US012565769B2

(12) United States Patent
Johnson

(10) Patent No.: US 12,565,769 B2
(45) Date of Patent: Mar. 3, 2026

(54) STRUCTURAL MODULE, SYSTEM, AND METHOD

(71) Applicant: NJ IP Holding Company LLC, Miami Beach, FL (US)

(72) Inventor: Neal Johnson, Miami Beach, FL (US)

(73) Assignee: NJIP Holding Company LLC, Miami Beach, FL (US)

( * ) Notice: Subject to any disclaimer, the term of this patent is extended or adjusted under 35 U.S.C. 154(b) by 328 days.

(21) Appl. No.: 18/308,482

(22) Filed: Apr. 27, 2023

(65) Prior Publication Data

US 2024/0360658 A1 Oct. 31, 2024

(51) Int. Cl.
*E04B 1/24* (2006.01)

(52) U.S. Cl.
CPC ..... *E04B 1/24* (2013.01); *E04B 2001/2415* (2013.01)

(58) Field of Classification Search
CPC ..... E04B 1/24; E04B 1/30; E04B 1/32; E04B 1/36; E04B 1/167; E04B 2001/2415; E04B 5/19; E04B 5/36; E04B 5/40; E04B 5/23; E04G 11/06; E04G 11/04
USPC ..... 52/126.1, 167.3; 249/29
See application file for complete search history.

(56) References Cited

U.S. PATENT DOCUMENTS 4,090,336 A * 5/1978 Carroll ..... E04D 13/1606 428/312.4
4,592,184 A * 6/1986 Person ..... E04B 5/40 52/694
4,653,237 A * 3/1987 Taft ..... E04B 5/40 52/693
4,972,537 A * 11/1990 Slaw, Sr. ..... E04B 5/04 14/77.1
5,111,628 A * 5/1992 Desjoyaux ..... E04H 4/0081 249/35

(Continued)

FOREIGN PATENT DOCUMENTS

CN 210177688 3/2020
CN 115977462 4/2023

OTHER PUBLICATIONS

International Search Report and Written Opinion for International Application No. PCT/US2024/026007, mailed Sep. 20, 2024, 11 Pages.

*Primary Examiner* — Paola Agudelo
(74) *Attorney, Agent, or Firm* — DLA Piper LLP (US)

(57) ABSTRACT

A containerized, transportable, pre-engineered, pre-fabricated, pre-assembled, adjustable, structural module and structural module system and method is disclosed, having one or more beams to provide desired construction dimensions; and a first beam of the one or more beams, the first beam having deflection reduction properties. The structural module is not supported by shoring when the structural fixture is placed for construction. The structural modules may be expanded and contracted to vary the height, length, and width of the structural module based on building specifications or desired construction dimensions. A second beam having deflection reduction properties has the same orientation as the first beam when the structural module is placed for construction. One or more sheets are affixed to at least one of the one or more beams, wherein the one or more sheets provide a surface for concrete or building material to be poured on the one or more sheets.

8 Claims, 48 Drawing Sheets

(56) References Cited

U.S. PATENT DOCUMENTS

| | | | | |
|---|---|---|---|---|
| 5,941,035 | A * | 8/1999 | Purse | E04B 5/40 52/263 |
| 6,804,923 | B1 * | 10/2004 | Potter | E04B 5/04 52/480 |
| 7,389,620 | B1 * | 6/2008 | McManus | E04B 5/40 52/414 |
| 8,245,469 | B2 * | 8/2012 | Rubel | E04B 5/48 52/223.6 |
| 8,950,143 | B2 * | 2/2015 | Studebaker | F16B 25/0031 52/319 |
| 2013/0074433 | A1 * | 3/2013 | Ciuperca | E04B 1/41 52/698 |
| 2014/0298745 | A1 * | 10/2014 | Rechenmacher | E04H 1/005 52/425 |
| 2016/0251844 | A1 | 9/2016 | Allen et al. | |
| 2017/0237389 | A1 | 8/2017 | Hudson et al. | |
| 2021/0131100 | A1 * | 5/2021 | Lim | E04B 5/36 |

* cited by examiner

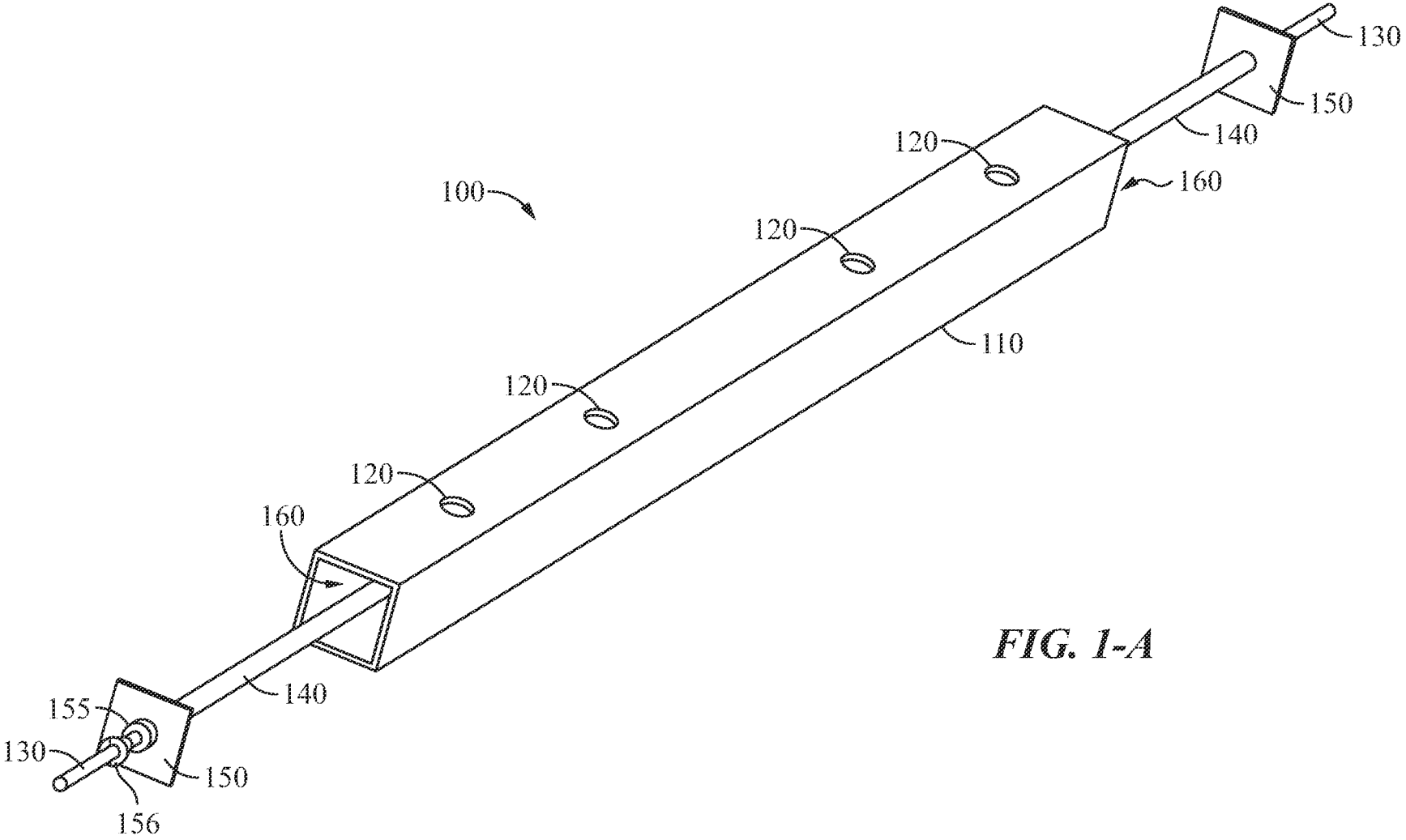
FIG. 1-A

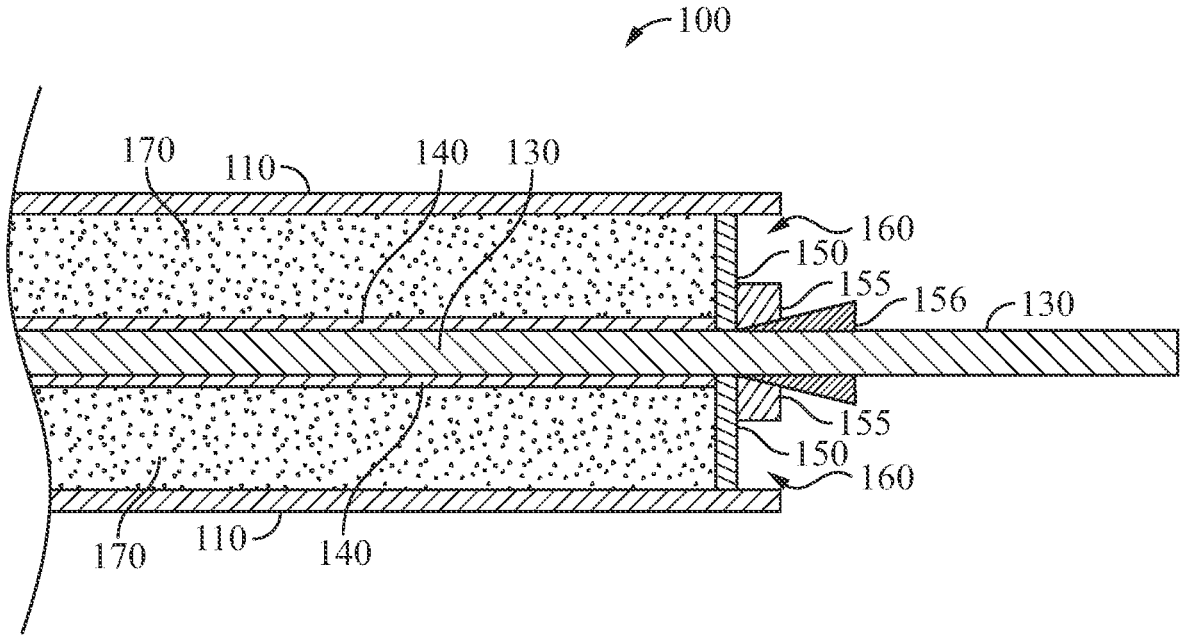
*FIG. 1-B*

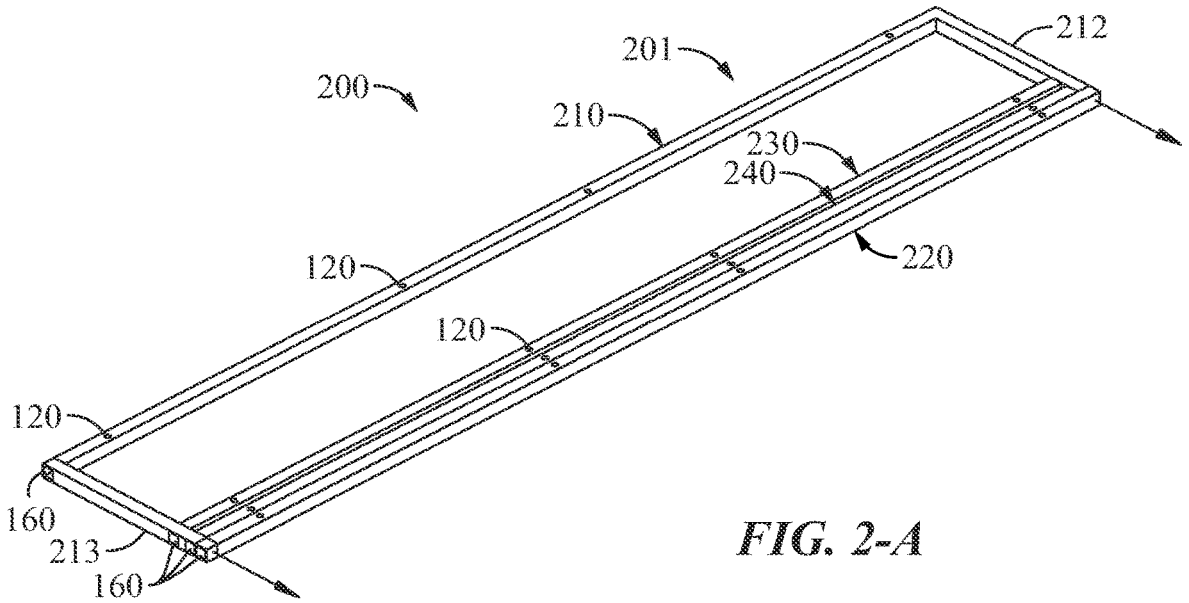
FIG. 2-A

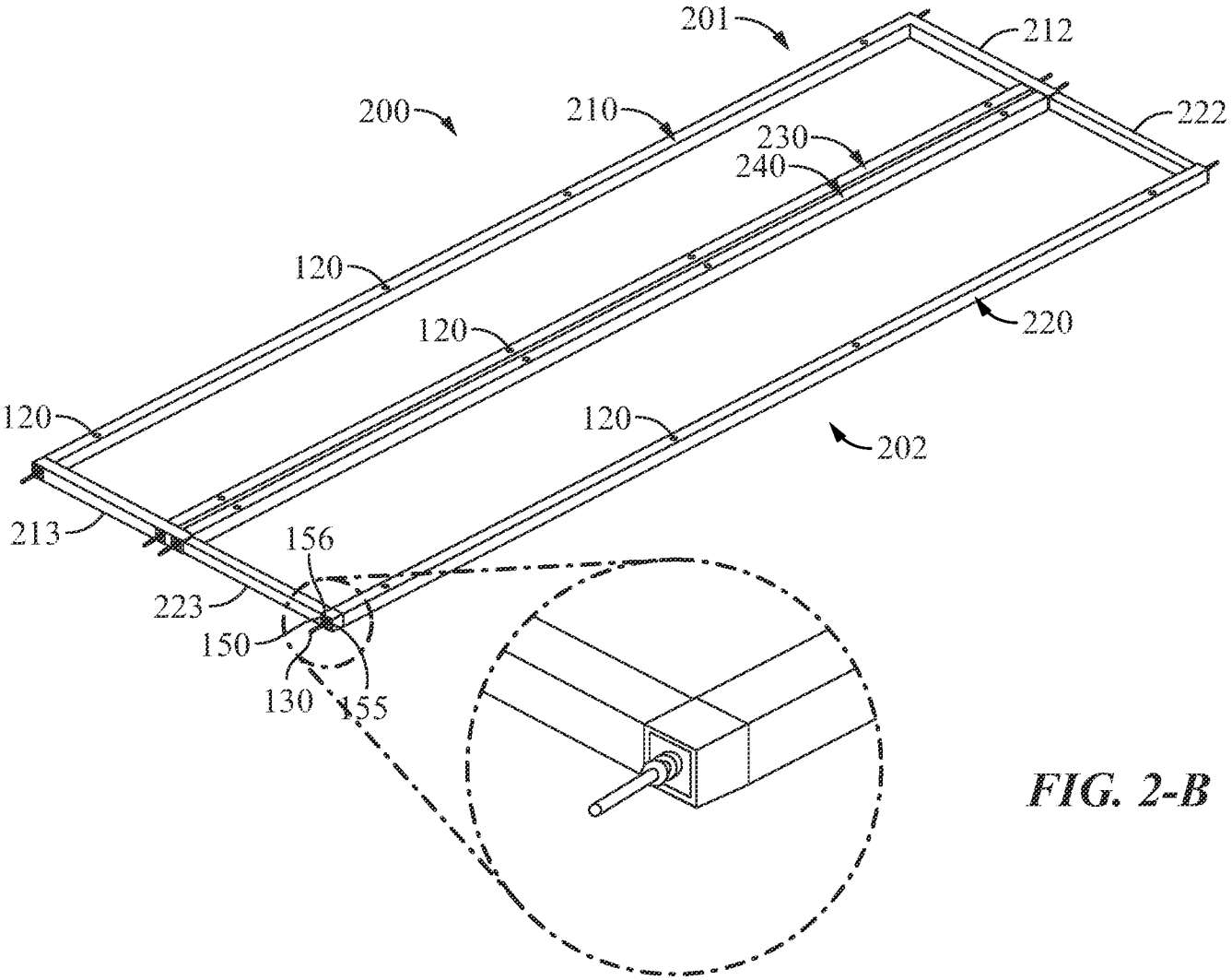
FIG. 2-B

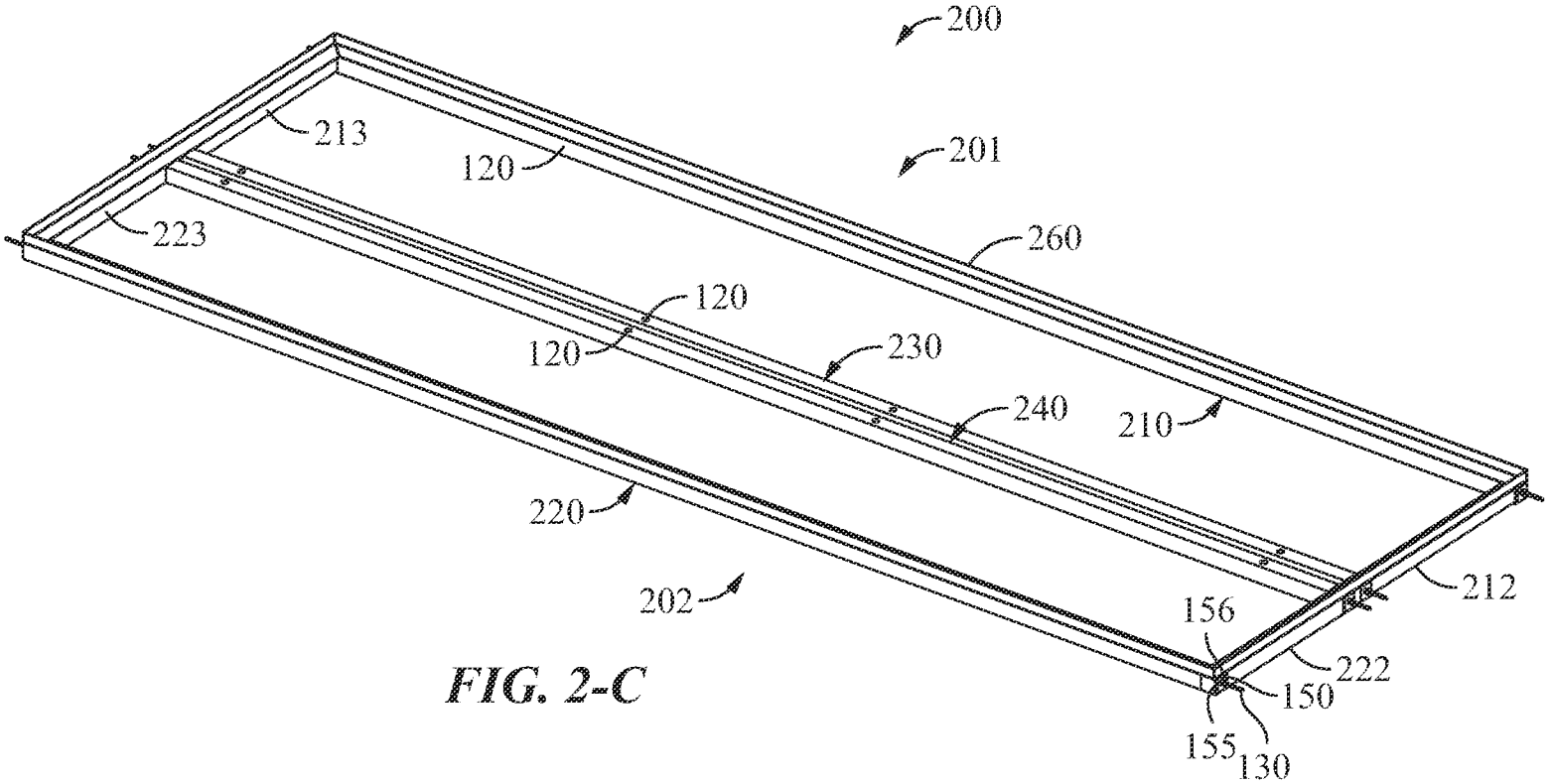
FIG. 2-C

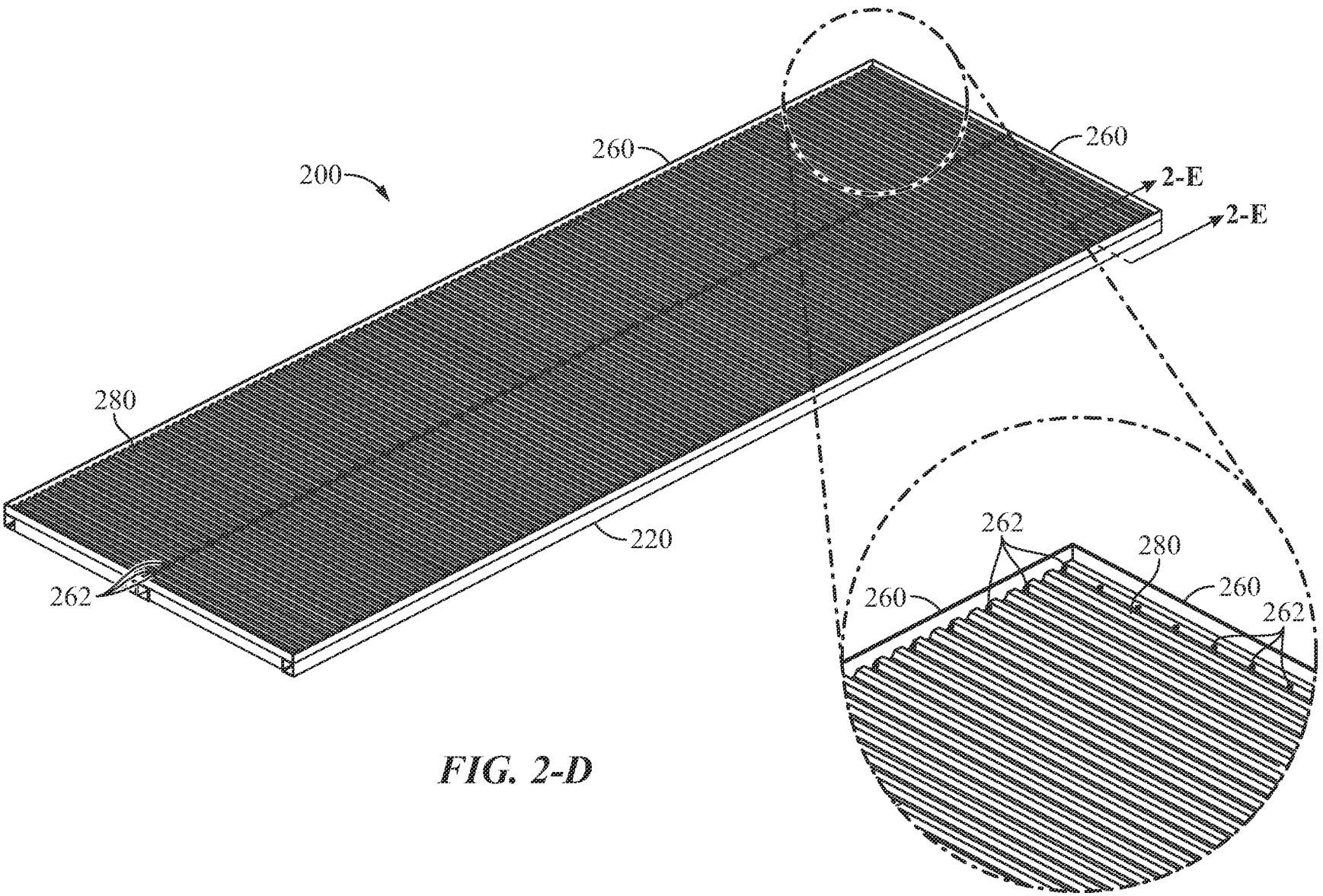
FIG. 2-D

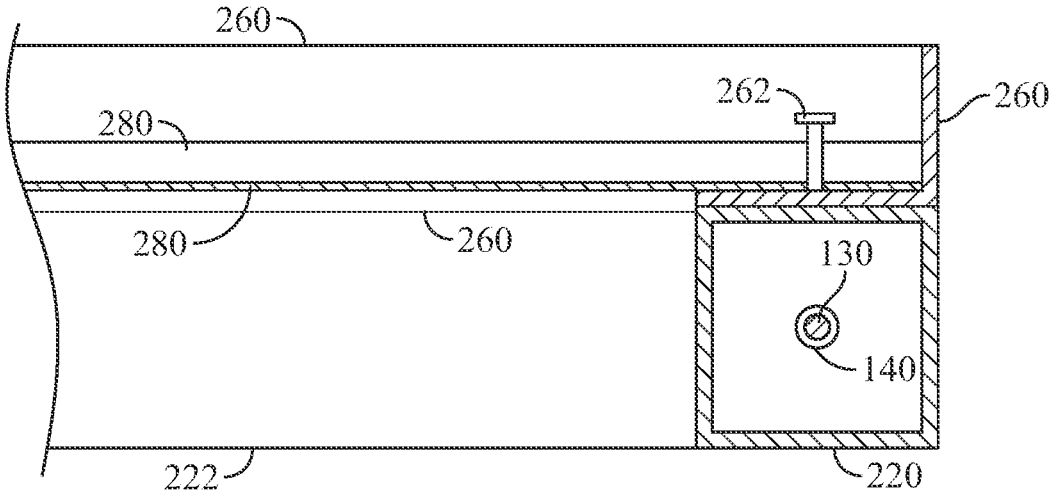
*FIG. 2-E*

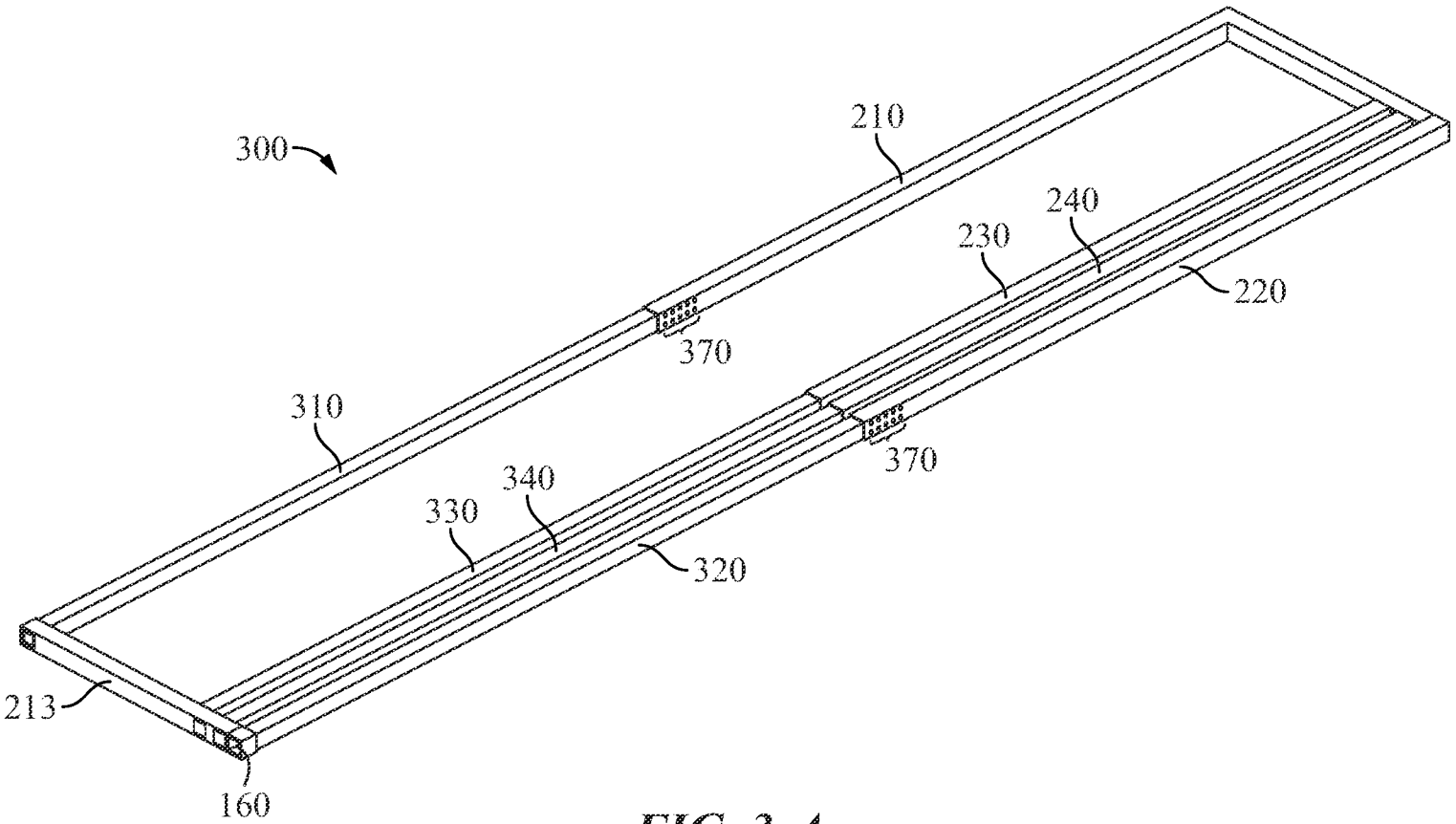
FIG. 3-A

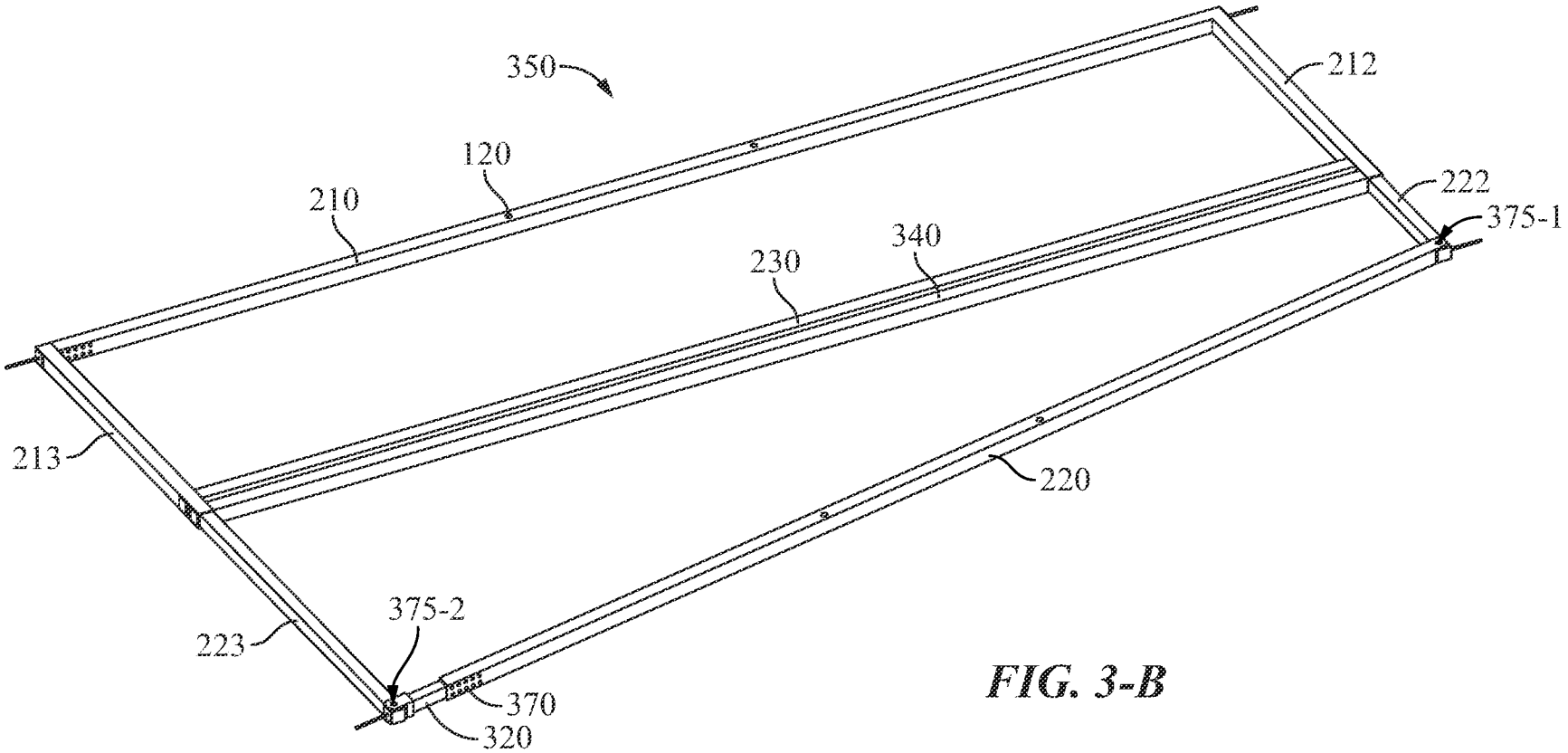
FIG. 3-B

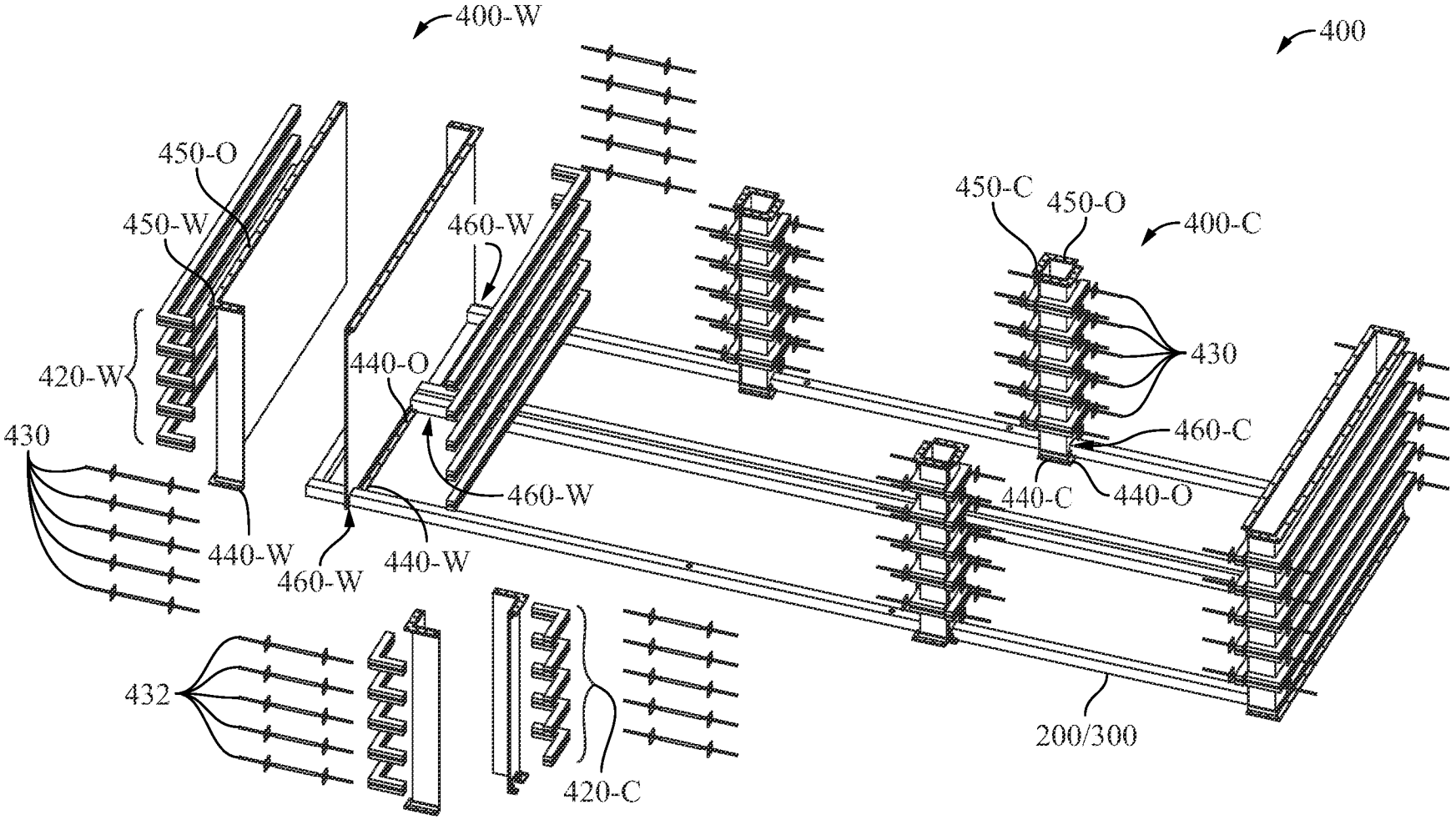
FIG. 4-A

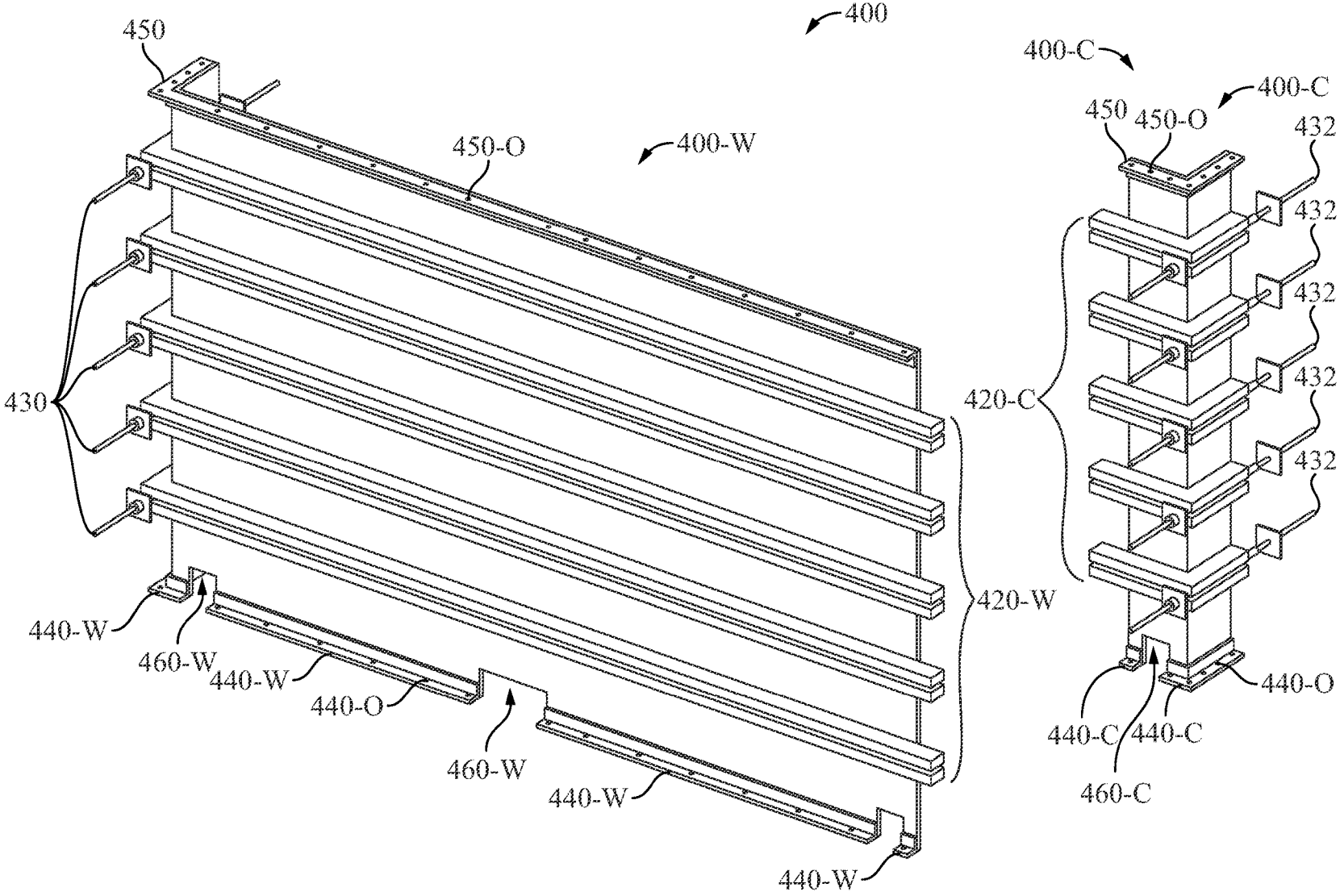
FIG. 4-B

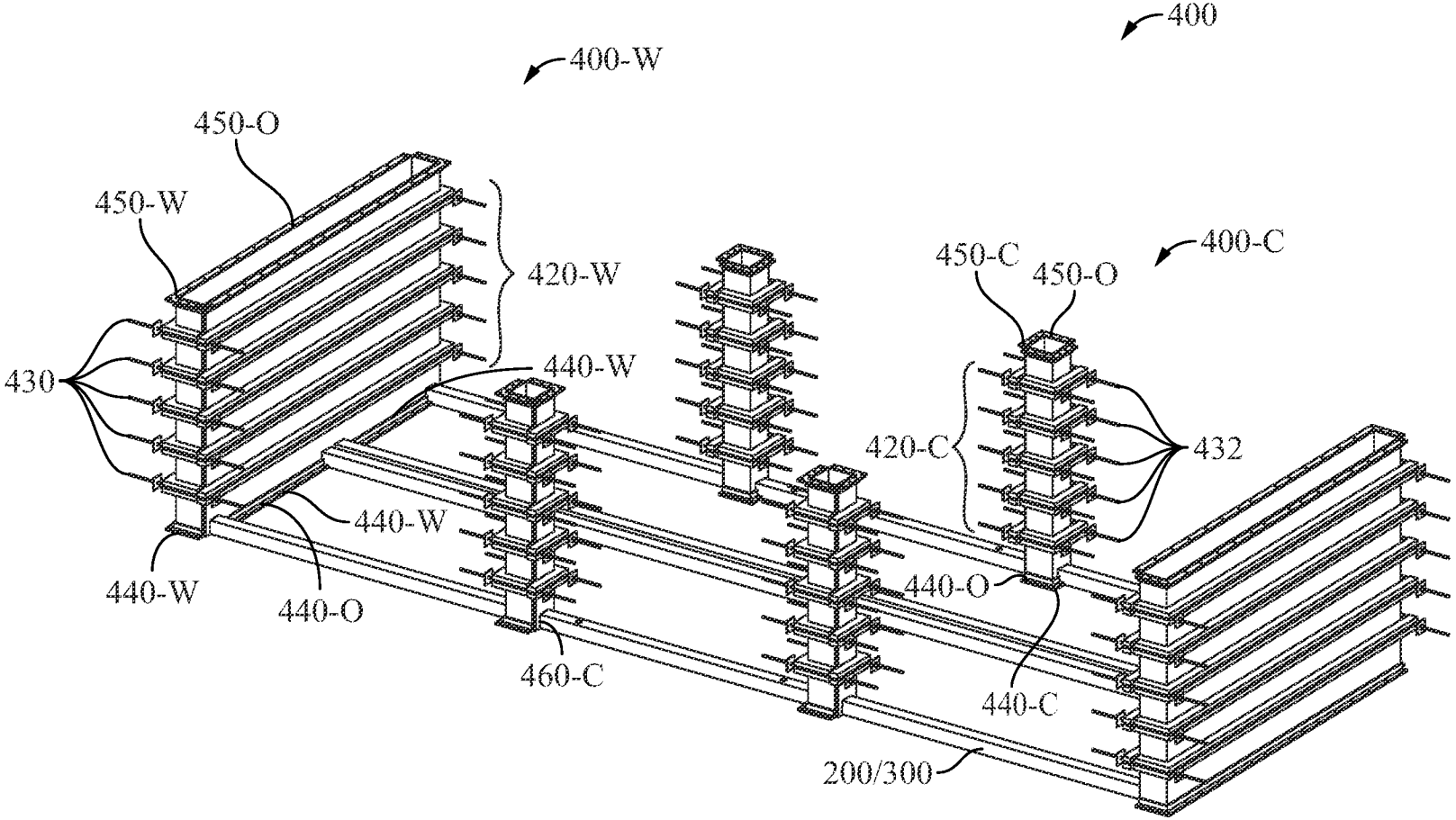
FIG. 4-C

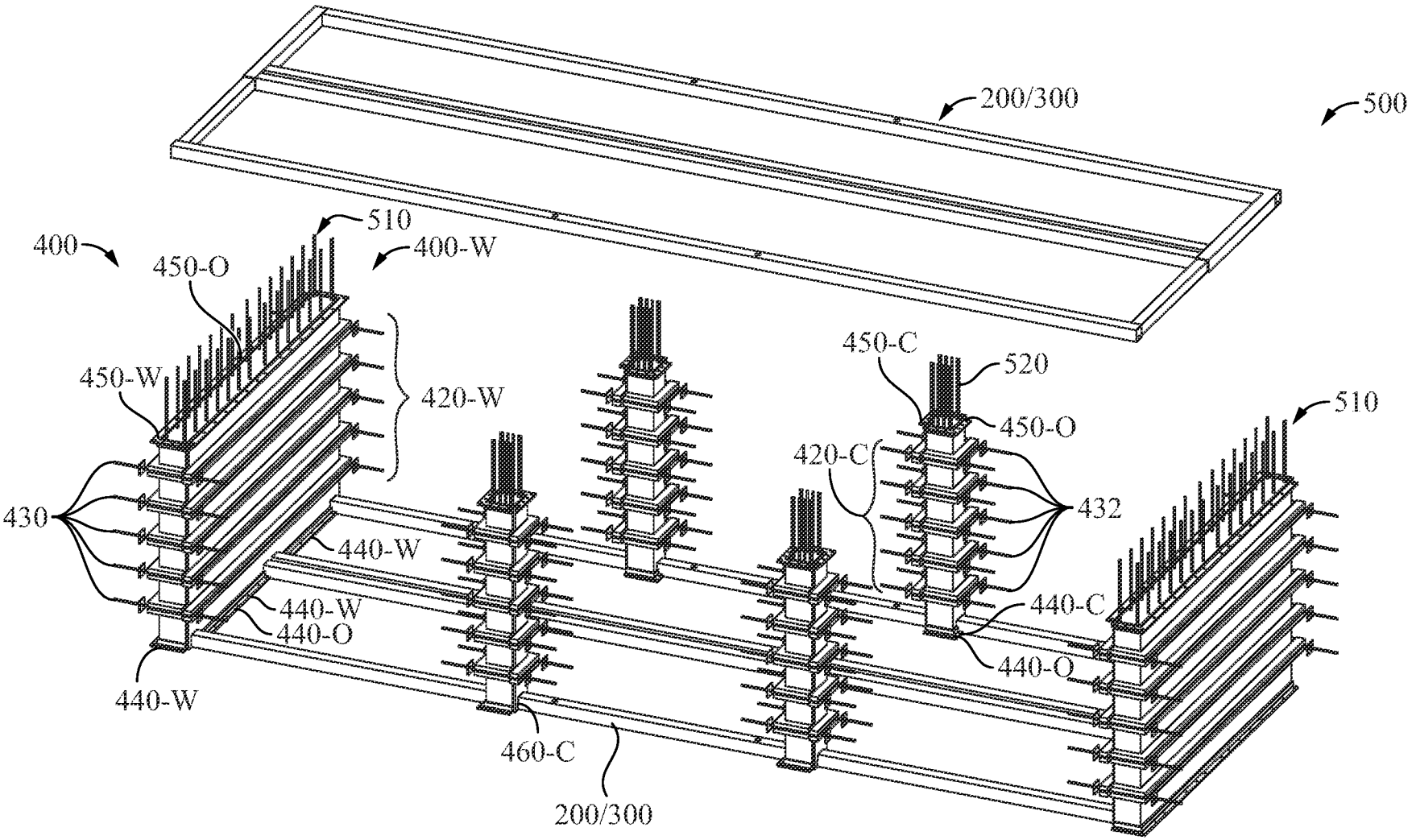
FIG. 5-A

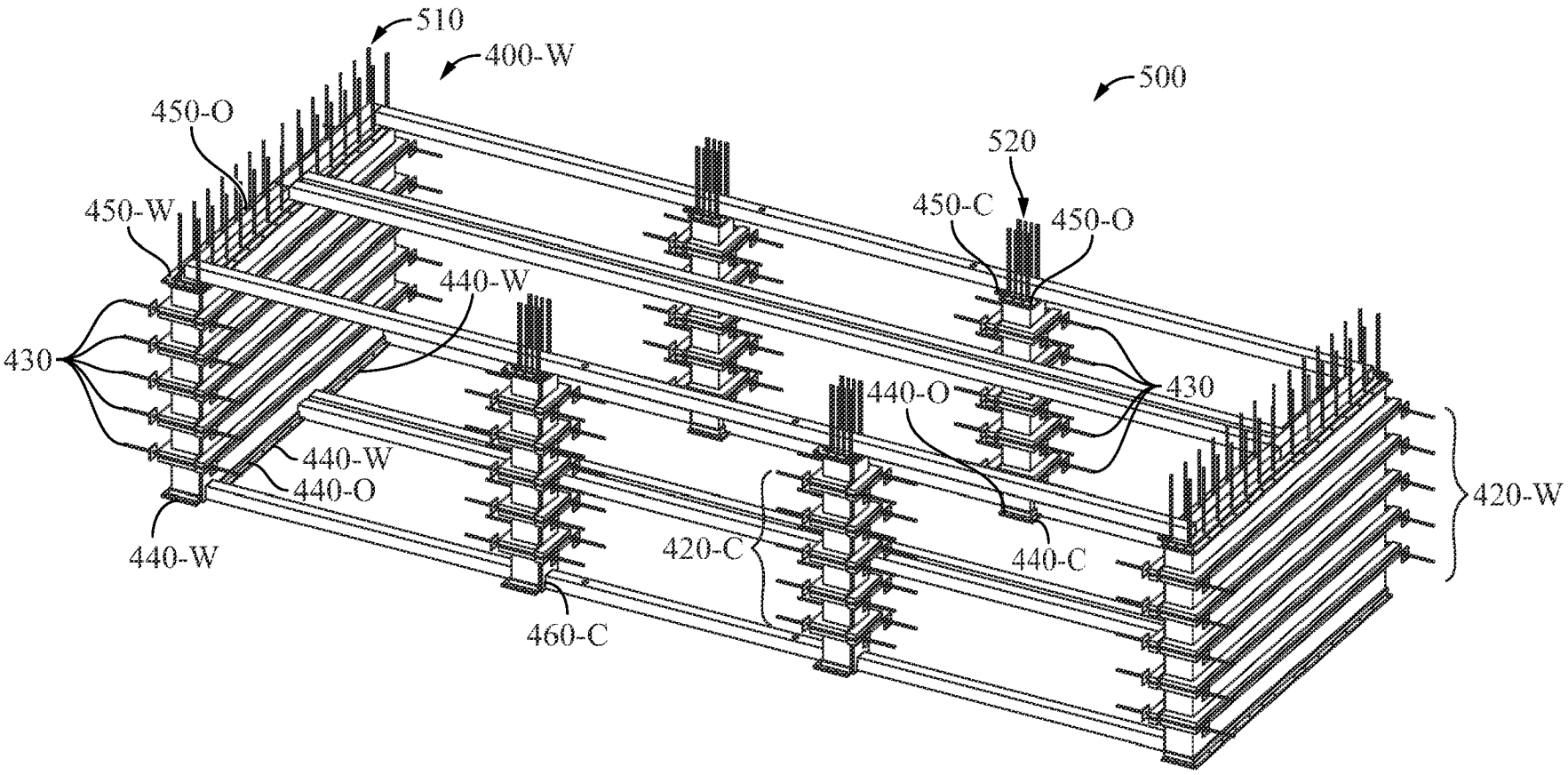
FIG. 5-B

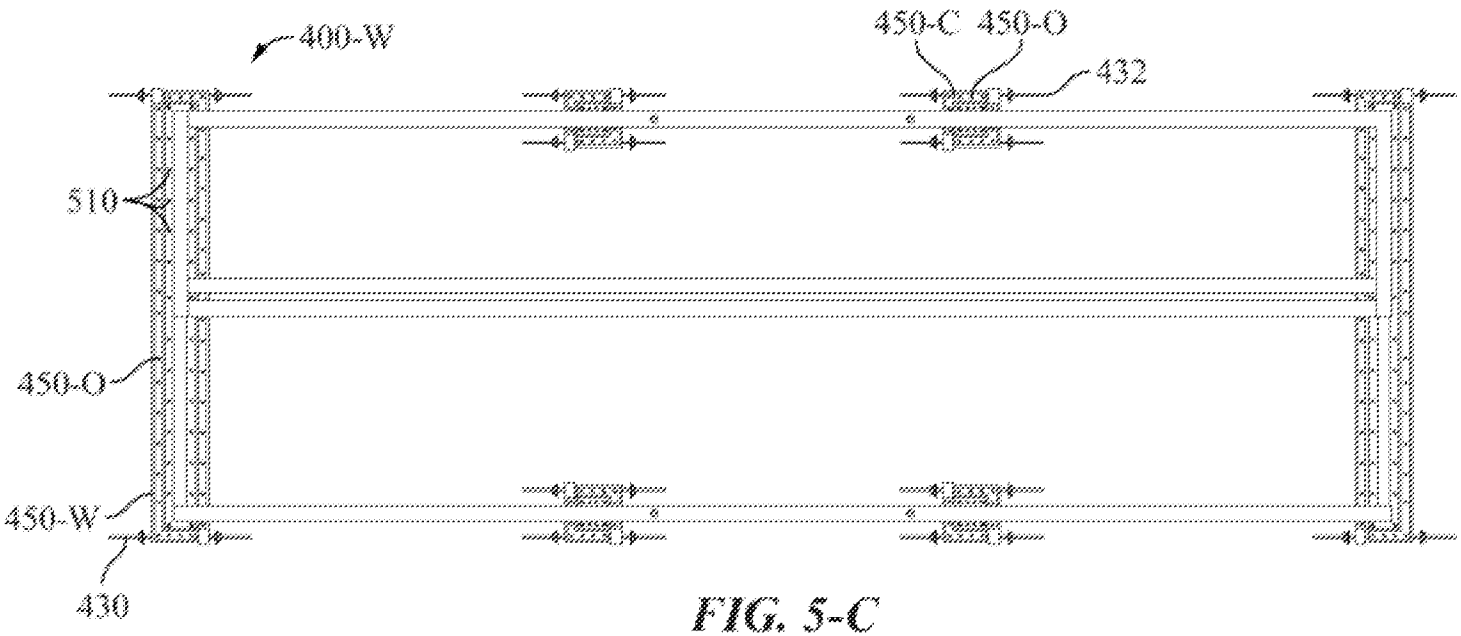
FIG. 5-C
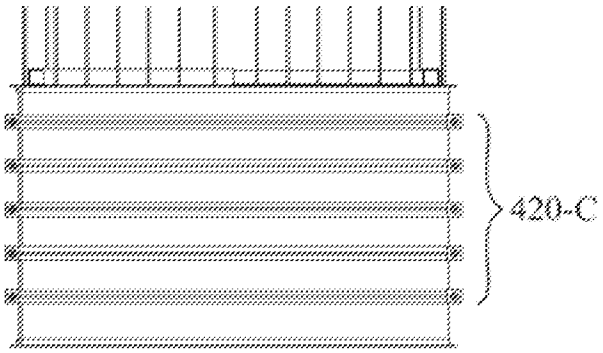
FIG. 5-D

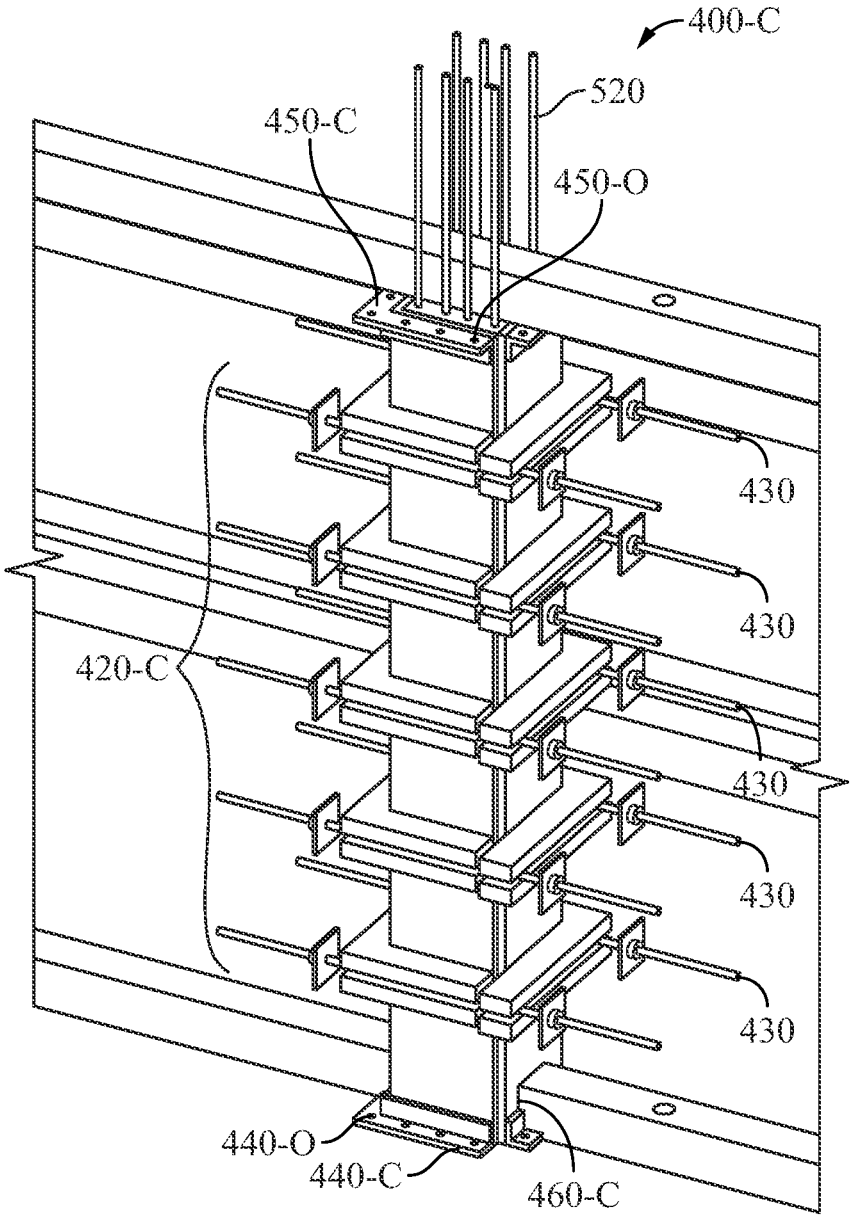
*FIG. 5-E*

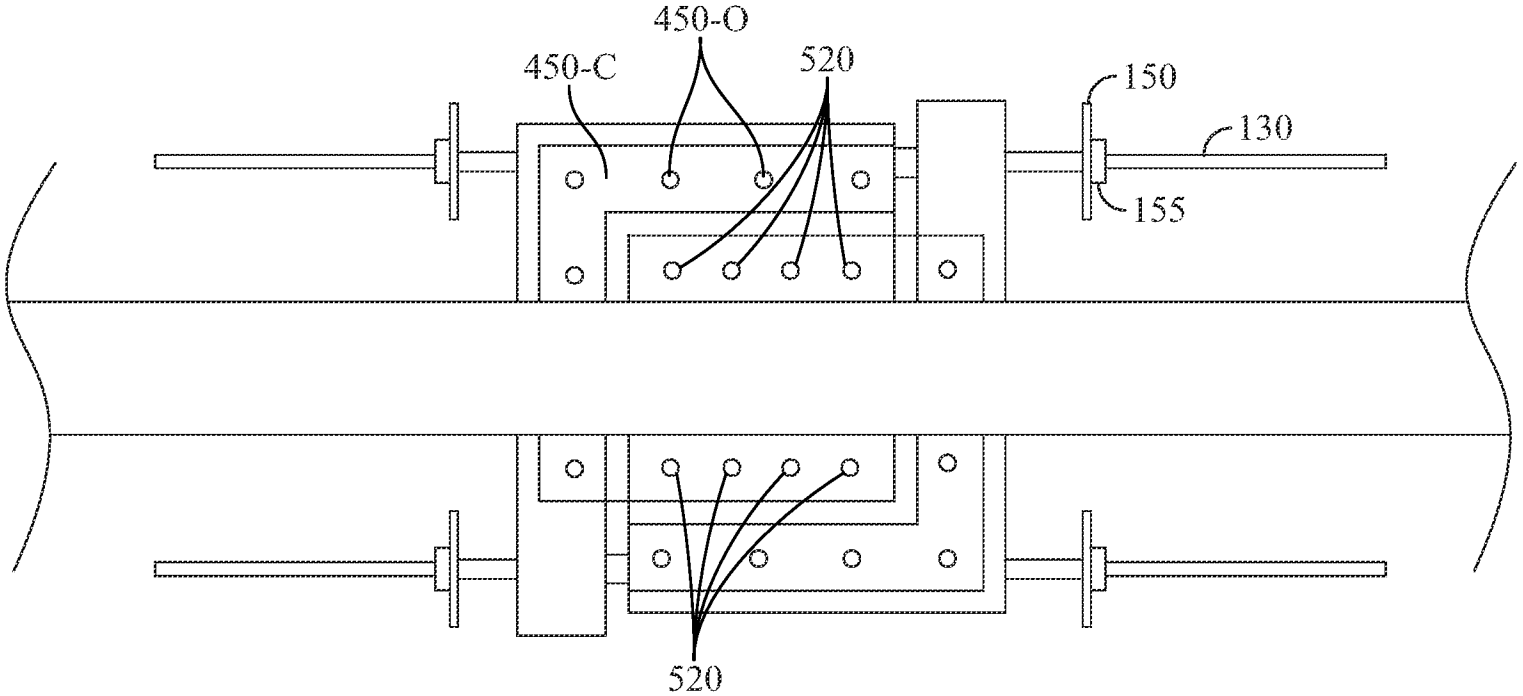
FIG. 5-F

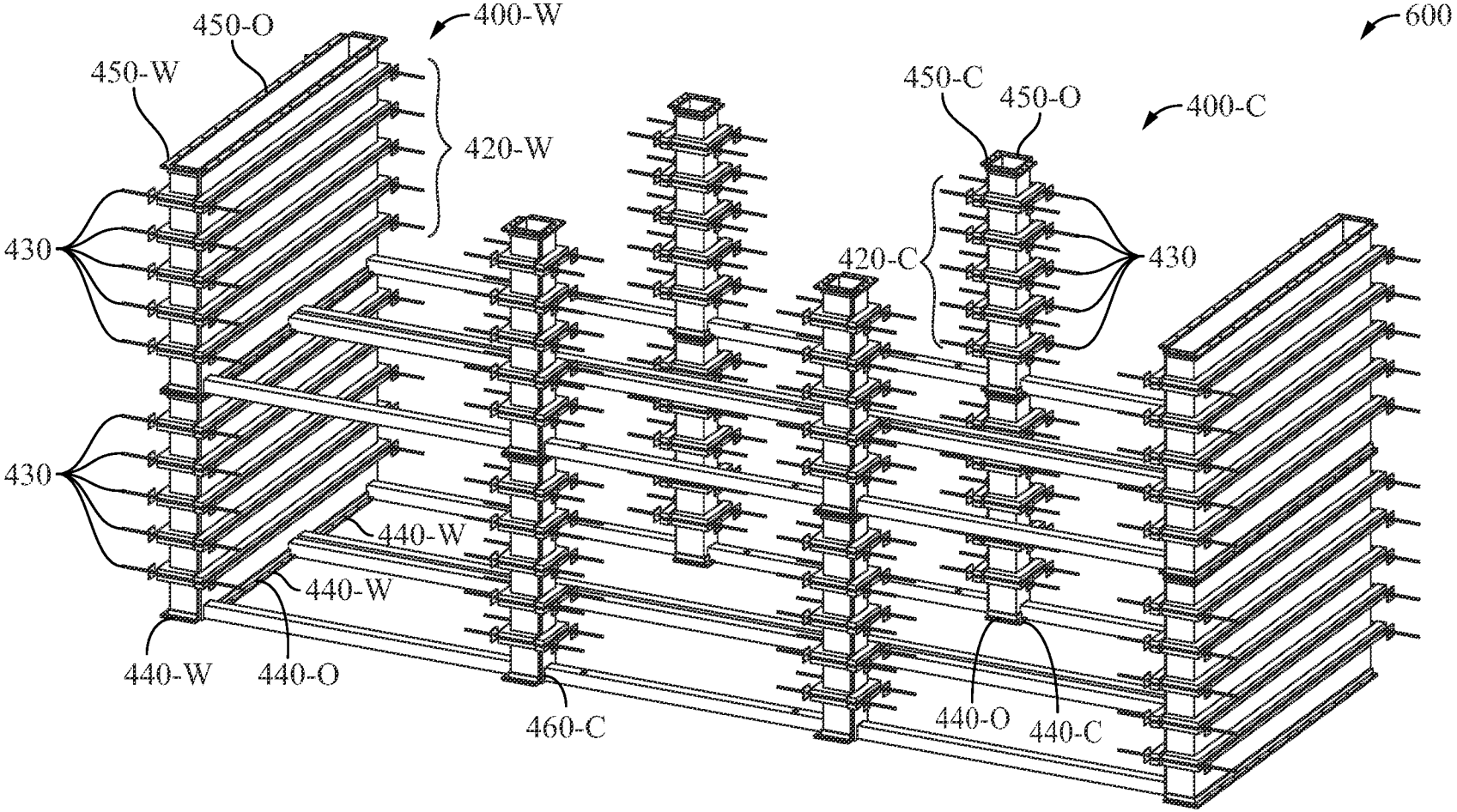
FIG. 6-A

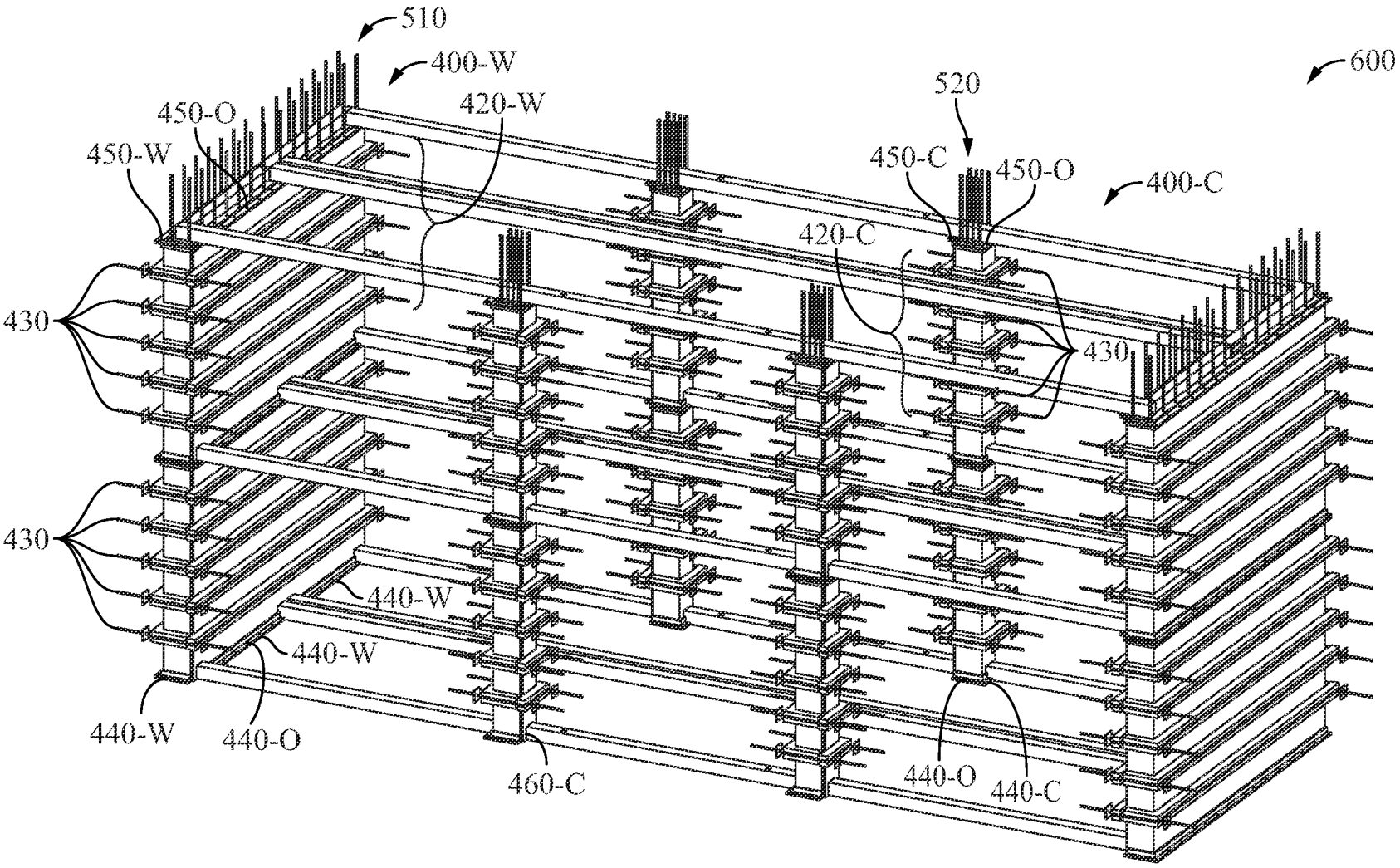
FIG. 6-B

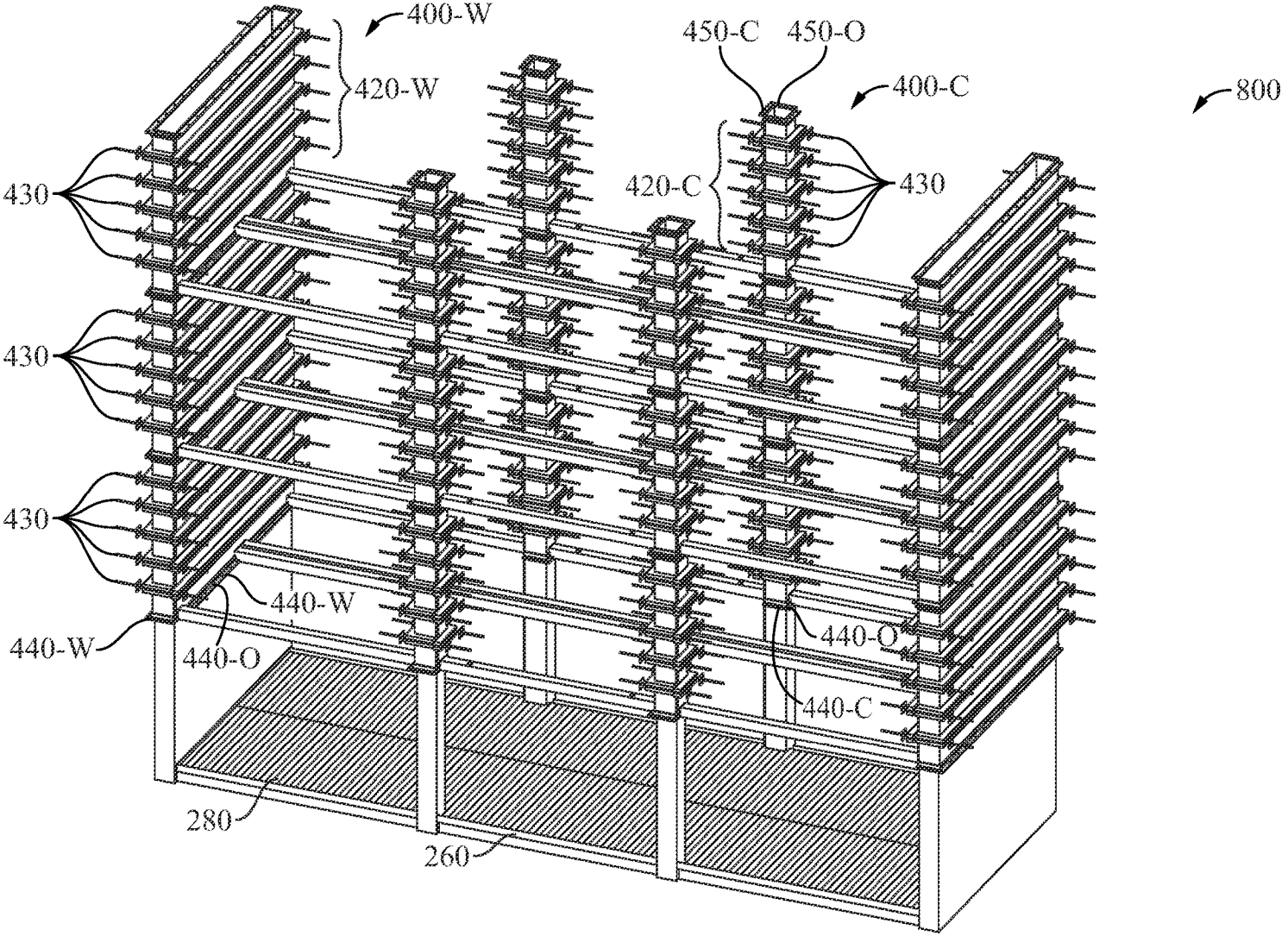
FIG. 8-A

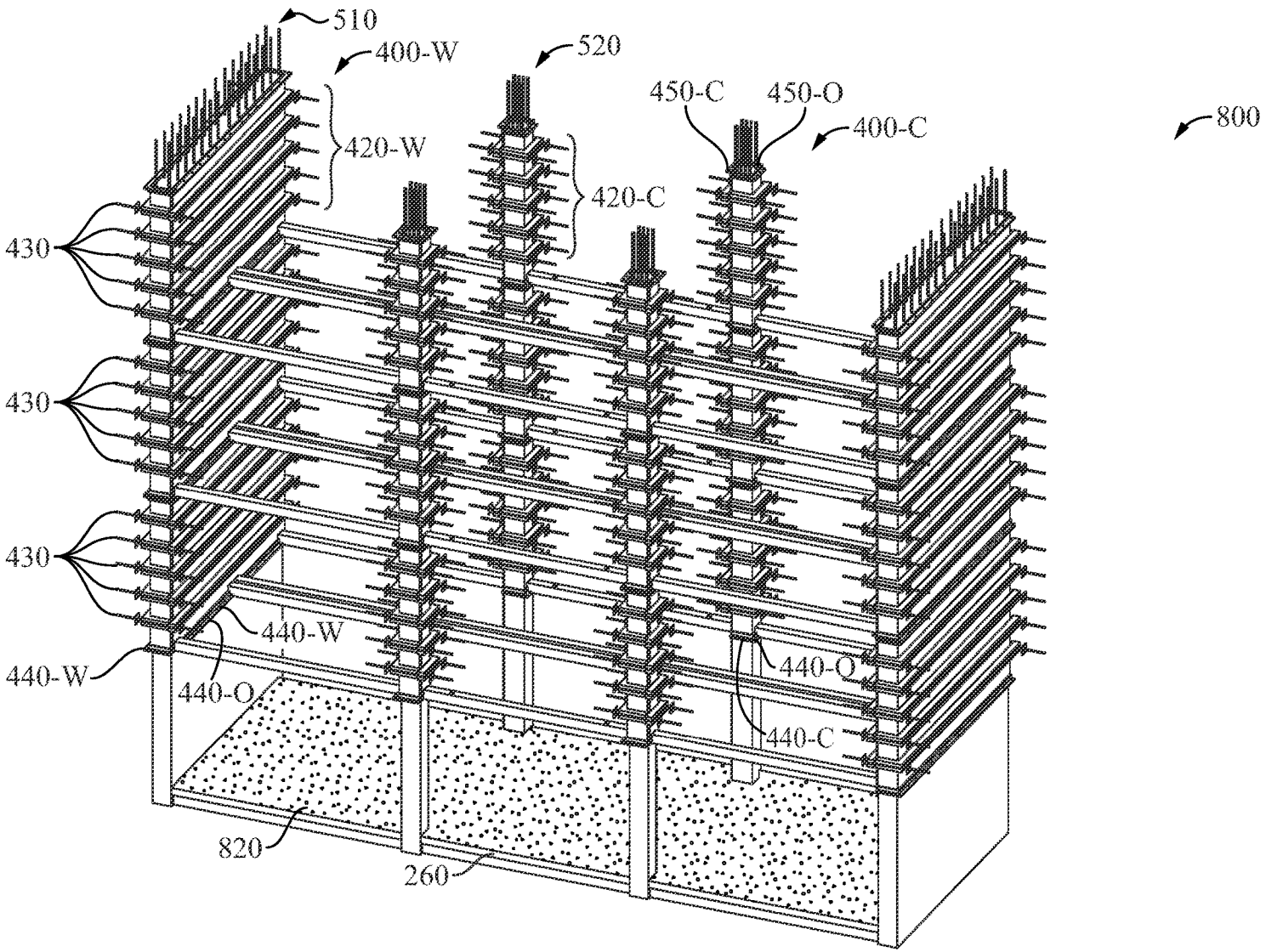
FIG. 8-B

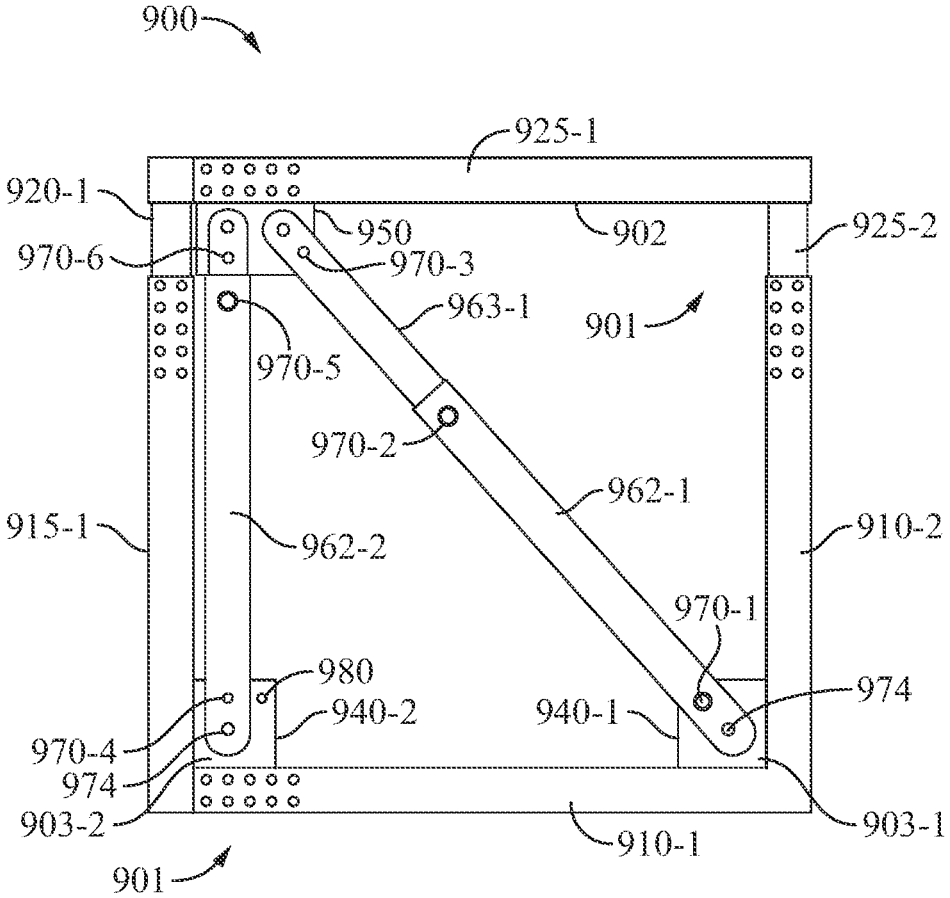
*FIG. 9-A*

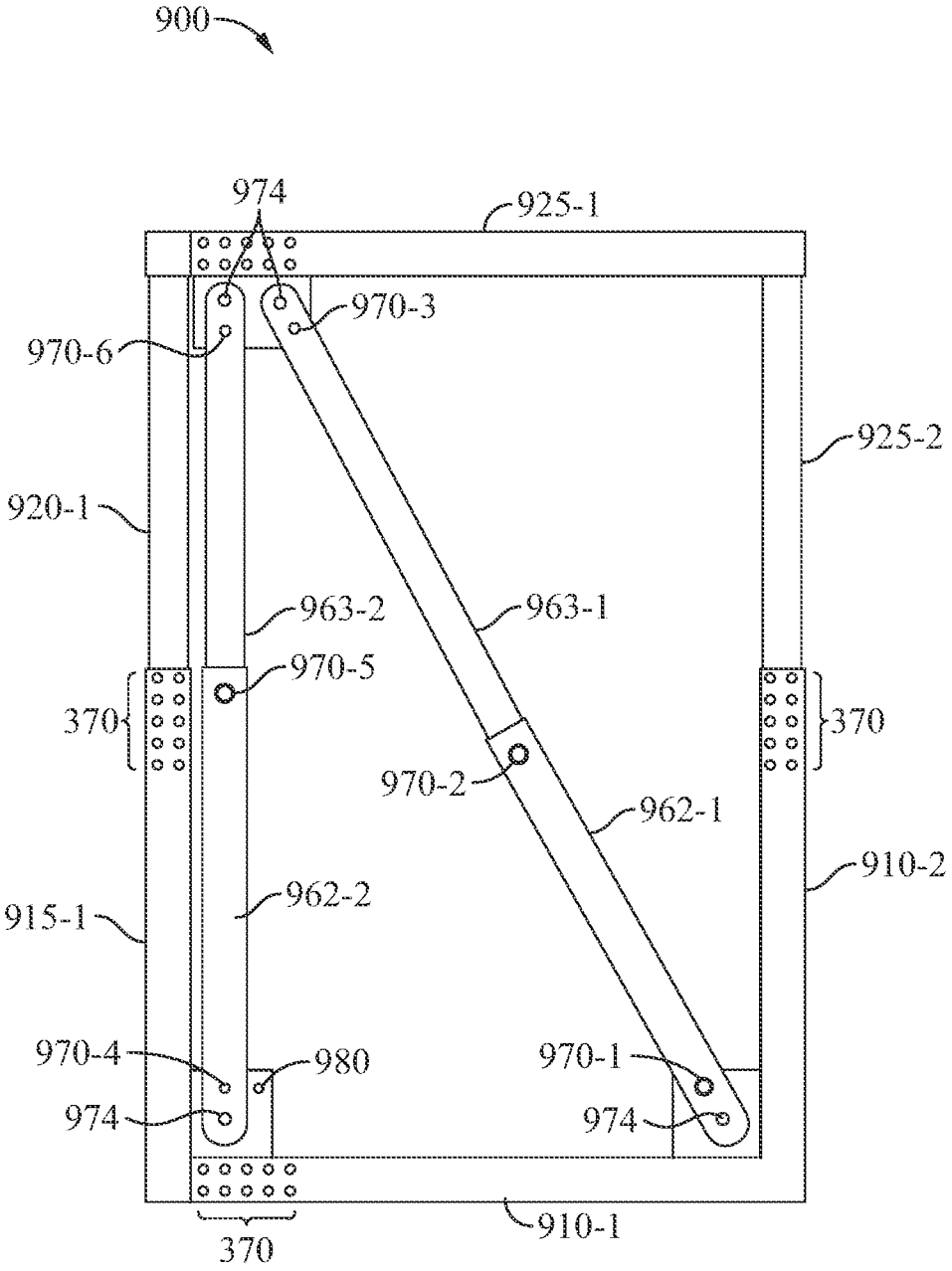
*FIG. 9-B*

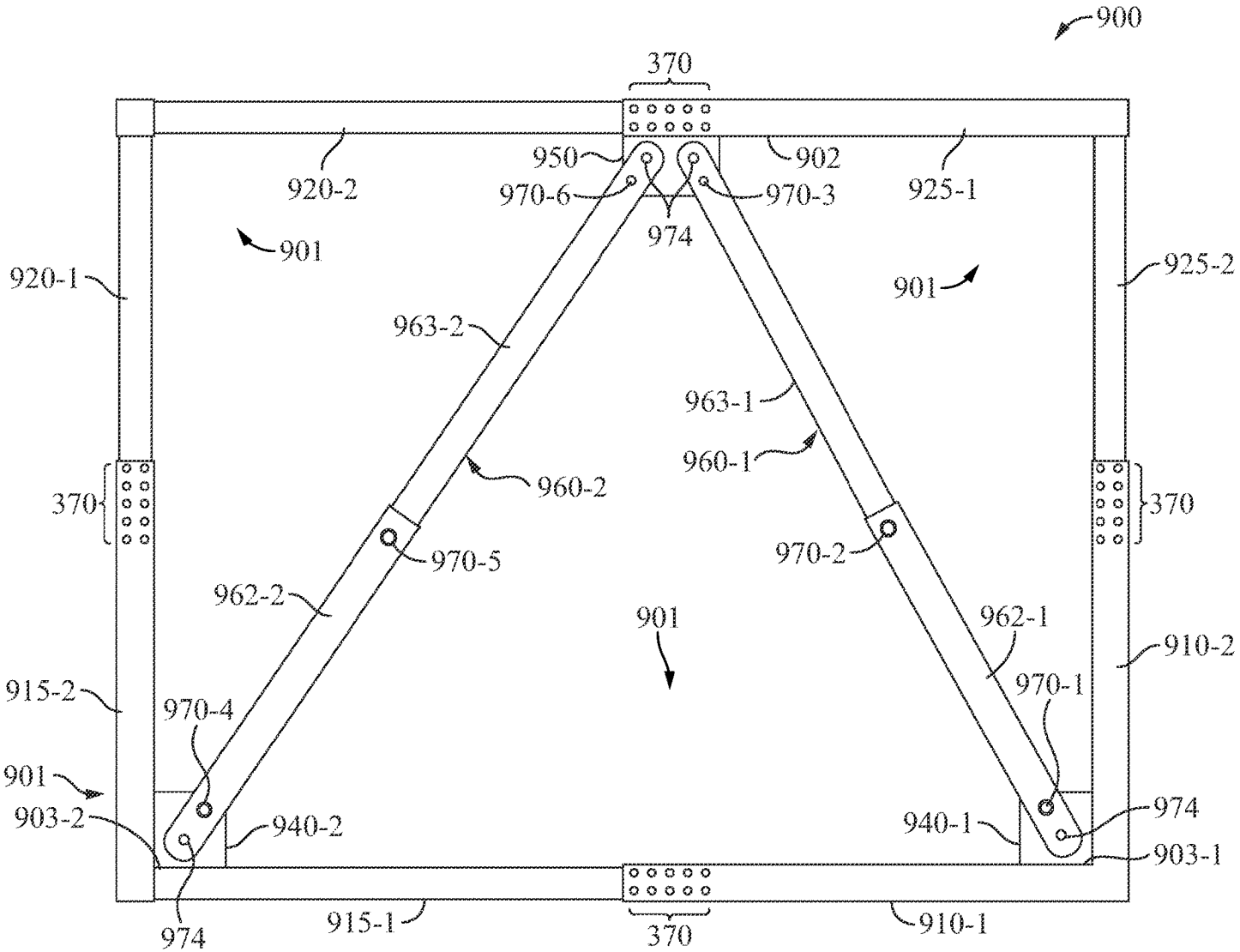
FIG. 9-C

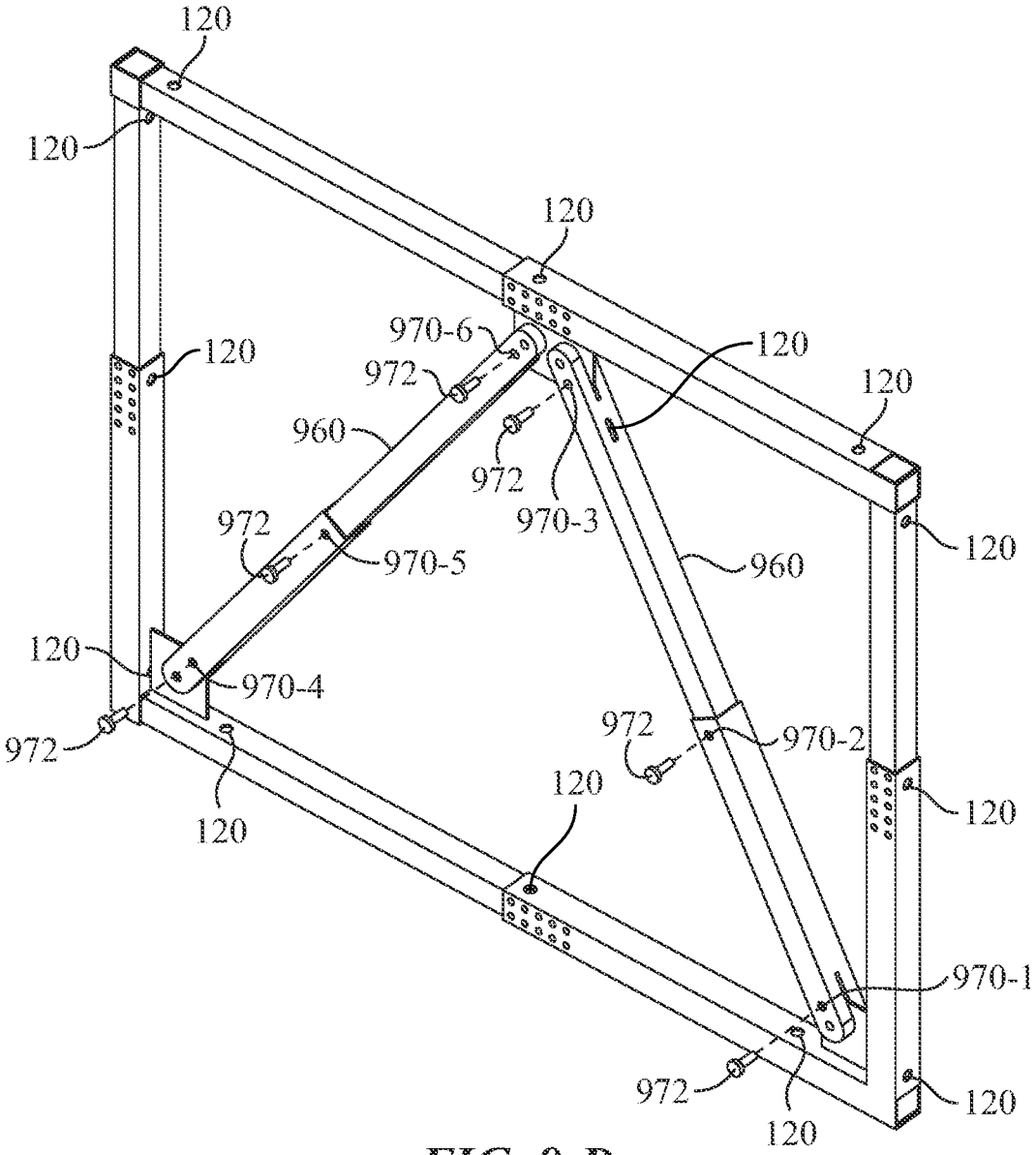
*FIG. 9-D*

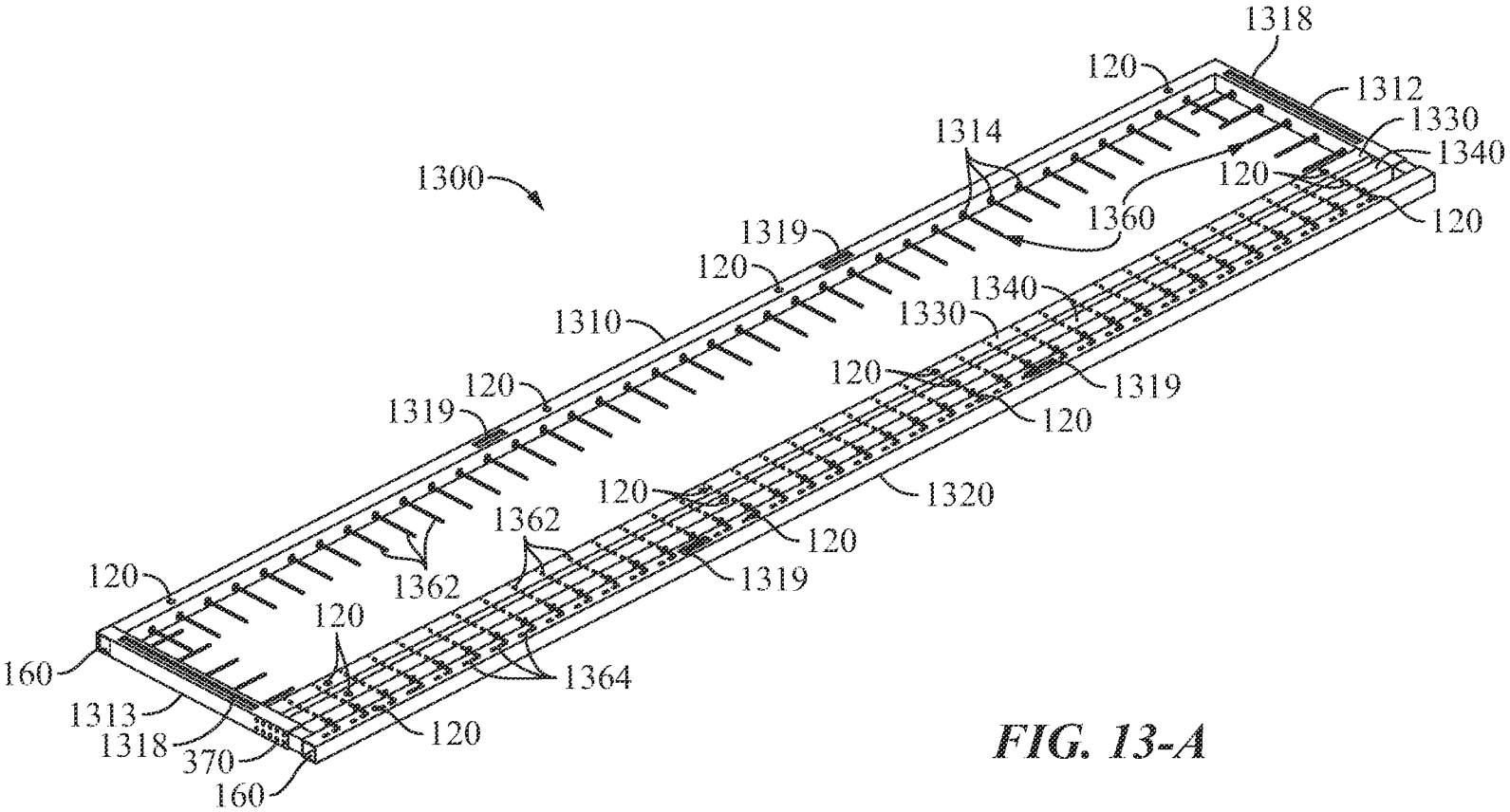
FIG. 13-A

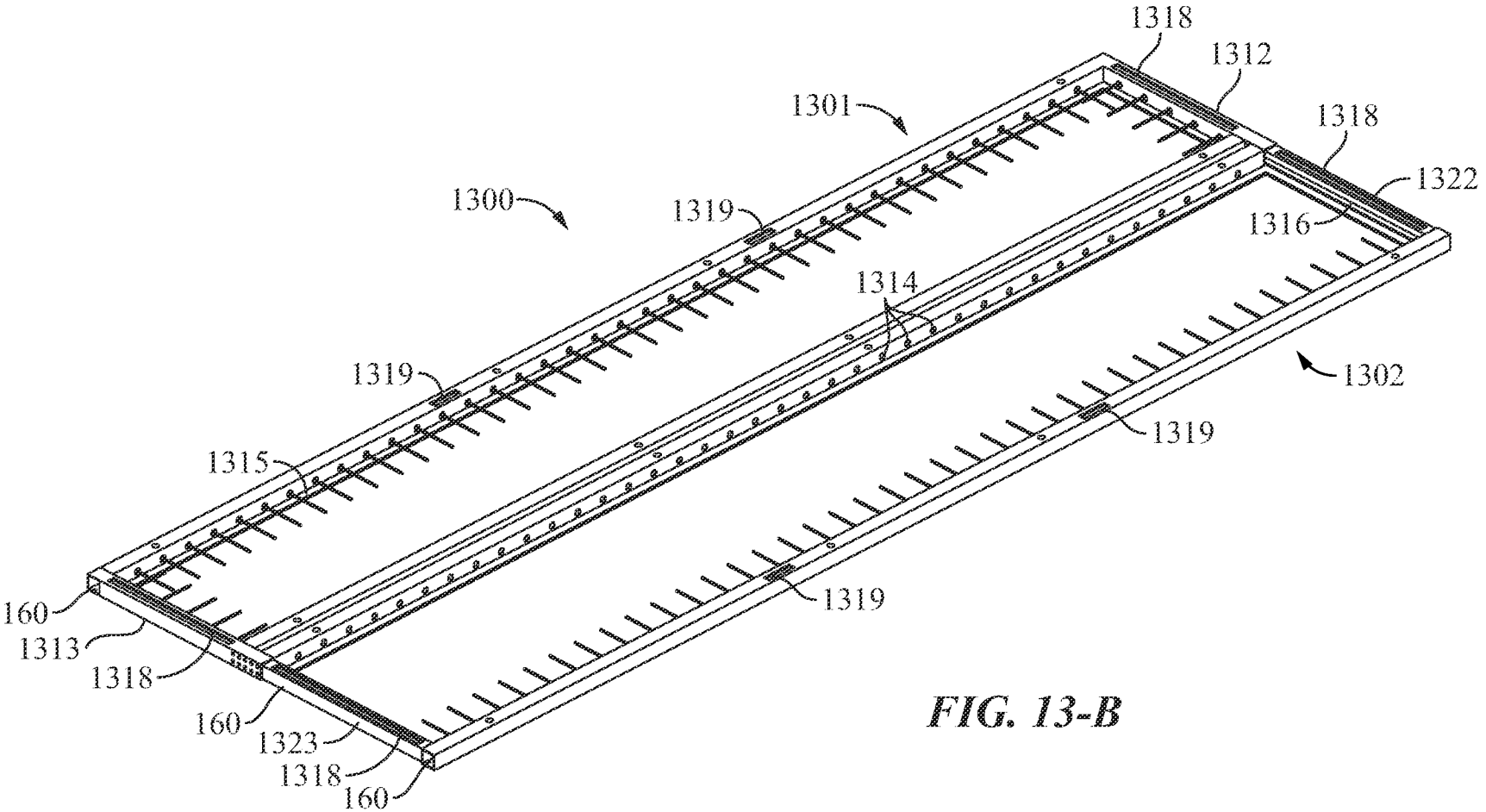
FIG. 13-B

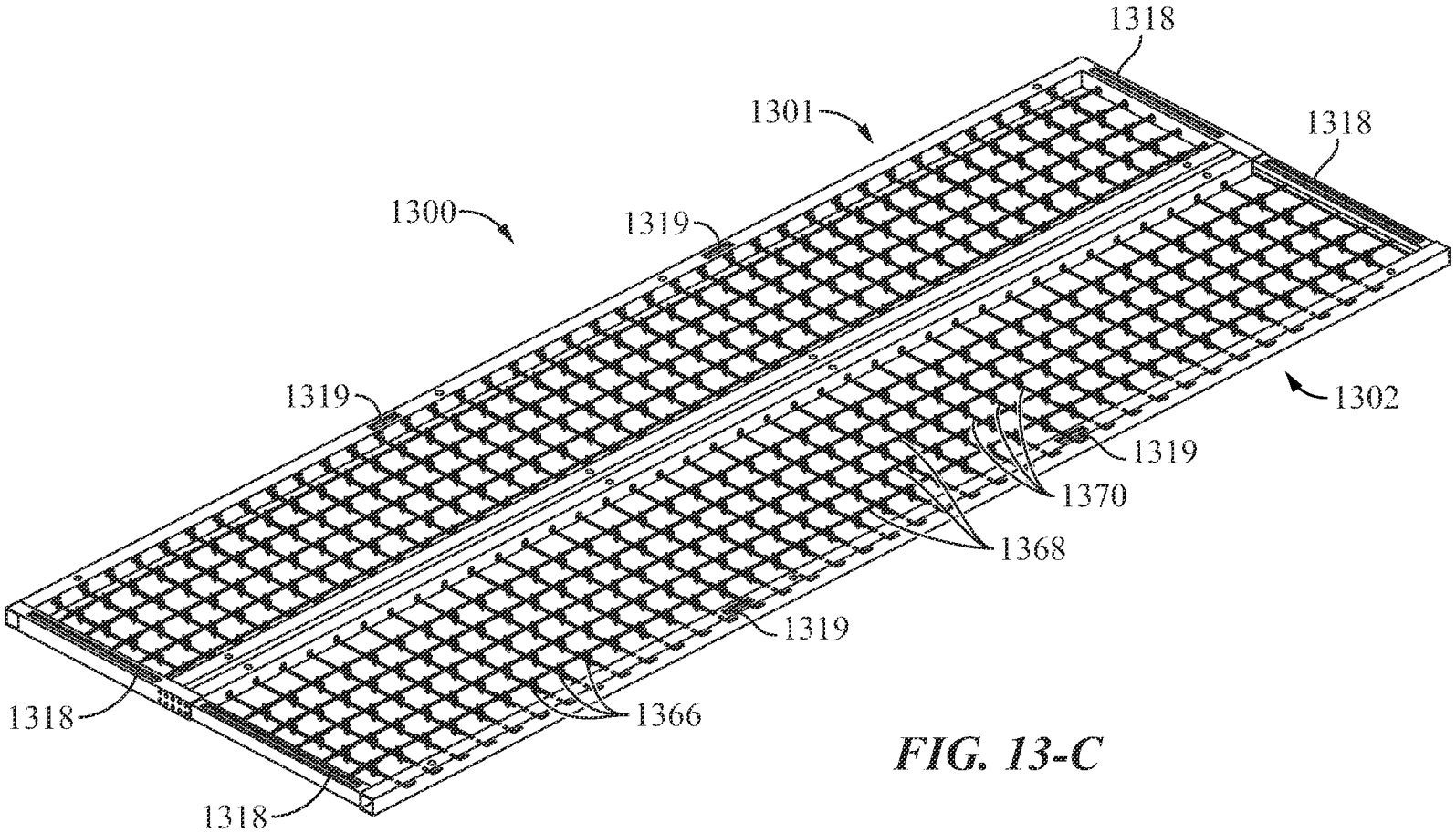
FIG. 13-C

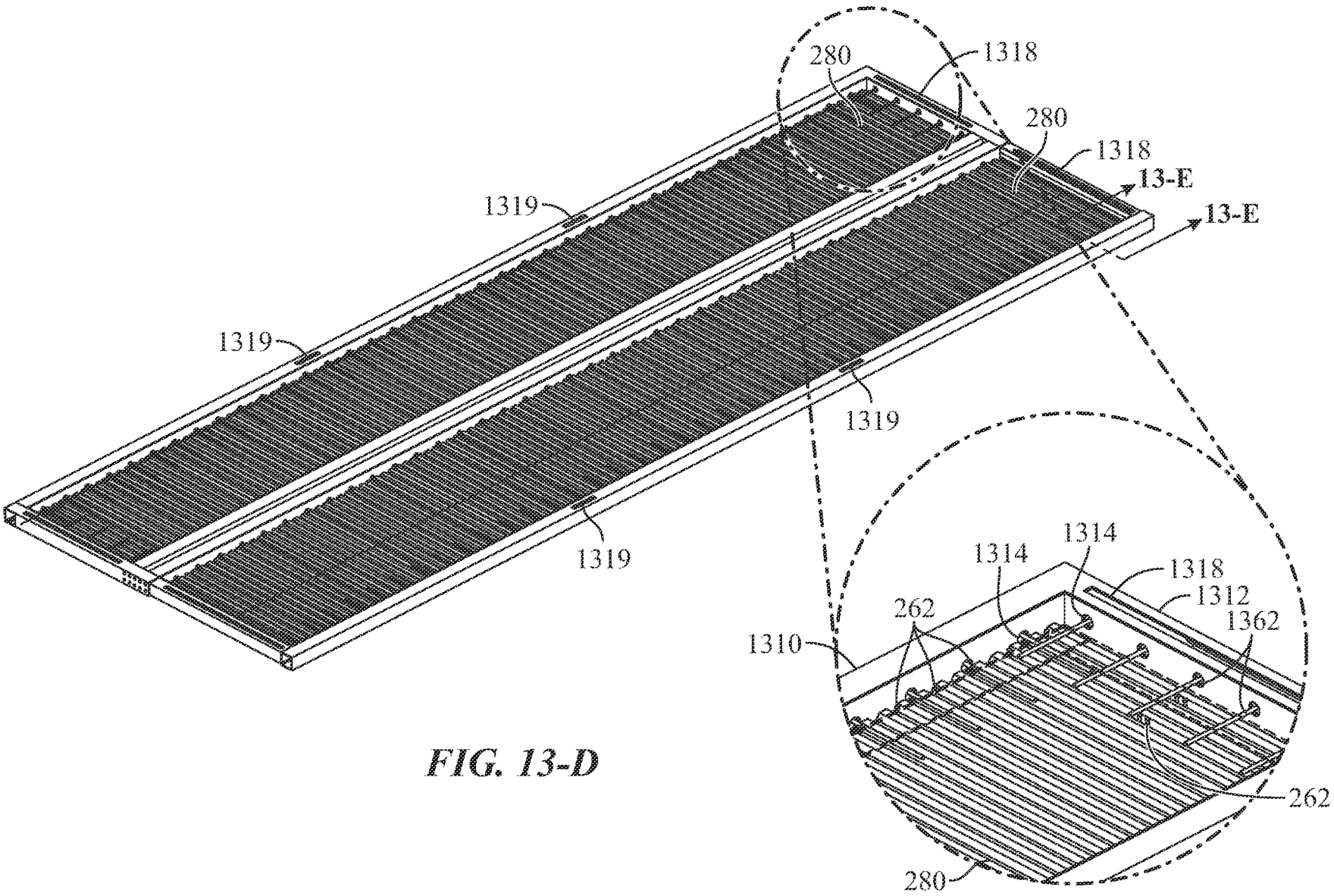
FIG. 13-D

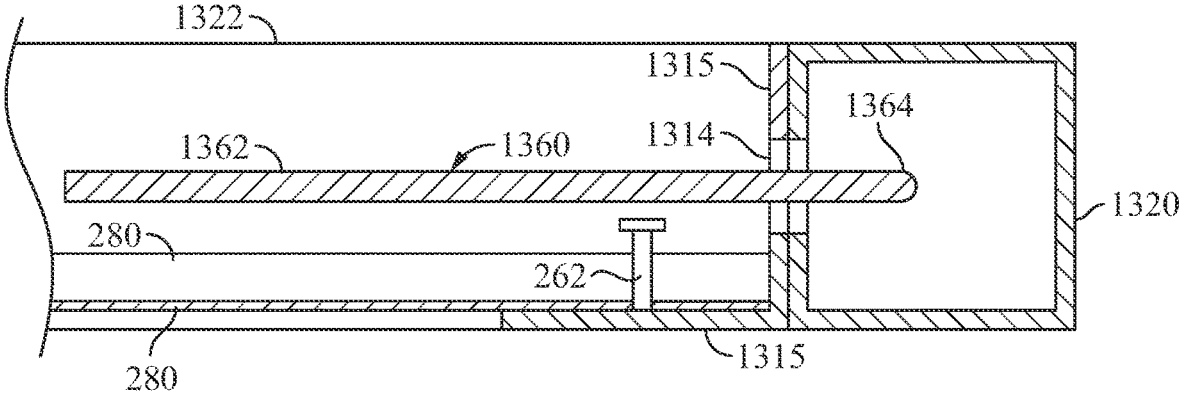
*FIG. 13-E*

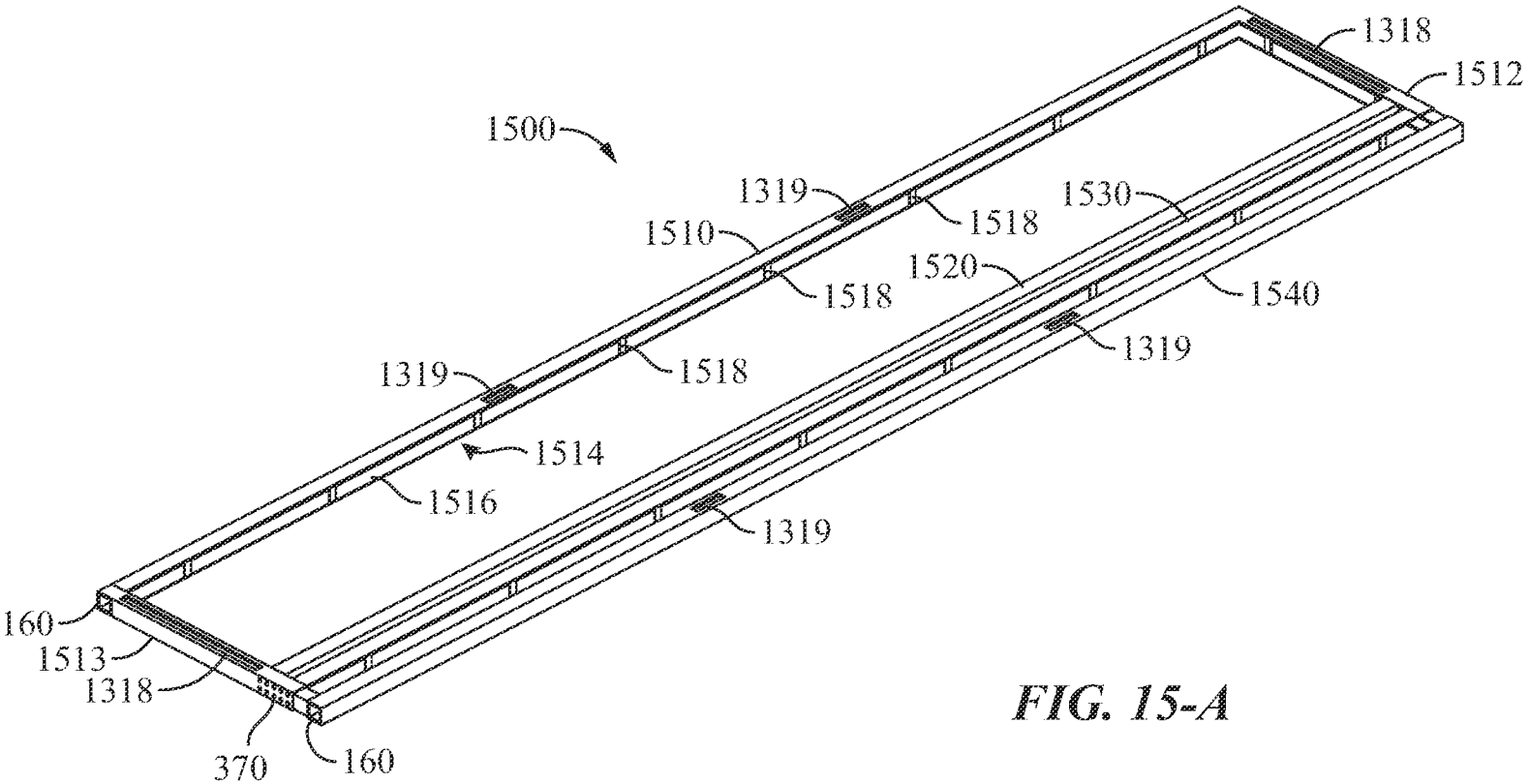
FIG. 15-A

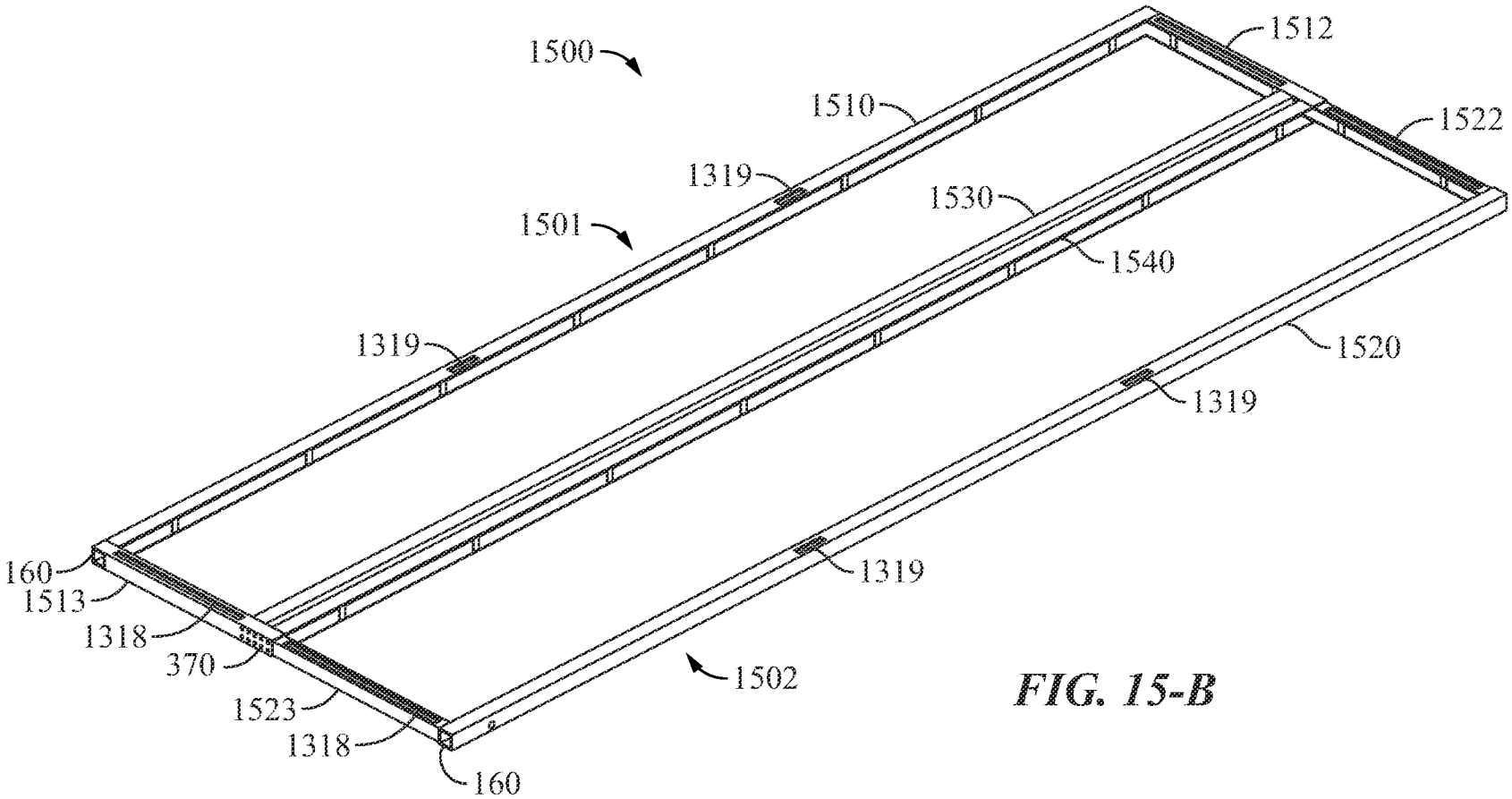
FIG. 15-B

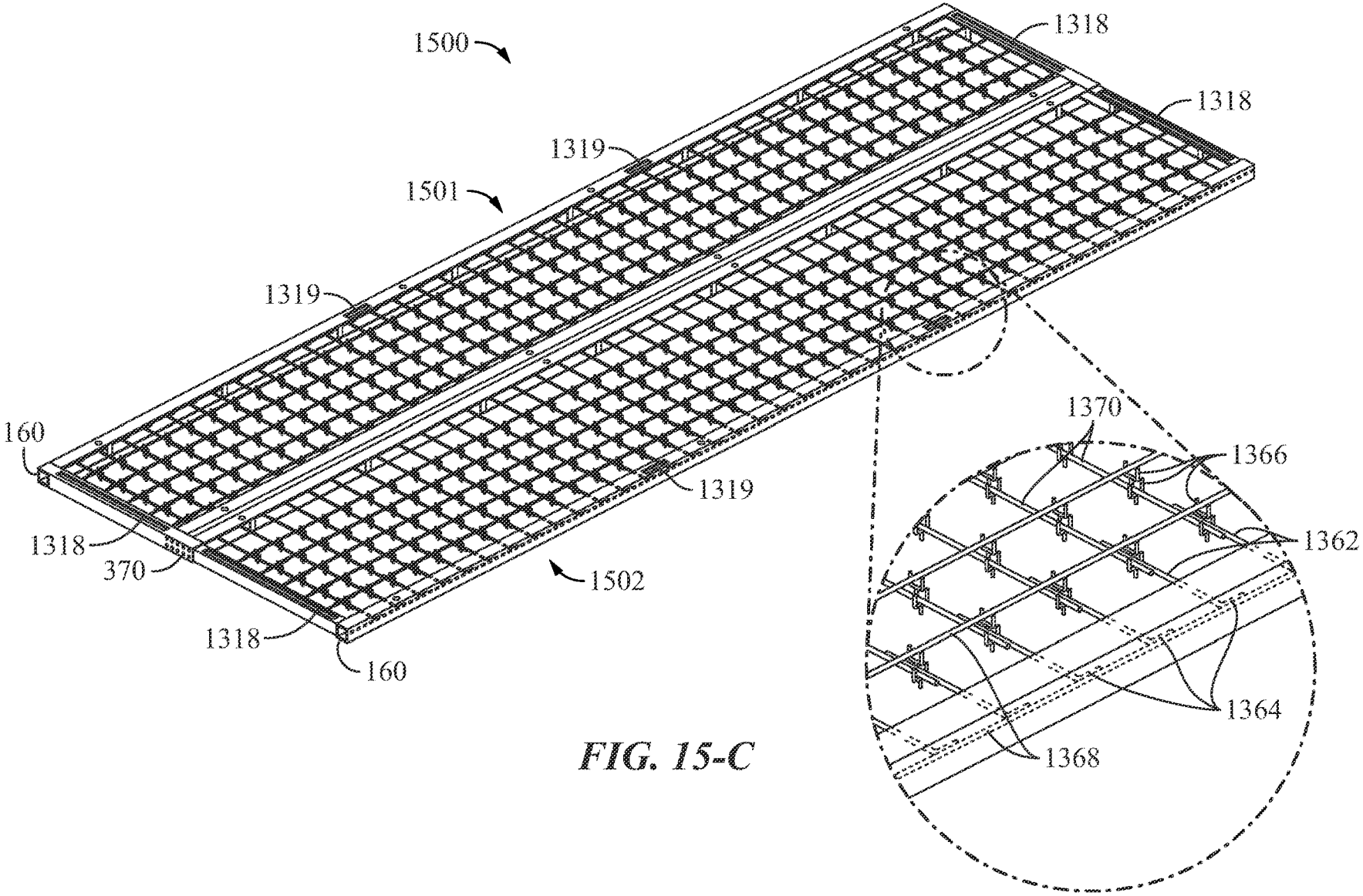
FIG. 15-C

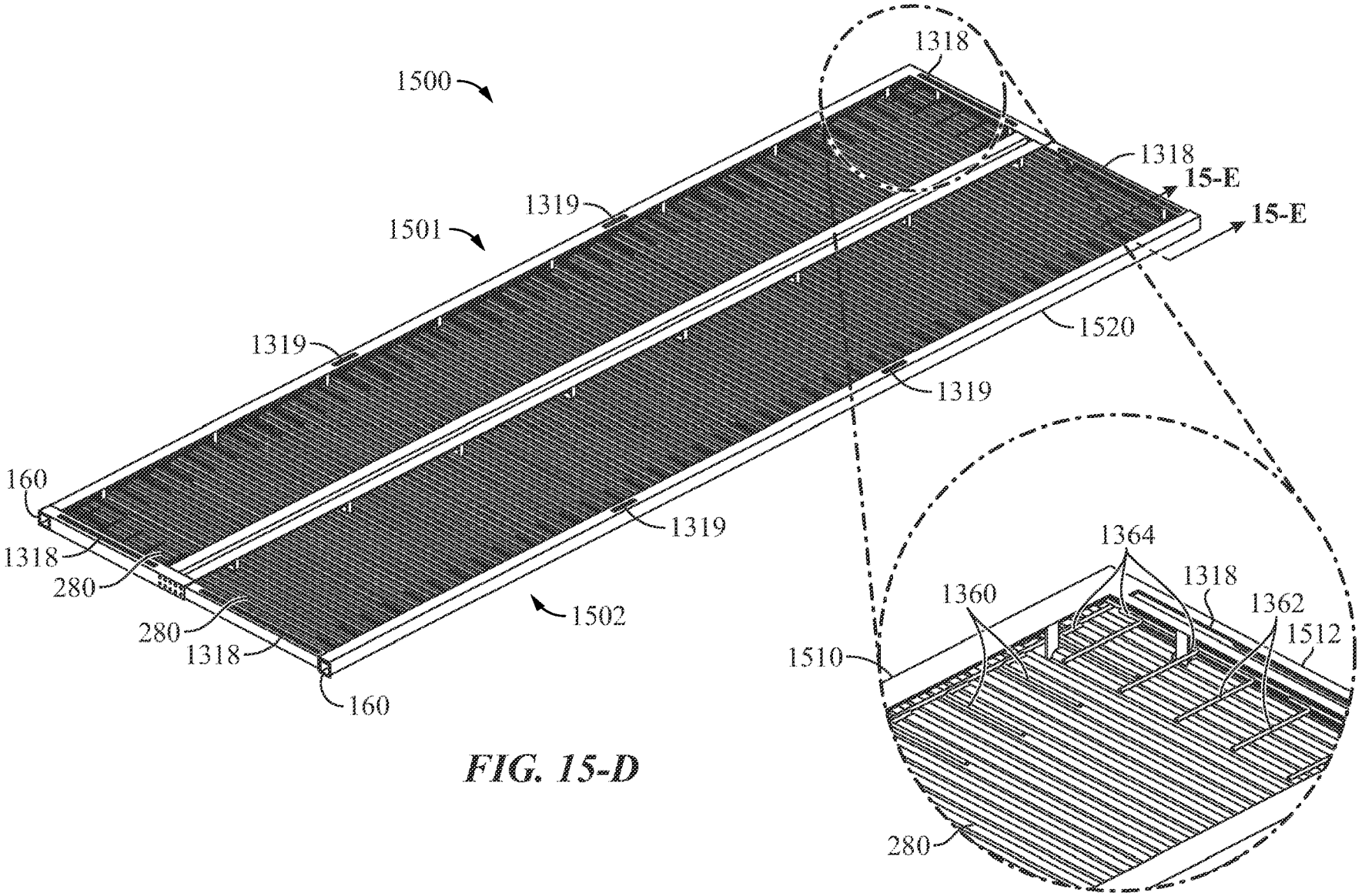
FIG. 15-D

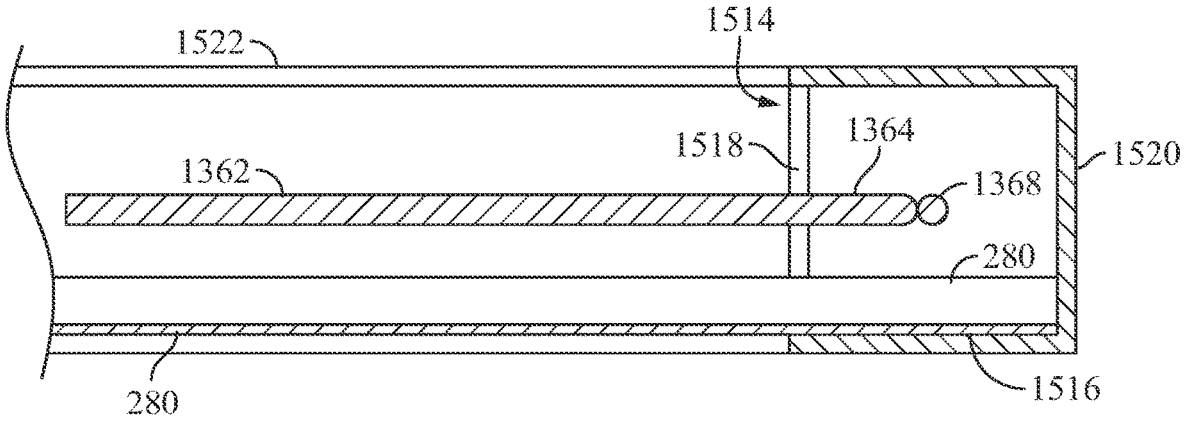
*FIG. 15-E*

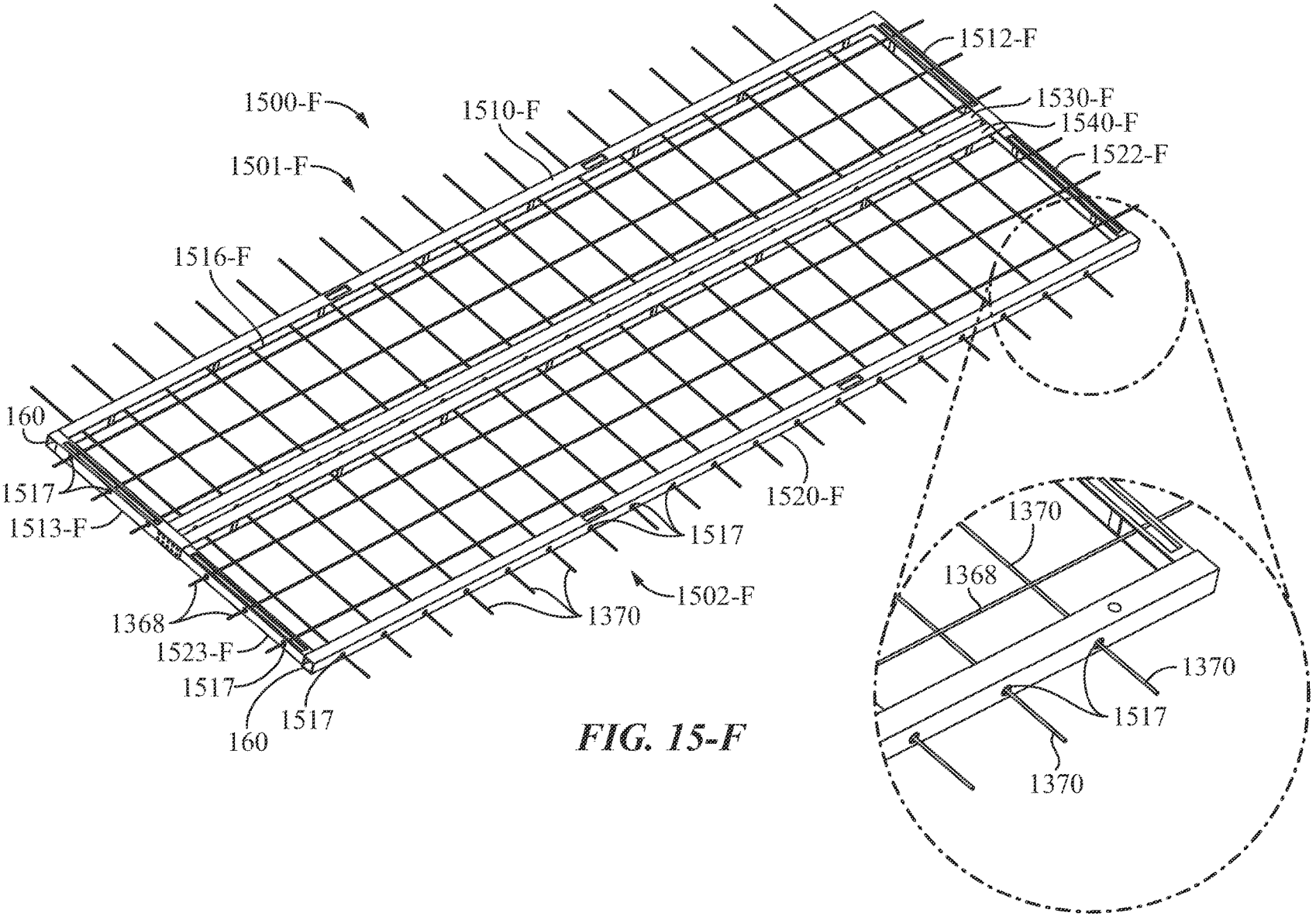
FIG. 15-F

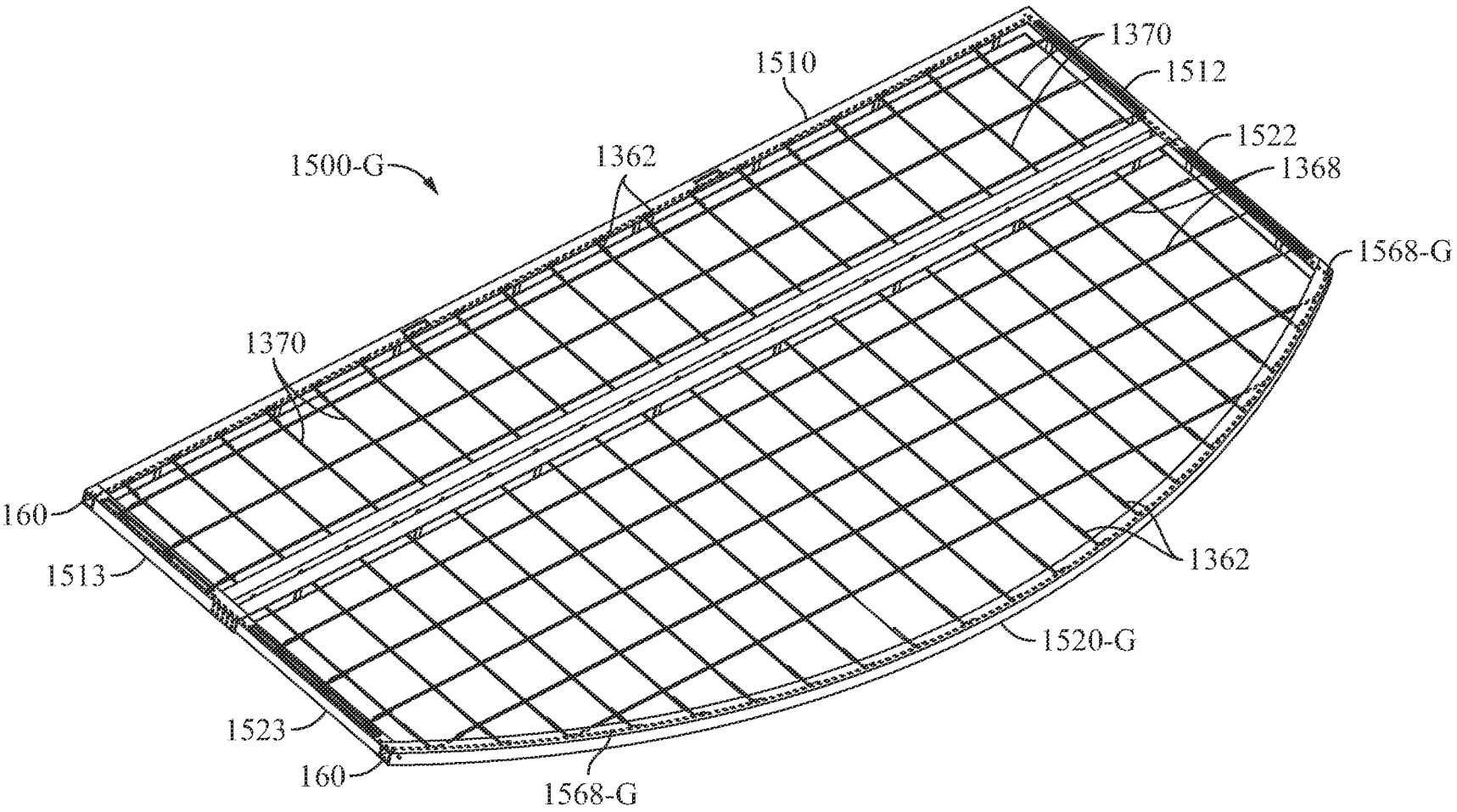
FIG. 15-G

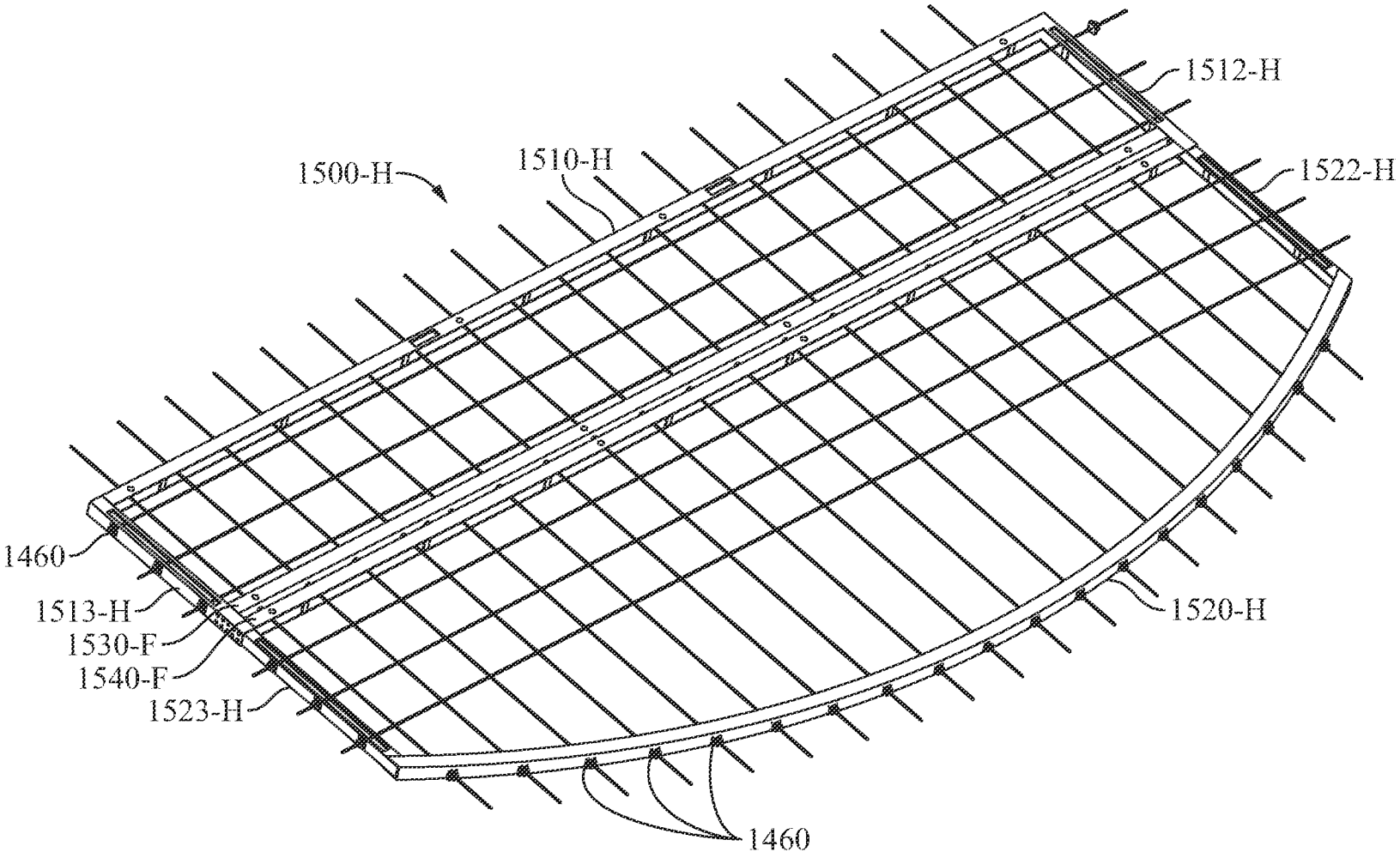
FIG. 15-H

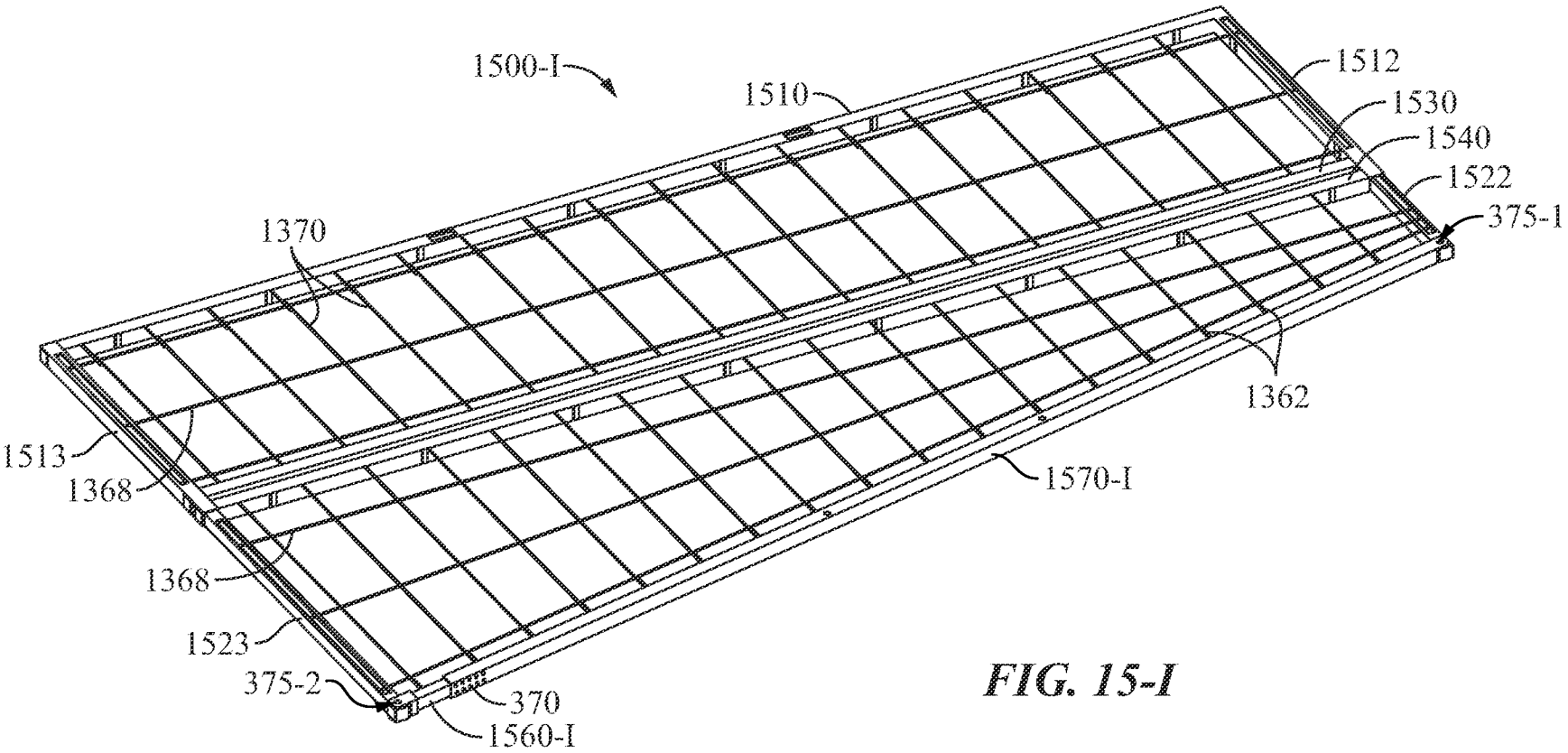
FIG. 15-I

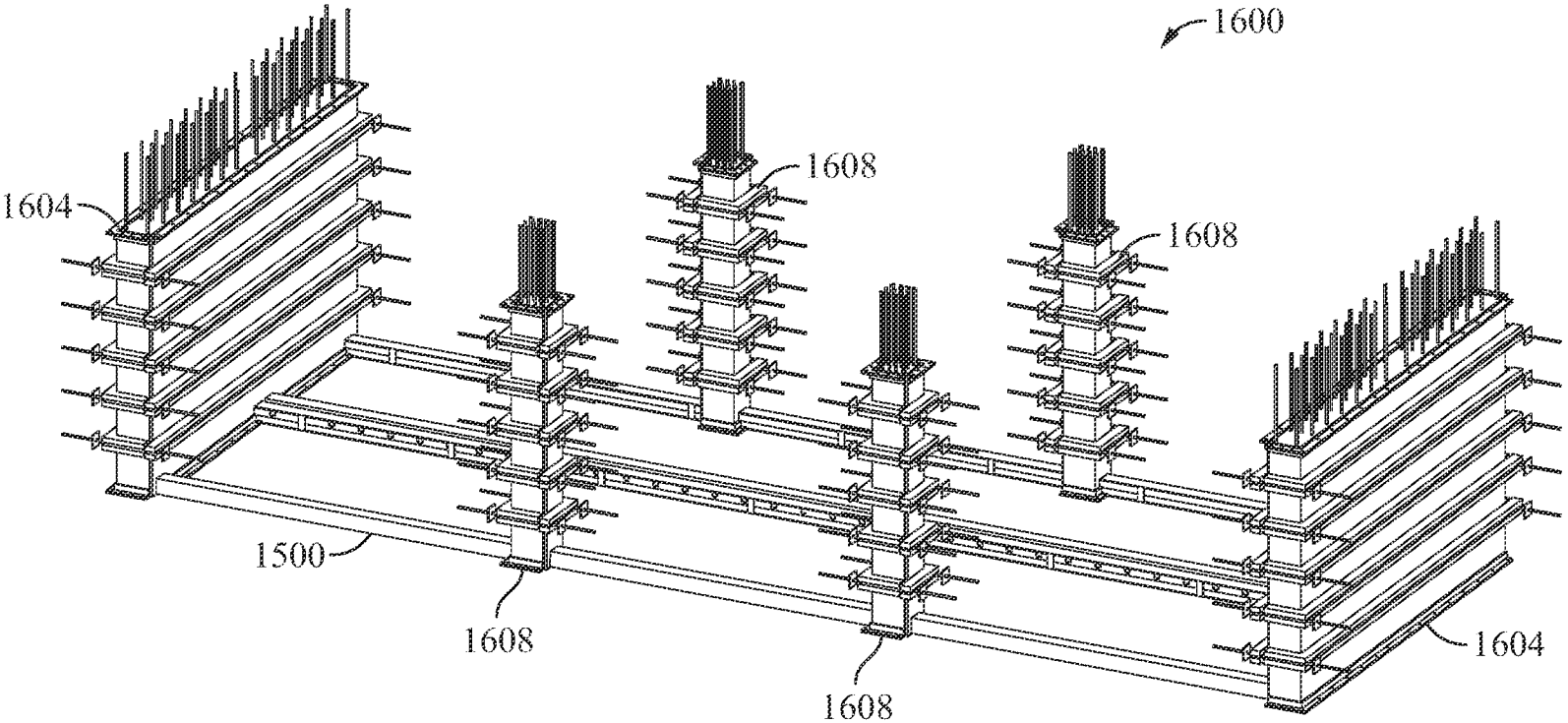
FIG. 16-A

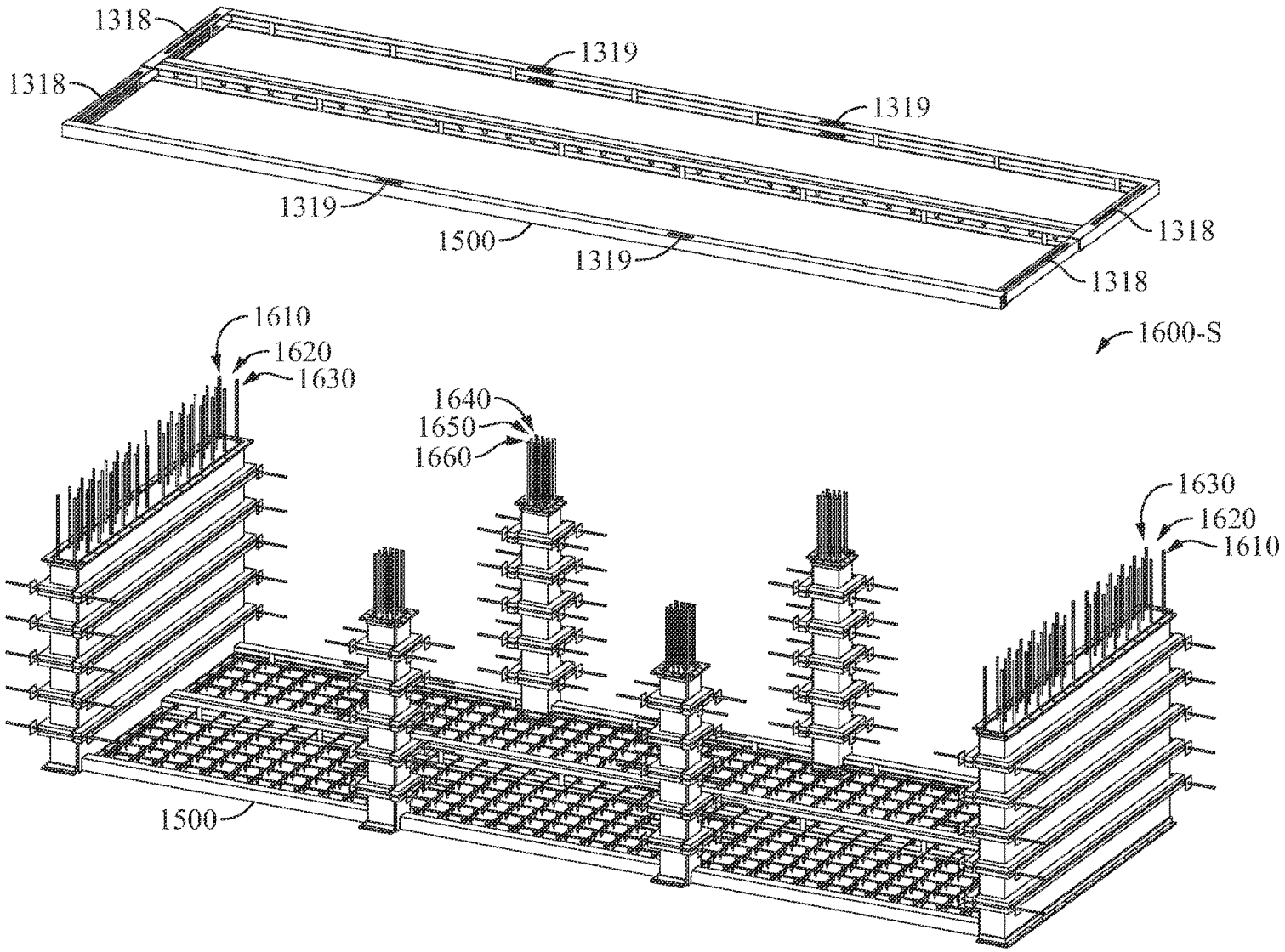
FIG. 16-B

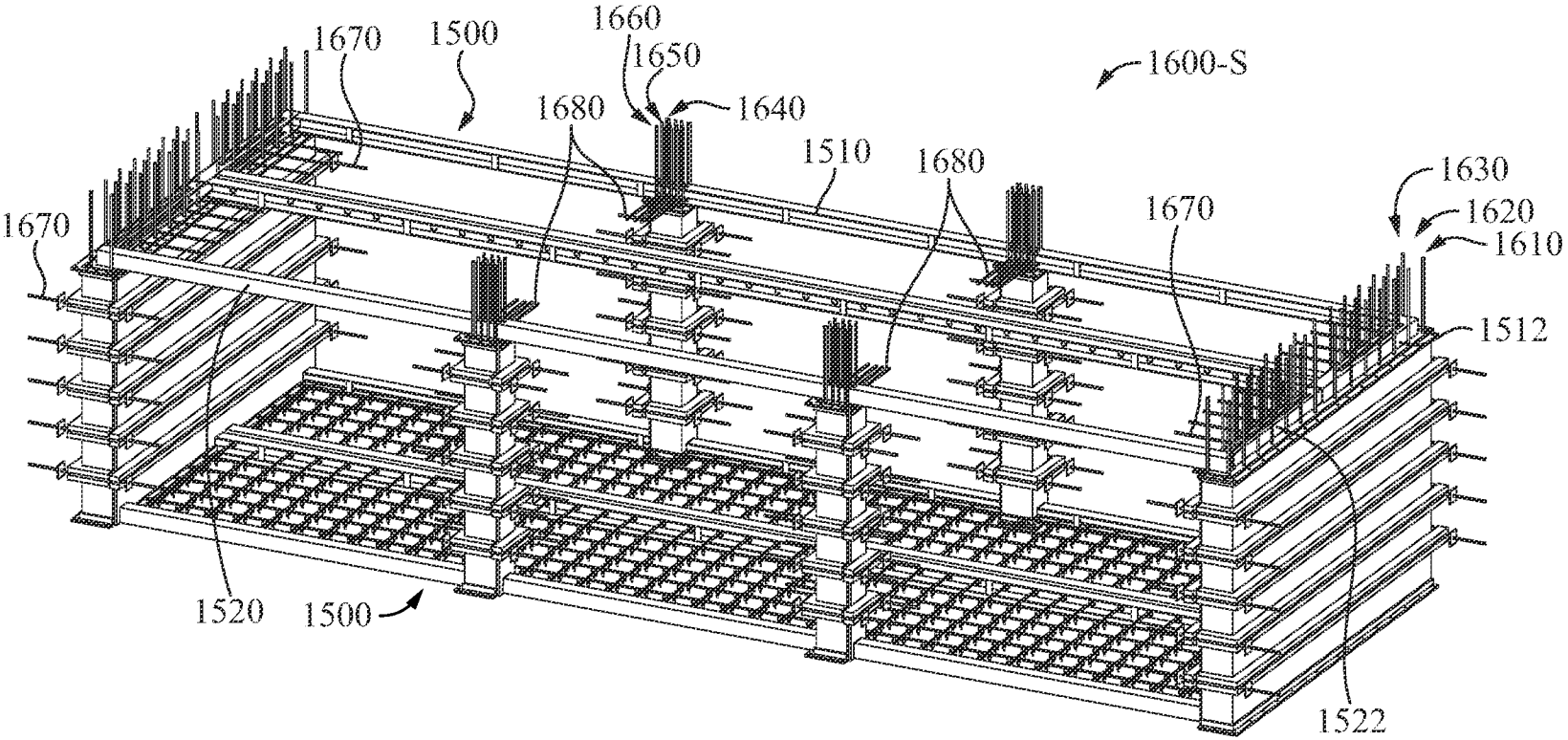
FIG. 16-C

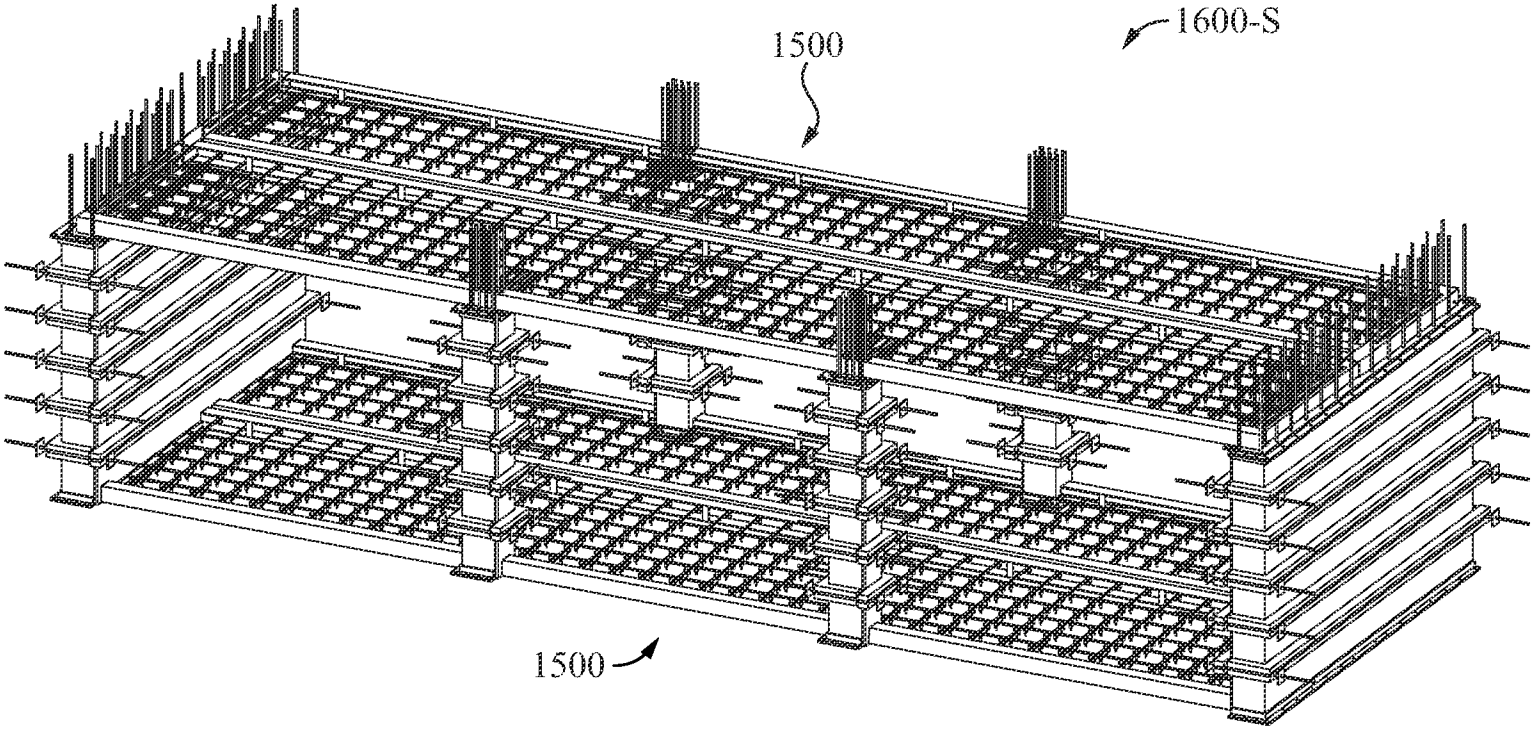
FIG. 16-D

STRUCTURAL MODULE, SYSTEM, AND METHOD

TECHNICAL FIELD

The aspects relate to transportable building structures and, more specifically, relate to structural modules and to a transportable modular building system of pre-engineered, pre-assembled, adjustable structural modules or elements to be used in building construction applications.

BACKGROUND

Concrete is a composite material composed of fine and coarse aggregate bonded together with a fluid cement that hardens over time. Many types of concrete exist, including cementitious and non-cementitious types, each having different means for binding aggregate together. Due to its vast building applications, concrete is one of the most frequently used building materials. In fact, its usage worldwide is, ton for ton, twice that of steel, wood, plastics, and aluminum combined.

Structural steel is a category of steel used for making construction materials in a variety of shapes. Many structural steel shapes take the form of an elongated beam having a profile of a specific cross section. Structural steel shapes, sizes, chemical composition, mechanical properties such as strengths, storage practices, etc., are regulated by standards in most industrialized countries. Most structural steel shapes, such as I-beams, have high second moments of area, which means they are very stiff in respect to their cross-sectional area and thus can support a high load without excessive sagging. While many sections are made by hot or cold rolling, others are made by welding together flat or bent plates.

Current construction methodologies usually use either structural steel or structural concrete. Many buildings utilize a reinforced concrete frame structure (meaning concrete that is shaped into a frame structure on-site) to meet building requirements, especially those of multilevel or high-rise buildings. Often, concrete is chosen as this material can be formed into almost any shape, it is more readily available, and the constructability of this material is easier when compared to structural steel frame construction. When building with concrete, the sequence of construction requires that shear walls and columns be poured first, followed by a supporting deck or table, shored to the floors below, which serves as a surface to hold wet concrete when pouring the floor above. The deck then becomes the working surface to pour the columns for the next level of construction. Often, each floor of a building requires at least four days to complete to ensure proper building techniques are employed. On Day 1, the columns and shear walls are formed and vertical reinforcement is tied into place, and on Day 2 each column and shear wall is poured and allowed to set. On Day 3, the table is jumped from the floor below and shored to support the wet load of concrete. Placement of reinforcement and other internal concrete slab elements commences on the deck. On Day 4, internal slab elements are completed and the deck is poured to complete the floor of the building. This process is then repeated for each floor until the building is complete. The aforementioned process is referred to as a "4-day cycle". The most impactful among the various time limiting factors of the 4-day cycle building procedure is the time it takes for the concrete to cure and harden enough to become structurally viable enough to support the concrete's own dead load in order to become a self-supporting structure. Another time limiting factor is the placing and adjusting of the new shoring before, during, and after jumping the table.

The aforementioned process forms a composite construction material (or composite building material) comprising the concrete and reinforcement elements. The reinforcement elements correct the low tensile and ductile properties of concrete by including a reinforcement with a higher tensile strength and ductility.

When building with structural steel as a frame structure, the sequence of construction requires that pre-fabricated fixed length columns be set in place first, followed by supporting pre-fabricated fixed length horizontal beams. Longer sections are either welded or bolted together. The next level of columns and beams are subsequently installed. A corrugated metal deck is then installed at each level of the structure in line with the horizontal beams, which serves as a surface to hold wet concrete when pouring the floor. In this building procedure, the individual steel members are typically fabricated off site and then transported to the jobsite. On the jobsite, individual members are hoisted into position and either bolted or welded together using standard connection details familiar to those in the trade. The time limiting factor in this building procedure is the based on the fabrication process of the individual steel members, including the engineering, shop drawing and approval process and the logistics of shipping differently sized members to the jobsite. Once all the components are on site, the vertical erection of the structural steel frame can be done much faster when compared to the vertical erection of a similar concrete framed structure. The erection time is only limited by the hoisting time required to lift the individual members into place on the structure and the assembly labor required to assemble all of the columns, beams and other components. Construction with steel is more logistically challenging when compared to concrete due to the rigid nature of the material and all of assembly required for the individual components.

In view of the currently available options for the construction of multilevel buildings, rising material costs, and the risks involved in building construction operations, it would be significantly advantageous to have a solution that eliminates or bypasses the bottlenecks that slow down building construction operations, reduces the costs of hiring workers and materials used, and reduces the risks of accidents in building construction operations and the time workers spend in high-risk construction operations.

SUMMARY

This summary is provided to introduce a variety of concepts in a simplified form that are further disclosed in the detailed description. This summary is not intended to identify key or essential inventive concepts of the claimed subject matter, nor is it intended for determining the scope of the claimed subject matter.

The present features or aspects disclosed herein provide structural modules and a structural modular building system. A structural module comprises one or more beams and a first beam of the one or more beams that has deflection reduction properties (reinforcement to add tensile strength to a concrete composite that includes the structural modules as fixtures of the concrete composite). The structural module is not supported by shoring, but rather by steel column or shear wall forms. The structural module is pre-engineered, pre-fabricated, pre-assembled, and/or adjustable. The one or more beams provide, or are adjustable to provide, desired construction dimensions (the desired length, width, height, surface area, shapes and/or physical properties of the structural module and/or the structural building modular system, as further detailed below) when or after concrete and/or another building material is poured onto the structural module.

The embodiments provide a system wherein the structural modules may be stacked upon one another to allow for multiple floors of a building to be constructed in a single day, rather than the four-day process common employed in the industry. The embodiments also allow for the elimination of the shoring and associated labor thereof commonly used in the arts. The system allows for the structural modules to be easily transported to the building site, anywhere in the world, using standard ISO shipping methodologies. Once at the construction site, the structural modules are readily constructed and stacked based on the building requirements. In such, the embodiments provide a means for modulating the dimensions of the structural module to accommodate varying building dimensions, including the ability to form patios, balconies, angles, curves, etc.

In one general aspect, a structural module comprises one or more beams to provide desired construction dimensions; and a first beam of the one or more beams, the first beam having deflection reduction properties, wherein the structural module is not supported by shoring when the structural module is placed for construction.

Implementations may include features where the structural module is a vertical structural frame or a structural deck. The structural module may also include a second beam of the one or more beams, the second beam having deflection reduction properties and having the same orientation as the first beam when the structural module is placed for construction, wherein the position of the second beam with respect to the first beam is adjustable. The structural module may also include two adjustable beams connected to the second beam of the one or more beams. The structural module may also include where the second beam is curved or has a different orientation than the first beam. The structural module may also include a building material inside the first beam of the one or more beams, wherein the building material is under compression when the building material is inside the first beam of the one or more beams. The structural module may also include a pair of compression plates located at the distal ends of the first beam, with a tensioned cable connected to both compression plates and pulling both compression plates to cause a compression onto the building material. In some embodiments, the structural module is a structural deck.

In one general aspect, the structural module comprises one or more beams to provide desired construction dimensions, a building material inside a first beam of the one or more beams, the first beam having deflection reduction properties, and at least one shear wall formwork or at least one column formwork fitting on top of the one or more beams, wherein the building material is compressible or under compression when the building material is inside the first beam of the one or more beams.

Implementations may include where the at least one shear wall formwork or the at least one column formwork is configured to receive and support the one or more beams on the at least one shear wall formwork or the at least one column formwork. The structural module may also include a pair of compression plates, wherein each plate of the pair of plates is at a distal end of the first beam or inside the first beam, with the building material between the pair of plates, wherein the pair of plates has dimensions fitting an internal cross-sectional area of the first beam, and wherein the pair of plates compress the building material. The structural module may also include a post-tensioned cable at least partly inside the first beam and in contact with the building material, wherein the post-tensioned cable causes compression onto the building material.

In one general aspect, a structural module system comprises a plurality of structural modules, each structural module of the plurality of structural modules comprising one or more beams to provide desired construction dimensions and a first beam of the one or more beams, the first beam having deflection reduction properties, wherein at least one of the structural modules further comprises at least one shear wall formwork or column formwork fitting on top of the one or more beams of the at least one of the structural modules, and wherein no structural module of the plurality of structural modules is supported by shoring when any structural module of the plurality of structural modules is placed for construction.

Implementations may include where the plurality of structural modules are stacked to permit the construction of a multilevel building. The structural module may also include one or more sheets supported by at least one of the one or more beams or a perimeter angle affixed to the at least one of the one or more beams, wherein the one or more sheets provide a surface for building material to be poured on. The structural module may also include where the one or more sheets are corrugated sheets affixed to the at least one of the one or more beams or the perimeter angle via at least one of a plurality of nelson studs, welding, bolting, and pinning.

In one general aspect, a structural module comprises an adjustable frame, a double hinge gusset plate at an internal side of the adjustable frame, a first single hinge gusset plate at a first corner inside the adjustable frame, a second single hinge gusset plate at a second corner inside the adjustable frame, a first cross-brace connected to the double hinge gusset plate and to the first single hinge gusset plate, and a second cross-brace connected to the double hinge gusset plate and to the first single hinge gusset plate.

Implementations may include where the first cross-brace comprises a first internal cross-brace beam that slides into and out of a first external cross-brace beam, and where the second cross-brace comprises a second internal cross-brace beam that slides into and out of a second external cross-brace beam. The structural module may also include where each of the first cross-brace and the second cross-brace contains building material. The structural module may also include where the adjustable frame comprises a first external beam and a second external beam with a distal end of the first external beam connected to a distal end of the second external beam, a first internal beam and a third external beam with a distal end of the first internal beam connected to a distal end of the third external beam, a second internal beam and a third internal beam with a distal end of the second internal beam connected to a distal end of the third internal beam, and a fourth external beam and a fourth internal beam with a distal end of the fourth external beam connected to a distal end of the fourth internal beam, wherein the first internal beam slides into and out of the first external beam, the second internal beam slides into and out of the third external beam, the third internal beam slides into and out of the fourth external beam, and the fourth internal beam slides into and out of the second external beam. The structural module may also include where each of the first cross-brace, the second cross-brace, the first external beam, second external beam, the third external beam, the fourth external beam, the first internal beam, second internal beam, the third internal beam, and the fourth internal beam contains building material.

In one general aspect, a method of construction with a structural module system, the method comprises selecting a plurality of structural modules conforming to desired building dimensions, placing a first set of one or more structural modules from the plurality of structural modules, stacking one or more upper sets of the one or more structural modules from the plurality of structural modules above the first set, affixing sheets to the plurality of structural modules wherein the sheets provide a surface for building material to be poured on, and pouring building material over the one or more upper sets wherein the one or more upper sets are not supported by shoring.

In one general aspects a structural module comprises a first beam, a first center beam, a first sheet supported by the first beam and the first center beam, a second beam, a second center beam, a second sheet supported by the second beam and the second center beam, and a first set of rebar over the first sheet and the second sheet, wherein the first center beam and the second center beam are between the first beam and the second beam, and wherein the structural module is not supported by shoring when the structural module is placed for construction.

Implementations may include where the first set of rebar passes through the first center beam and the second center beam. The structural module may also include a second set of rebar over at least one of the one or more sheets, wherein the second set of rebar has an orientation that is different from the orientation of the first set of rebar. The structural module may also include where the second beam is curved. The structural module may also include where the first beam is a C-shaped channel beam. The structural module may also include where each rebar of first set of rebar is tied to a corresponding hook rebar from a plurality of hook rebars, and where each hook portion of each hook rebar is within the first beam of the one or more beams. The structural module may also include where the first beam comprises a plurality of openings, and where each hook rebar from the plurality of hook rebars passes through a corresponding opening of the plurality of openings. The structural module may also include a first set of tensioned cables over the one or more sheets, wherein the one or more sheets provide a surface for building material to be poured on. The structural module may also include a second set of tensioned cables over the one or more sheets, wherein the second set of tensioned cables has an orientation that is different from the orientation of the first set of tensioned cables.

BRIEF DESCRIPTION OF THE DRAWINGS

A more complete understanding of the present invention and the advantages and features thereof will be more readily understood by reference to the following detailed description when considered in conjunction with the accompanying drawings wherein:

FIG. 1-A illustrates a perspective view of a structural module, according to some embodiments;

FIG. 1-B illustrates a cross-sectional view along part of the length of the structural module, according to some embodiments;

FIG. 2-A illustrates a perspective view of a structural module, according to some embodiments;

FIG. 2-B illustrates a perspective view of the structural module in extended form, according to some embodiments;

FIG. 2-C illustrates a perspective view of the structural module in extended form, according to some embodiments;

FIG. 2-D illustrates a perspective view of the structural module in extended form, according to some embodiments;

FIG. 2-E illustrates a cross-sectional view of part of the structural module, according to some embodiments;

FIG. 3-A illustrates a perspective view of a structural module in expanded form, according to some embodiments;

FIG. 3-B illustrates a perspective view of a structural module, according to some embodiments;

FIG. 4-A illustrates an exploded view and a perspective view a structural module, according to some embodiments;

FIG. 4-B illustrates a perspective view of part of a shear wall formwork and part of a column formwork of a structural module, according to some embodiments;

FIG. 4-C illustrates a perspective view of the structural module, according to some embodiments;

FIG. 5-A illustrates a perspective view of a structural system, according to some embodiments;

FIG. 5-B illustrates a perspective view of the structural system, according to some embodiments;

FIG. 5-C illustrates a top view of a structural system, according to some embodiments;

FIG. 5-D illustrates a side view of a structural system, according to some embodiments;

FIG. 5-E illustrates a perspective view of a column formwork of the structural system, according to some embodiments;

FIG. 5-F illustrates a top view of a column formwork of the structural system, according to some embodiments;

FIG. 6-A illustrates a perspective view of a structural system, according to some embodiments;

FIG. 6-B illustrates a perspective view of the structural system, according to some embodiments;

FIG. 8-A illustrates a perspective view of a structural system, according to some embodiments;

FIG. 8-B illustrates a perspective view of the structural system, according to some embodiments;

FIG. 9-A illustrates a front view of a structural module in fully retracted form, according to some embodiments;

FIG. 9-B illustrates a front view of the structural module in partially expanded form, according to some embodiments;

FIG. 9-C illustrates a front view of the structural module in fully expanded form, according to some embodiments;

FIG. 9-D illustrates a perspective view of the structural module in fully expanded form, according to some embodiments;

FIG. 13-A illustrates a perspective view of a structural module in non-extended form, according to some embodiments;

FIG. 13-B illustrates a perspective view of the structural module in extended form, according to some embodiments;

FIG. 13-C illustrates a perspective view of the structural module in extended form, according to some embodiments;

FIG. 13-D illustrates a perspective view of the structural module in extended form and a close-up view of part of the structural module, according to some embodiments;

FIG. 13-E illustrates a cross-section view of part of the structural module, according to some embodiments;

FIG. 15-A illustrates a perspective view of a structural module in non-extended form, according to some embodiments;

FIG. 15-B illustrates a perspective view of the structural module in extended form, according to some embodiments;

FIG. 15-C illustrates a perspective view of the structural module in extended form, according to some embodiments;

FIG. 15-D illustrates a perspective view of the structural module in extended form and a close-up view of part of the structural module, according to some embodiments;

FIG. 15-E illustrates a cross-section view of part of the structural module, according to some embodiments;

FIG. 15-F illustrates a perspective view of a structural module in extended form, according to some embodiments;

FIG. 15-G illustrates a perspective view of a structural module in extended form, according to some embodiments;

FIG. 15-H illustrates a perspective view of a structural module in extended form, according to some embodiments;

FIG. 15-I illustrates a perspective view of a structural module in extended form, according to some embodiments;

FIG. 16-A illustrates a perspective view of a structural module, according to some embodiments;

FIG. 16-B illustrates a perspective view of a structural system, according to some embodiments;

FIG. 16-C illustrates a perspective view of the structural system, according to some embodiments; and FIG. 16-D illustrates a perspective view of the structural system, according to some embodiments.

DETAILED DESCRIPTION

Figure 7:
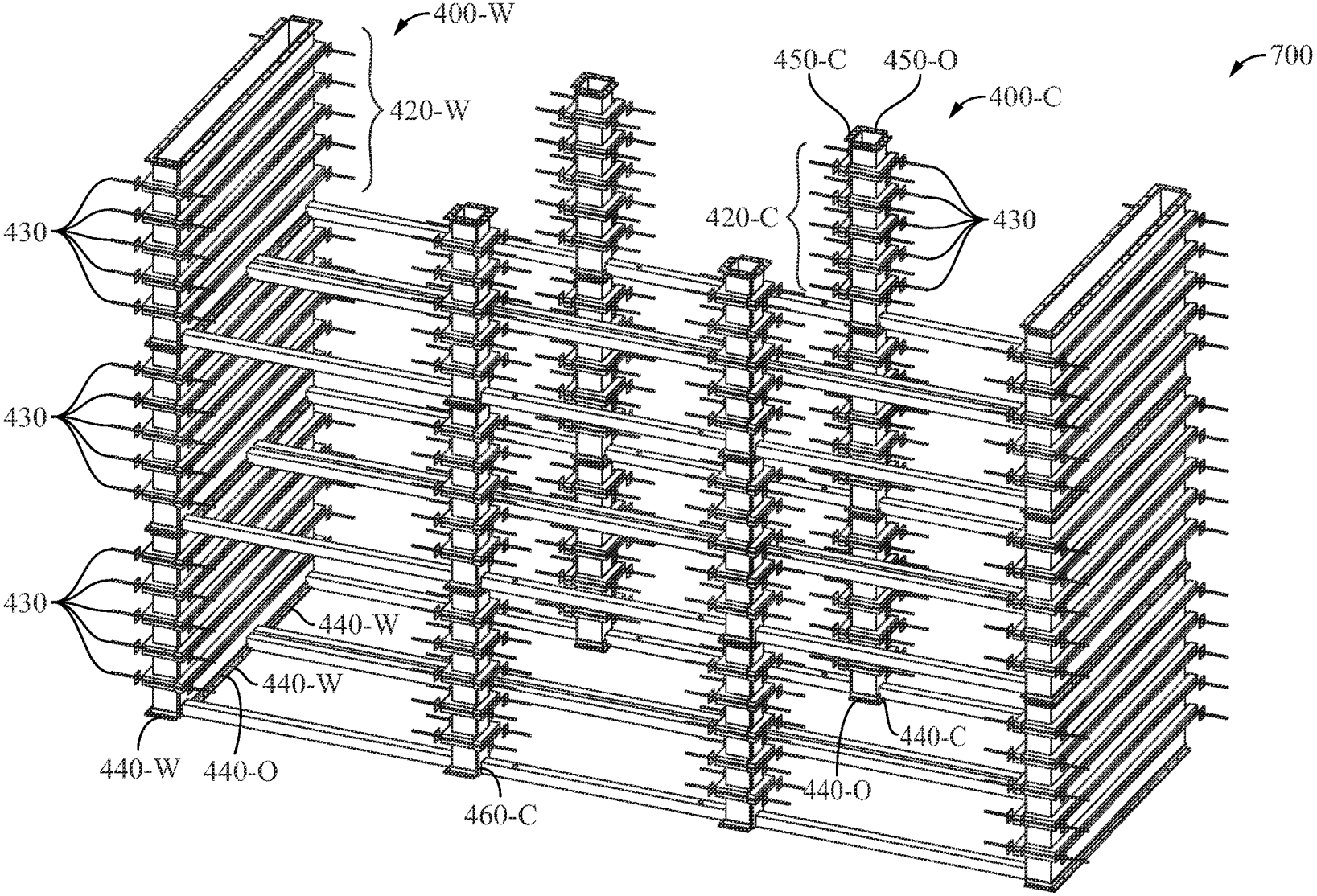
FIG. 7 illustrates a perspective view of a structural system, according to some embodiments.

The specific details of the single embodiment or variety of embodiments described herein are to a system and method of use. Any specific details of the embodiments are used for demonstrative purposes only and no unnecessary limitations or inferences are to be understood therefrom.

Before describing in detail exemplary embodiments, it is noted that the embodiments reside primarily in combinations of components related to the structural modules, the system and method. Accordingly, the system and the module components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

As used herein, relational terms, such as "first" and "second", "top" and bottom", and the like, may be used solely to distinguish one entity or element from another entity or element without necessarily requiring or implying any physical or logical relationship or order between such entities or elements.

As used herein, when drawing in a 3-dimensional perspective view, the x and y axis are used to define a horizontal plane with 2 axes positioned at right angles or at 90 degrees to each other. The z-axis is used to define a $3^{rd}$ vertical plane sitting at 90 degrees to both the x and y axis. This nomenclature for describing a 3-dimensional perspective view will be understood to those familiar in the art.

As used herein, the term "concrete" may mean and/or include any concrete material including fine and coarse aggregates, fluid cements (of any type including lime-based cement binder, lime putty, hydraulic cements such as aluminate cement, or Portland cement). Concrete elements may also include non-cementitious types of concrete with various forms of binding aggregates. One skilled in the arts will readily understand that similar building materials with equivalent engineering or mechanical properties may be used along with the structural modular building system described herein.

As used herein, the term "building material" may mean and/or include any past, present, or future material or element used in construction, such as concrete, cement, wood, ceramic, glass, fiberglass, plastic, polymer, steel, iron and/or other metals, and/or the like, including any combinations, compositions and/or mixtures of such materials. One skilled in the arts will readily understand that similar building materials with equivalent or improved engineering or mechanical properties may be used along with the structural modular building system described herein.

As used herein, the term "desired construction dimensions" or "desired building dimensions" means the desired length, width, height, surface area, shapes (including horizontals, perpendiculars, angles, curves, and/or the like) and/or physical properties of a structural module and/or a structural building modular system when or after concrete and/or another building material is poured onto the structural module. For example, plans for a building may include various floors, rooms of various sizes in particular positions, walls of a certain height, some balconies and ledges, columns at the entrance, and so on. The desired construction dimensions for such building include the length, width, height, and shape of every floor, room, wall, balcony, ledge, column, window, and/or the like; the positions of the walls, the rooms, the balconies, the ledges, and/or the like; and so on, such that when the plans include the desired construction dimensions and the plan is executed in the construction, the result is actual building dimensions that match the desired construction dimensions.

In general, the aspects described herein relate to a transportable modular building system of pre-engineered, prefabricated, pre-assembled, adjustable, structural modules or elements for construction of a building. A structural module comprises one or more structural components, with at least one structural component having deflection reduction properties (properties to reduce or eliminate bending of the structural module). A structural component can be one or more beams, with the beams having any shape, size, dimensions and/or orientations. Beams that provide deflection reduction properties will generally be straight, having little to no curvature, and will generally have a post-tensioning cable to create the deflection reduction properties by being configured to cause compression to material inside the beam. Other structural components may include beams with or without deflection reduction properties, adjustable length beams, adjustable orientation beams, sheets, frames, hinges, cables, compression plates, sheets, corrugation, studs and/or screws and/or attachment/affixing means (studs, screws, pieces fitting each other, welding, bolting, pinning, and/or the like), rebar, building material, and/or the like, including any other structural components of structural modules described herein, any other parts or subparts of structural modules described herein, any other parts or subparts of structural components described herein, and/or the like.

A structural module may comprise just one beam with deflection reduction properties or may comprise one or more beams and a first beam of the one or more beams that has deflection reduction properties. The structural modules are pre-engineered, pre-fabricated, pre-assembled, and/or adjustable. The one or more beams provide, or are adjustable to provide, desired construction dimensions when or after concrete and/or another building material is poured onto the structural module. Two or more structural modules may be combined to create a desired building structure with desired building dimensions. To summarize, one or more structural components make a structural module, and structural modules have at least one structural component with deflection reduction properties.

FIGS. 1-A and 1-B illustrate structural module 100, which may be part of a horizontal deck or a horizontal element in a building structure. The structural module 100 comprises a first beam 110 of one or more beams to provide desired construction dimensions, a tensioning cable 130, a sleeve 140, compression plates 150, stress nuts 155, wedges 156, and beam distal openings 160, with the first beam of the one or more beams having deflection reduction properties. The beam 110 comprises one or more grout openings 120 through which wet building material or wet concrete may be poured. The tensioning cable 130 comes out of the beam 110 through each of the beam distal openings 160 of the beam 110, with the beam distal openings 160 located at the distal ends of the beam 110. The tensioning cable 130 may be a pre-tensioning cable or a post-tensioning cable. For simplicity, this disclosure and drawings show the structural module 100 as having a post-tensioning cable 130 that passes through compression plates 150, which are either collocated with the beam distal openings 160 or inside the beam 110. Each of the compressing plates 150 has a stress nut 155 positioned at the outside facing side of the compressing plates 150. In operation, a wedge 156 is inserted between the stressed post-tensioning cable 130 and each stress nut 155, such that when the cable 130 is released, the reactionary compression forces are distributed by the post-tensioned cable 130 into the building material 170.

FIG. 1-A illustrates a perspective view of the structural module 100. FIG. 1-A shows the compression plates 150 apart from the beam distal openings 160 to make apparent the presence of the beam distal openings 160 and to show a sleeve 140 surrounding the post-tensioning cable 130 between the compression plate 150. The sleeve 140 binds to the building material and/or concrete. The tensioning cable 130 moves freely within the sleeve 140 to allows for hydraulic stretching of the tensioning cable 130 and then the tensioning cable 130 is fixed into position using the stress nut 155 and the wedge 156. In operation, building material is under compression when the building material is inside the first beam and has cured when using stressed post-tensioning cables.

FIG. 1-B illustrates a cross-sectional view along part of the length of the structural module 100. FIG. 1-B shows one of the compression plates 150 in a position located inside the beam and closely located to one of the beam distal openings 160 such that when the beam 110 is filled with building material 170, the building material 170 does not pour out through the beam distal openings 160. That is, the pair of compression plates 150 stop wet concrete or building material 170 from spilling out of the beam 110. Thus, the compression plates 150 border flush to the internal surface of the beam 110. In operation, the wedge 156 is inserted between the stressed post-tensioning cable 130 and each stress nut 155, such that when the cable 130 is released, the reactionary compression forces are distributed by the post-tensioned cable 130 into the building material 170. In operation, the pair of compression plates 150 is located at the distal ends of the beam 110 (meaning at or about the distal ends of the beam 110), with a tensioned cable connected to both compression plates 150 and pulling both compression plates 150 to cause a compression onto the building material 170.

The beam 110 may have a square shape as shown in FIG. 1-A, a round shape, triangular shape, polygonal shape, an oval shape, a T-beam shape, an I-beam shape, a C-beam shape, a trapezoidal shape, an irregular shape, and/or the like. The structural module 100 may be made of any structurally sound material according to the application, such as metal (steel, iron, titanium, aluminum, and/or the like), wood, ceramic, plastics, polymers, and/or the like. Note that the beam 110 (and any of the one or more beams) may itself provide deflection reduction properties and/or rigidity, even before the pouring and/or the curing of the building material.

In operation, the structural module 100 is dimensioned and shaped to match desired construction dimensions. For example, if the structural module 100 is to be used to create support for a structural deck, the structural module 100 is placed on the desired construction location, filled with building material (for example, wet concrete) and have tension effected on its tension cable 130 (before or after filling with building material, according to whether the cable is a pre-tensioned cable or a post-tensioned cable). The tensioned cable 130 pulls the compression plates 150 into the beam 110, causing compression unto the building material inside the beam 110 once the building material has cured. Given that the building material is cured and no longer wet, compression unto the building material does not cause the building material to exit through the grout openings 120. The structural module 100 becomes part of the structural deck and structural system (i.e., becomes part of the building) as building material is poured onto the structural module 100.

Note that the structural deck, having one or more structural modules 100, can be thought of as a module (and/or each structural module 100 itself can be thought of as a module within the structural deck). Once in position during building construction, any structural module 100 resting on structural vertical elements, such as shear walls, columns, or formwork, provides a solid structural support such that elements resting on support from the structural module 100 do not need shoring. For example, a corrugated sheet supporting wet building material may be supported by or be part of one or more structural modules 100, with the one or more structural modules 100 being supported by shear walls, columns, and/or formwork. In this example, there is never a need for shoring the corrugated sheet whether with wet building material or cured building material. Thus, each of the one or more structural modules 100 can be thought of as a structural module providing support to one or more corrugated sheets. Likewise, the one or more structural modules 100 along with the corresponding corrugated sheets can be thought of as a structural module providing support to wet building material. In any scenario, the structural module 100 incorporates the aspect of not needing shoring during construction. Corrugated sheets are affixed to the structural module 100 by welding, bolting, or pinning.

The beam 110 may be an extendable beam and/or have nonlinear length in one or more dimensions. For example, the beam 110 may extend following the typical contour or curve created by a post-tensioned cable in operation.

FIGS. 2-A, 2-B, 2-C, and 2-D illustrate a structural module 200, which incorporates the aspects of the structural module 100. The structural module 200 comprises one or more beams to provide desired construction dimensions, and a first beam 210 of the one or more beams having deflection reduction properties. Any number of the one or more beams may incorporate the aspects of the structural module 100. In some embodiments, the structural module 200 further comprises a second beam 220 of the one or more beams and a first and a second enclosing beams 212, 213, each connected to the first beam 210. The second beam 220 has deflection reduction properties and the same orientation as the first beam when the structural module is placed for construction. FIG. 2-A illustrates a perspective view of the structural module 200 in non-extended form. FIGS. 2-A shows the first beam 210 and the second beam 220 each having beam distal openings 160. FIGS. 2-B and 2-C illustrate a perspective view of the structural module 200 in extended form and show the first and second adjustable beams 222, 223, each extended out from inside the first and second enclosing beams 212, 213, respectively, and connected to the second beam 220. The second beam 220 has deflection reduction properties and the same orientation as the first beam when the structural module is placed for construction. The adjustable beams 222 are inside the first and second enclosing beams 212, 213 in FIG. 2-A and are extended out from the first and second enclosing beams 212, 213 in FIGS. 2-B and 2-C. Note that the adjustable beams 222 may be extended to different lengths according to any desired building dimensions, making the position of the second beam 220 with respect to the first beam 210 adjustable. Once extended to the desired position, the first and second adjustable beams 222, 223 are locked in by welding with the first and second enclosing beams 212, 213, whereby the adjustable beams become adjusted beams which are no longer adjustable. A first center beam 230 and a second center beam 240 are connected at their respective distal ends to the first and second enclosing beams 212, 213.

In some embodiments, the first center beam 230 and a second center beam 240 are parallel to the first beam 210. In some embodiments, the first beam 210, the second beam 220, the enclosing beams 212, and the adjustable beams 222 form a rectangular shape. The term "center" in first center beam 230 and second center beam 240 is used for simplicity, as these beams may be centered or may be located with respect to the first beam 210 and/or the second beam 220 without being precisely located in the center between the first beam 210 and the second beam 220 when then structural module 200 is in extended form. In some embodiments, the first center beam 230 and second center beam 240 are located somewhere between the first beam 210 and the second beam 220. Also note that the first and second enclosing beams 212. 213 and the first and second adjustable beams 222, 223 are optional, as some embodiments might not include the first and second enclosing beams 212, 213 and the first and second adjustable beams 222, 223 while still positioning the rest of the one or more beams adequately for construction.

The structural module 200 has all necessary components to be optionally expanded, contracted, and constructed at the build site where it is shipped.

When the structural module 200 is fitted to meet the desired building dimensions, which may include no extension, partial extension, or full extension of the adjustable beams 222, the adjustable beams 222 may be fixed in position by welding, bolting, and/or pinning to the enclosing beams 212, making the adjustable beams 220 no longer adjustable, but adjusted beams. Alternatively, the structural module 200 may be filled through the grout openings 120 with building material. Once filled with building material, the adjustable beams 222 are no longer adjustable, particularly if the building material has cured. In some embodiments, there are no adjustable beams 222 and/or enclosing beams 212.

FIG. 2-C illustrates the structural module 200 with tension cables 130, compression plates 150, and a perimeter angle 260. The perimeter angle 260 is an "L" shaped beam that rests on the top edges of the perimeter of the structural module 200, walling off the whole area inside the perimeter created by the structural module 200. Note that the first beam 210, the second beam 220, the first center beam 230, and/or the second center beam 240 incorporate the aspects of the first beam 110. The perimeter angle 260 can be welded on site prior to the placing of a sheet 280 on the structural module 200.

FIG. 2-D illustrates the structural module 200 having a sheet 280 affixed on top of the perimeter angle 260 by nelson studs, welding, bolting, and/or pinning. In operation, the perimeter angle 260 can affixed by welding, bolting, and/or pinning on site onto the one or more beams. The structural module 200 also has one or more sheets 280 on the one or more beams and/or the perimeter angle 260. In some embodiments, the first and a second sheet of the one or more sheets 280 are corrugated, as shown in FIG. 2-D. The perimeter angle 260 prevents any wet building material from pouring over and away from the one or more sheets 280.

FIG. 2-E illustrates a cross-sectional view of part of the structural module 200. The perimeter angle is welded to the second beam 220 and to the adjustable beam 222. Nelson studs 262 are placed to affix the sheet 280 in place with the perimeter angle 260. The nelson studs 262 are placed with their heads in an elevated position such that wet building material will surround and grab a hold of the structure of the nelson studs 262 as the wet building material cures. In some embodiments, the sheet 280 is welded to the perimeter angle 260.

It will be apparent to those skilled in the art that the distinctions between beams serves the purpose of illustrating and describing the features and aspects, but that such distinctions do not mean that two or more beams could not be considered just one beam. For example, the first beam 210 and the first and second enclosing beams 212, 213 may be characterized instead as one beam that may be characterized as a first frame 201, with or without the first center beam 230. Likewise, the second beam 220 and the first and second adjustable beams 222, 223 may be characterized as a second frame 202, with or without the second center beam 240.

In operation, the structural module 200 is fitted, dimensioned, and shaped to match desired construction dimensions. For example, if the structural module 200 will be used to create support for a deck or sheet 280, the first frame 201 and the second frame 202 are prefabricated, adjusted to the desired construction dimensions by extending the second frame 202, filled on site (or prefilled) with building material (for example, wet concrete) through grout openings 120, and have tension effected on their tension cables 130 (before or after filling with building material, according to whether the cable is a pre-tensioned cable or a post-tensioned cable) before or after the structural module 200 is placed on the desired construction location. The tensioned cables 130 pull the compression plates 150 into the long portion of the first frame 201, the long portion of the second frame 202, the first center beam 230 and the second center beam 240, causing compression into the building material inside each once the building material has cured. Given that the building material is cured and no longer wet, compression into the building material does not cause the building material to exit through the grout openings 120. Prior to pouring building material, a first sheet of the one or more sheets 280 is affixed on the perimeter angle 260 at the first frame 201 and a second sheet of the one or more sheets 280 is affixed on the perimeter angle 260 at the second frame 202 as further discussed in the description of FIGS. 8 and 10-11, below. In the case of multiple structural modules 200 placed together laterally or in another orientation at the same level, the perimeter angle 260 will follow the perimeter of the multiple structural modules 200.

FIG. 3-A illustrates a perspective view of structural module 300, which incorporates the aspects of the structural module 200. FIG. 3-A shows a of structural module 300 in an expanded form, wherein the direction of expansion is perpendicular to the direction of extension shown in FIG. 2-B with respect to the first beam 210. In FIG. 3-A, a first expanding beam 310 expands from inside of the first beam 210, a first expanding center beam 330 expands from inside the first center beam 230, an second expanding center beam 340 expands from inside the second center beam 240, and an second expanding beam 320 expands from inside the second beam 220. The structural module 300 can also have the first and second adjustable beams 222, 223 extend out of the first and second enclosing beams 212, 213.

Note that the first expanding beam 310, the first expanding center beam 330, the second expanding center beam 340, and the second expanding beam 320 may be expanded to different lengths according to any desired building dimensions. However, the expanding beam 310, the expanding first center beam 330, the expanding second center beam 340, and the adjustable expanding beam 320 all have the same length. FIG. 3-A also shows bolt holes 370 at the distal end of the first beam 210 towards the first expanding beam 310 and at the distal end of the second beam 220 towards the second expanding beam 320. The first bolt holes 370 secure the position of the first expanding beam 310 with respect to the first beam 210. The second bolt holes 370 secure the position of the second expanding beam 320 with respect to the second beam 220. In some embodiments, the positions of the first expanding beam 310 and/or the second expanding beam 320 are secured with respect to the first beam 210 and/or the second beam 220 by bolting, welding, and/or pinning. In some embodiments, the positions of the first expanding center beam 330 and/or the second expanding center beam 340 are secured with respect to the first center beam 230 and/or the second center beam 240 by bolting, welding, and/or pinning.

FIG. 3-B illustrates a structural module 350 which incorporates the aspects of the structural module 300. FIG. 3-B shows a configuration in which a first pin connector 375-1 connects the second beam 220 to the first adjustable beam 222 and a second pin connector 375-2 connects the second expanding beam 320 to the second adjustable beam 223. The first and the second pin connectors 375-1, 375-2 allow the second beam 220 together with the second expanding beam 320 to change their angle with respect to the first beam, the first center beam, and/or the second center beam. The combined length of the second beam 220 and the second expanding beam 320 changes to accommodate the changes of the angle between the second beam 220 and the first adjustable beam 222, and between the second expanding beam 320 and the second adjustable beam 223. While maintaining particular angles with the first and the second pin connectors 375-2, the first and second adjustable beams 222, 223 may be adjusted to change the position of the second beam 220 and the second expanding beam 320 with respect to the first and second enclosing beams 212, 213. Thus, the position, the angle, and the combined length of the second beam 220 and the second expanding beam 320 change to fit desired construction dimensions specified by developers, designers, engineers, and architects.

Structural modules 100, 200, 300, and 350, and the structural modules 1300, 1400, 1500, 1500-F, 1500-G, 1500-H, 1500-I, and/or 1600, discussed below, are supported by shear walls, columns, vertical elements, and/or the like. The placement of shear walls, columns, vertical elements, and/or the like will follow desired building dimensions, which may include horizontals, perpendiculars, angles, curves, and/or the like.

FIG. 4-A illustrates an exploded view in tandem with a perspective view of structural module 400 comprising at least one shear wall formwork 400-W, at least one column formwork 400-C, and a structural module 200/300. The at least one shear wall formwork 400-W and the at least one column formwork 400-C fit on top of the structural module 200/300. FIG. 4-B illustrates a perspective view of part of the shear wall formwork 400-W and part of the column formwork 400-C of a structural module 400, as shown in FIGS. 4-A and 4-C. FIG. 4-C illustrates a perspective view of the structural module 400. The shear wall formwork 400-W has shear wall double wailers 420-W to press and hold the shear wall formwork 400-W in place and form. The column formwork 400-C has column double wailers 420-C to press and hold the column formwork 400-C in place and form. The first wailing ties 430 create the pressure necessary to hold the shear wall formwork 400-W by creating pressure between the shear wall double wailers 420-W. Second wailing ties 432 create the pressure necessary to hold the column formwork 400-C by creating pressure between the column double wailers 420-C. The shear wall formwork 400-W has shear wall frame openings 460-W that fit the structural module 200/300 according to desired construction dimensions, including consideration of the position of the shear wall formwork 400-W and the structural module 200/300 with respect to each other and with respect to the desired construction dimensions. The column formwork 400-C has column frame openings 460-C that fit the structural module 200/300 according to desired construction dimensions, including consideration of the position of the column formwork 400-C and the structural module 200/300 with respect to each other and with respect to the desired construction dimensions. Thus, part of the structural module 200/300 without a tension cable is inside the shear wall formwork 400-W, and part of the structural module 200/300 with a tension cable is inside the column formwork 400-C. The parts of the structural module 200/300 inside the shear wall formwork 400-W and the parts of the structural module 200/300 inside the column formwork 400-C will be in direct contact with the building material poured into the shear wall formwork 400-W and the column formwork 400-C.

Although only one structural module 200/300 is shown, multiple structural modules 200/300 may be set side-by-side and/or one after the other (making a plane of structural modules 200/300). Thus, any shear wall formwork 400-W and/or any column formwork 400-C may be added and/or modified to fit the multiple structural modules 300, including modifying the shear wall frame openings 460-W, the column frame openings 460-C. Shear wall and column forms are placed to match the desired building dimensions, which may include horizontals, perpendiculars, angles, curves, and/or the like.

The shear wall formwork 400-W has wall bottom flanges 440-W and wall top flanges 450-W. The column formwork 400-C has column bottom flanges 440-C and column top flanges 450-C. The wall bottom flanges 440-W, the column bottom flanges 440-C, the wall top flanges 450-W, and the column top flanges 450-C allow for the stacking of formwork, as the shear wall formwork 400-W and the column formwork 400-C can be placed on top of a previously placed shear wall formwork and column formwork. The wall bottom flanges 440-W are bolted through bottom flange bolt holes 440-O to the wall top flanges of a lower formwork through top flange bolt holes 450-O which match in position with the corresponding bottom flange bolt holes 440-O, as is further explained below in the discussion of FIG. 6. Because the at least one shear wall formwork 400-W and at least one column formwork 400-C fit on top of the structural module 200/300, the structural module 400 can be stacked as shown with the structural system 500, as discussed in FIGS. 5, 6, 7, and 8.

FIG. 5-A, which illustrates a structural system 500, is the same as FIG. 4-C but with the shear wall formwork 400-W and the column formwork 400-C filled with building material, shear wall rebars 510 extending out from the shear wall formwork 400-W and column rebars 520 extending out from the column formwork 400-C, and a second structural module 200/300 above the shear wall formwork 400-W and the column formwork 400-C. The first structural module 200/300 remains below the shear wall formwork 400-W and the column formwork 400-C. FIG. 5-B shows the second structural module 300 resting on the shear wall formwork 400-W and the column formwork 400-C while the shear wall rebars 510 and the column rebars 520 are positioned to not interfere or impede the positioning of the second structural module 200/300. The shear wall formwork 400-W and the column formwork 400-C are configured to receive and support any structural module 100/200/300/350. Thus, the shear wall formwork 400-W and/or the column formwork 400-C may be configured to receive and support one or more beams, according to the configuration and dimensions of the corresponding structural module 100/200/300/350. For example, FIGS. 5-A and 5-B shows that the shear wall formwork 400-W and the column formwork 400-C receive and support the structural module 200/300, with parts of the various beams of the structural module 200/300 fitting onto the shear wall formwork 400-W.

FIGS. 5-C and 5-D illustrate a top view and a side view, respectively, of the structural system 500.

FIGS. 5-E and 5-F illustrate a perspective view and a top view, respectively, of a column formwork 400-C of the structural system 500.

Note also that structural system 500 shows that structural module 400 is stackable. The stackable aspects further discussed below show that the various structural modules are stackable to permit the construction of multilevel buildings. Also note that, at this point, the structural system 500 provides support for the second structural module 200/300 without the need for any shoring. In other words, the shear wall formwork(s) 400-W and/or the column formwork(s) 400-C provide the necessary structural support for the second structural module 200/300 and for any subsequently stacked structural modules. Thus, the use of one or more structural modules 100/200/300/350/400 may deliver the benefit of avoiding the time, expense, and human error involved in installing shoring for a deck during construction.

FIG. 6-A illustrates a perspective view of structural system 600, which is an expansion of and incorporates the aspects of the structural system 500. FIG. 6-A shows a second shear wall formwork 400-W and a second column formwork 400-C on top of the first shear wall formwork 400-W and the second column formwork 400-C from FIG. 5-B.

FIG. 6-B illustrates a perspective view the structural system 600 from FIG. 6-A, with a third structural module 300 on top of the second shear wall formwork 400-W and the second column formwork 400-C. Again, note that no shoring is required to place or support the third structural module 300. Likewise, no shoring is required to support any corrugation deck on the third structural module 300.

FIG. 7 illustrates a perspective view of a structural system 700, which is an expansion of and incorporates the aspects of the structural system 600. FIG. 7 shows a third shear wall formwork 400-W and a third column formwork 400-C on top of the second shear wall formwork 400-W and the second column formwork 400-C from FIG. 6-B.

FIG. 8-A illustrates a perspective view of a structural system 800, which is an expansion of and incorporates the aspects of the structural system 600. FIG. 8-A shows a fourth shear wall formwork 400-W and a fourth column formwork 400-C on top of the third shear wall formwork 400-W and the third column formwork 400-C from FIG. 7. A fourth structural module 200/300 is placed on top of the third shear wall formwork 400-W and the third column formwork 400-W, but below the fourth shear wall formwork 400-W and the fourth column formwork 400-C. FIG. 8-A also illustrates a sheet 280 of one or more sheets affixed to at least one beam (for example, the first beam 210). The one or more sheets provide a surface for building material to be poured on. Thus, the sheet 280 provides a surface for building material to be poured on when the sheet 280 is affixed to the at least one beam. At this point, the building material within the first shear wall formwork 400-W and withing the first column formwork 400-C has cured, so the first shear wall formwork 400-W and the first column formwork 400-C are removed.

FIG. 8-B illustrates a perspective view of the structural system 800 from FIG. 8-A, with wet building material 820 poured over a sheet 280 and with the shear wall rebars 510 and column rebars 520 extending out from top of the fourth shear wall formwork 400-W and the fourth column formwork 400-C. The perimeter angle 260 blocks the wet building material to pour away from the first structural module 200/300. Again, note that no shoring is required to place or support the any structural module 200/300. Technically, this allows the placement of a sheet 280 immediately after the placement of any structural module 200/300. In some embodiments, the sheet 280 is a corrugation sheet or corrugation deck. The pouring of building material onto the sheet 280 transforms the sheet 280 to a composite deck that permanently includes the sheet 280 and the corresponding structural module, surrounded by building material, as part of the composite deck. Thus, the pouring of wet building material transforms a structural module 200/300 or 350 into a composite deck, or a structural deck, once the building material has cured. As building material inside the shear wall formworks 400-W and the column formworks 400-C continues to cure, the shear wall formworks 400-W and the column formworks 400-C can be removed and the sheets 280 can be poured with wet building material.

In FIGS. 8-A and 8-B, the first shear wall formwork 400-W and the first column formwork 400-C are removed. However, the rest of the shear wall formwork 400-W and the column formwork 400-C are still shown in place, supported by the second, third, and fourth structural modules 200/300 and the already cured first floor shear walls and columns, which are now part of the structural system 800. The system incorporates the ability to place additional formwork in the structural system 400/500/600/700/800, such as additional shear wall formwork 400-W and/or column formwork 400-C or additional upper module sets. The upper module sets are supported by the poured and cured shear walls and/or columns below the upper module sets, or by the shear wall and/or column forms above the poured and cured shear walls and/or columns. This saves time and resources and bypasses the wait times typical of the 4-Day cycle. Likewise, the ability to create a deck (such as a composite deck) at any level of the in the structural system 400/500/600/700/800 saves time and resources and bypasses the wait times typical of the 4-Day cycle.

Figure 10:
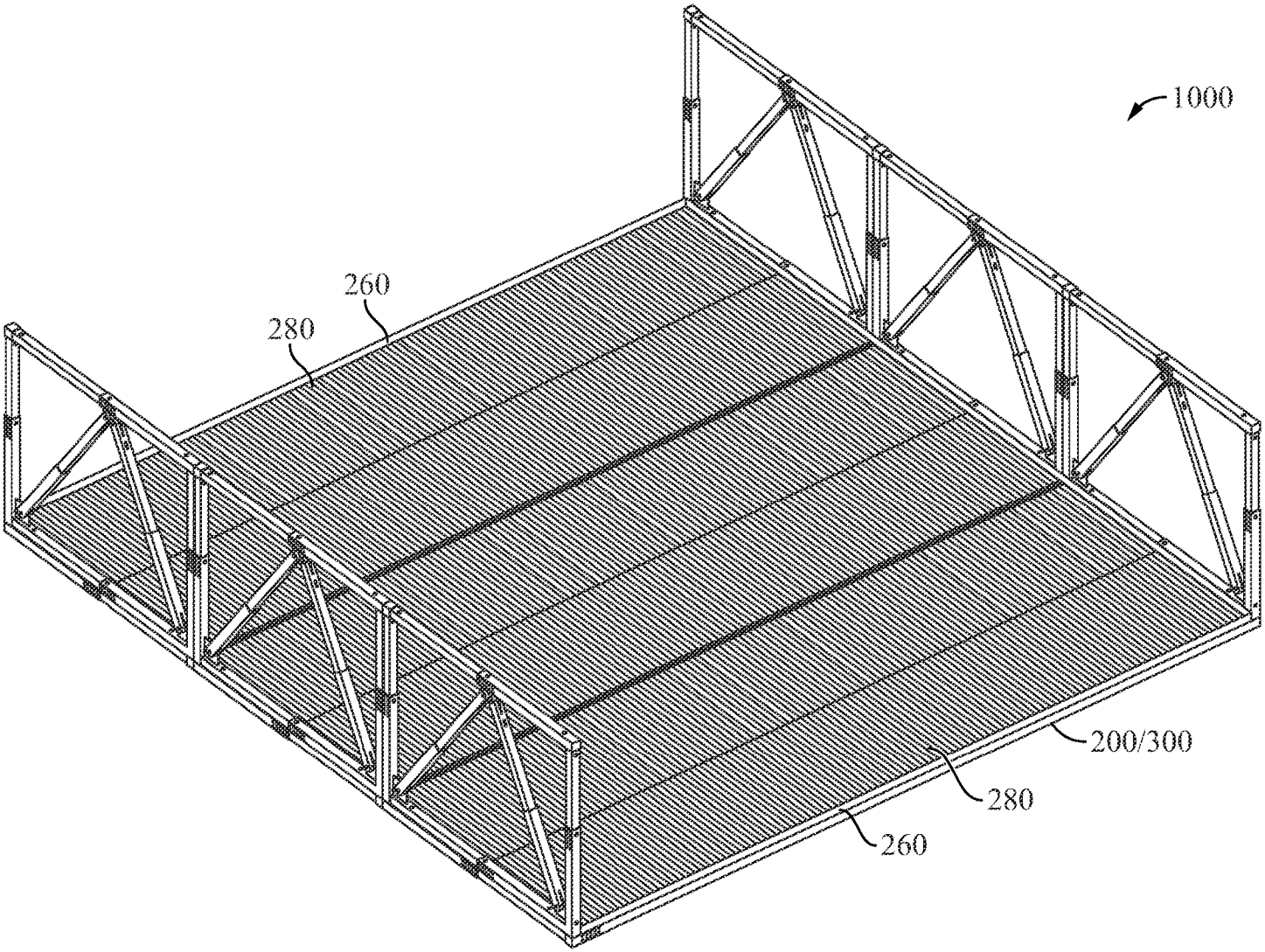
FIG. 10 illustrates a perspective view of a structural system, according to some embodiments.

Structural modules may be used in combination with or in substitution of shear walls and/or columns. FIGS. 9-A through 9-D illustrate views of a structural module which may be used as a vertical structural element or structural frame, while FIG. 10 illustrates the use of such structural module as a vertical structural element.

FIG. 9-A illustrates a front view of a structural module (vertical structural frame) 900, which incorporates the aspects of the structural module 200/300/350, in fully retracted form. FIG. 9-B illustrates the structural module 900 in partially expanded form. FIG. 9-C illustrates the structural module 900 in fully expanded form. FIG. 9-D illustrates a perspective view of the structural module 900 in fully expanded form.

The structural module 900 comprises an adjustable frame 901 with a double hinge gusset plate 950, a first and a second single hinge gusset plates 940, and a first and a second cross-braces 960-1, 960-2. The adjustable frame 901 is, rectangular, square, or quadrilateral. The double hinge gusset plate 950 is located inside the frame and connected to a frame side 902. The first and the second single hinge gusset plates 940-1, 940-2 are located at a first and a second internal corners 903-1, 903-2, respectively. The first and the second internal corners 903-1, 903-2 are located inside the adjustable frame 901 opposite to the frame side 902. The first cross-brace 960-1 is connected to the first single hinge gusset plate 940-1 and to the double hinge gusset plate 950. The second cross-brace 960-2 is connected to the second single hinge gusset plate 940-2 and to the double hinge gusset plate 950.

There are various ways to configure the adjustable frame 901 to make it adjustable. In some embodiments, the adjustable frame 901 comprises a first external beam 910-1 and a second external beam 910-2 with a distal end of the first external beam 910-1 connected to a distal end of the second external beam 910-2, a first internal beam 915-1 and a third external beam 915-2 with a distal end of the first internal beam 915-1 connected to a distal end of the third external beam 915-2, a second internal beam 920-1 and a third internal beam 920-2 with a distal end of the second internal beam 920-1 connected to a distal end of the third internal beam 920-2, and a fourth external beam 925-1 and a fourth internal beam 925-2 with a distal end of the fourth external beam 925-1 connected to a distal end of the fourth internal beam 925-2. The first internal beam 915-1 and the second internal beam 920-1 fit and slide into and out of the first external beam 910-1 and the third external beam 915-2, respectively. The third internal beam 920-2 and a fourth internal beam 925-2 fit and slide into and out of the fourth external beam 925-1 and the second external beam 910-2, respectively.

In some embodiments, the double hinge gusset plate 950 slides connected to the fourth external beam 925-1 to allow different form configurations as the first and second cross-braces 960 change in length and direction. The first cross-brace 960-1 comprises a first external cross-brace beam 962-1 and a first internal cross-brace beam 963-1. The second cross-brace 960-2 comprises a second external cross-brace beam 962-2 and a second internal cross-brace beam 963-2. The first internal cross-brace beam 963-1 fits and slides into and out of the first external cross-brace beam 962-1. The second internal cross-brace beam 963-2 fits and slides into and out of the second external cross-brace beam 962-2. The first cross-brace 960-1 comprises a first shear pin socket 970-1 at the distal end towards the first single hinge gusset plate 940-1, a second shear pin socket 970-2 at the distal end of the first external cross-brace beam 962-1 away from the first single hinge gusset plate 940-1, and a third shear pin socket 970-3 at the distal end of the first internal cross-brace beam 963-1 towards the double hinge gusset plate 950. The second cross-brace 960-2 comprises a fourth shear pin socket 970-4 at the distal end towards the second single hinge gusset plate 940-2, a fifth shear pin socket 970-5 at the distal end of the second external cross-brace beam 962-2 away from the second single hinge gusset plate 940-2, and a sixth shear pin socket 970-6 at the distal end of the second internal cross-brace beam 963-2 towards the double hinge gusset plate 950.

The first single hinge gusset plate 940-1 has a first gusset opening (not shown). FIGS. 9-A show a second gusset opening 980 at the second hinge gusset plate 940-2. The double hinge gusset plate 950 has a third and a fourth gusset openings (not shown). When both the first and the second cross-braces 960-1, 960-2 are fully extended, as in FIGS. 9-C and 9-D, the first shear pin socket 970-1 aligns to the first gusset opening, the fourth shear pin socket 970-4 aligns to the second gusset opening 980, and the third and the sixth shear pin sockets 970-3, 970-6 align to the third and the fourth gusset openings on the double hinge gusset plate 950.

Each of the first and second cross-braces 960-1, 960-2 has a fixed hinge pin 974 at each distal end, allowing the first and second cross-braces 960-1, 960-2 to change in angle when being adjusted into position for construction. When the structural module 900 is in fully extended form, the first and the second cross-braces 960-1, 960-2 are fully extended. The first, second, third, fourth, fifth, and sixth shear pin sockets 970-1, 970-2, 970-3, 970-4, 970-5, 970-6 become available, as holes line up to allow the insertion of a shear pin or bolt. Once the structural module 900 is fully extended, pins or bolt elements 972 are inserted into the various pin sockets 970, and then the structural module 900 becomes fixed in form and is no longer adjustable. The inserting of pins or bolt elements 972 into the various pin sockets 970 adds tensile and compressive strength to the structural module 900. Welding may be used in combination or in the alternative to the insertion of the various pins or bolt elements 972.

All beams of the structural module 900 and the first and second cross-braces 960-1, 960-2 comprise grout openings 120 to allow building material to be poured inside the beams, which once cured, increases the tensile and compressive strength of the structural module 900. The various grout openings 120 allow for airflow during pouring of building material and confirm the filling of any of the beams of the structural module 900 by the spilling over of building material. The grout openings 120 are plugged to stop the spilling over of building material. The building material, once cured, fixes the beams and the whole structural module 900 into position and form, meeting the desired construction dimensions. All beams of the structural module 900, including the first and second cross-braces 960-1, 960-2, act as a container which holds the wet building material until the building material cures. The cured building material inside the beams of the structural module 900 adds to the tensile and compressive strength of the structural module 900.

Furthermore, the adjustable frame can be fixed into position by curing of building material inside the adjustable frame, welding, bolting, and/or pinning, making the adjustable frame into an adjusted frame that is no longer adjustable, and the structural module 900 fixed in form.

In some embodiments, bolt holes 370 are located at the distal ends of the first external beam 910-1 toward the first internal beam 915-1, the distal end of second external beam 910-2 towards the fourth internal beam 925-2, and the distal end of the third external beam 915-2 towards the second internal beam 920-1, and the distal end of the fourth external beam 925-2 towards the third internal beam 920-2. The bolt holes 370 allow for bolting and securing the form of the structural module 900, increasing the shear resistance in both tension and compression and increasing the strength of the structural module 900. Each of the adjustable frame 901 and the first and second cross-braces 960-1, 960-2 comprise grout openings 120 which allows for the pouring of building material.

The structural module 900 acts in combination with or replaces other vertical structural elements, such as shear walls or columns, and/or formwork.

FIG. 10 illustrates a perspective view of structural system 1000. FIG. 10 shows how multiple vertical structural modules 900 may be combined with multiple horizontal structural modules 200/300 to create a structural modular system 1000. This type of configuration also allows for the placement of additional horizontal structural modules 200/300 on top of vertical structural modules 900, which can be oriented in either the x or y axis (shown in x axis only for clarity), creating multiple floor, each of which may have its own sheets 280, without the need for shoring to create the new floor nor to add such additional sheets 280.

A perimeter angle 260 rests at the top of the structural module 200/300 and/or along the horizontal perimeter (or perimeters, in case of multiple floors or separate modules) of the structural system 1000 and prevents any wet building material from pouring over and away from the sheet 280.

Figure 11:
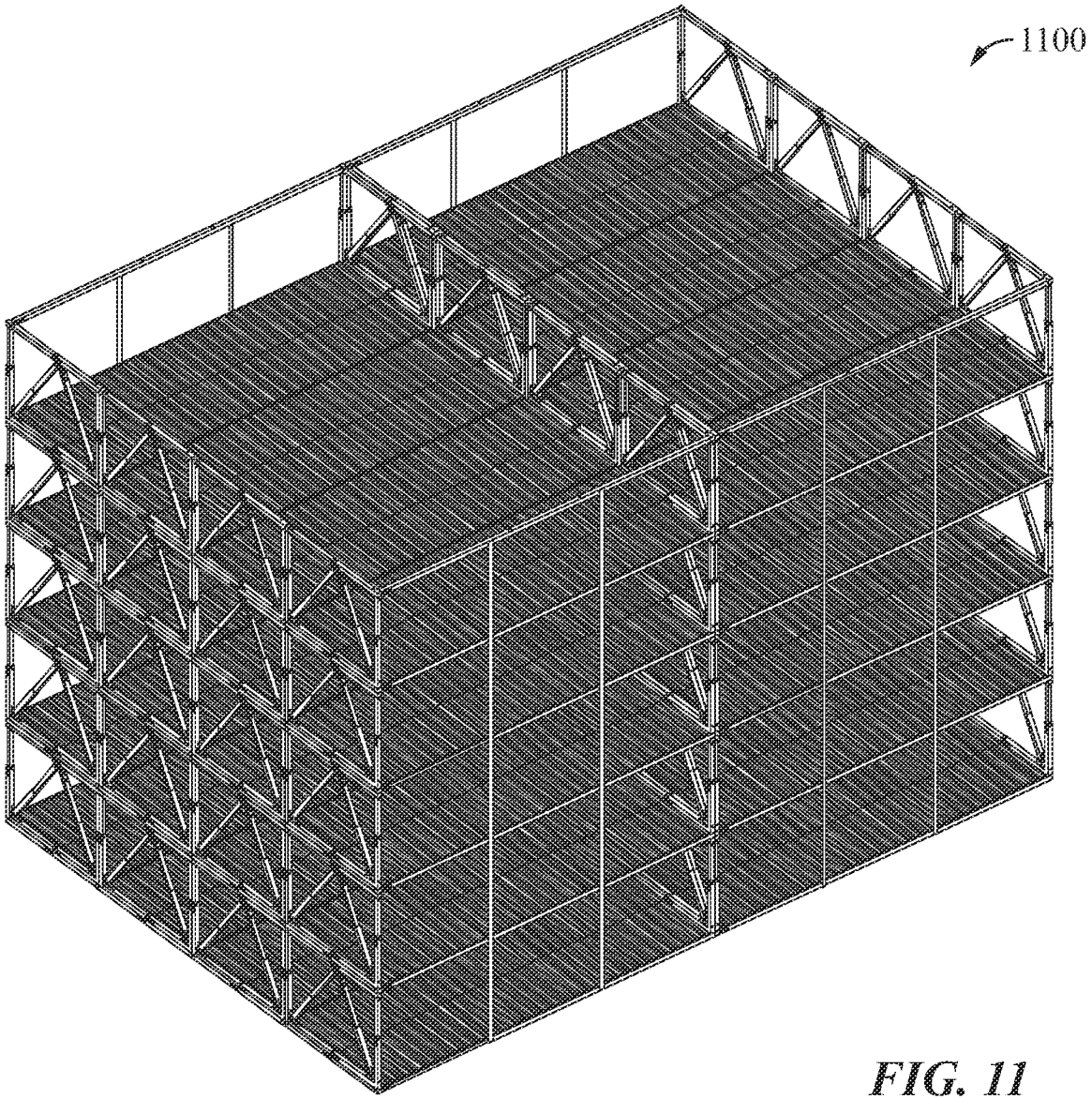
FIG. 11 illustrates a perspective view of the stacking of the structural modular system; according to some embodiments.

FIG. 11 illustrates the stacking of vertical structural modules 900 in the x and y direction (with the details in the y direction not shown for clarity) combined with multiple horizontal structural modules 300 to create a structural system 1100, which incorporates the aspects of the structural modular system 1000.

Figure 12:
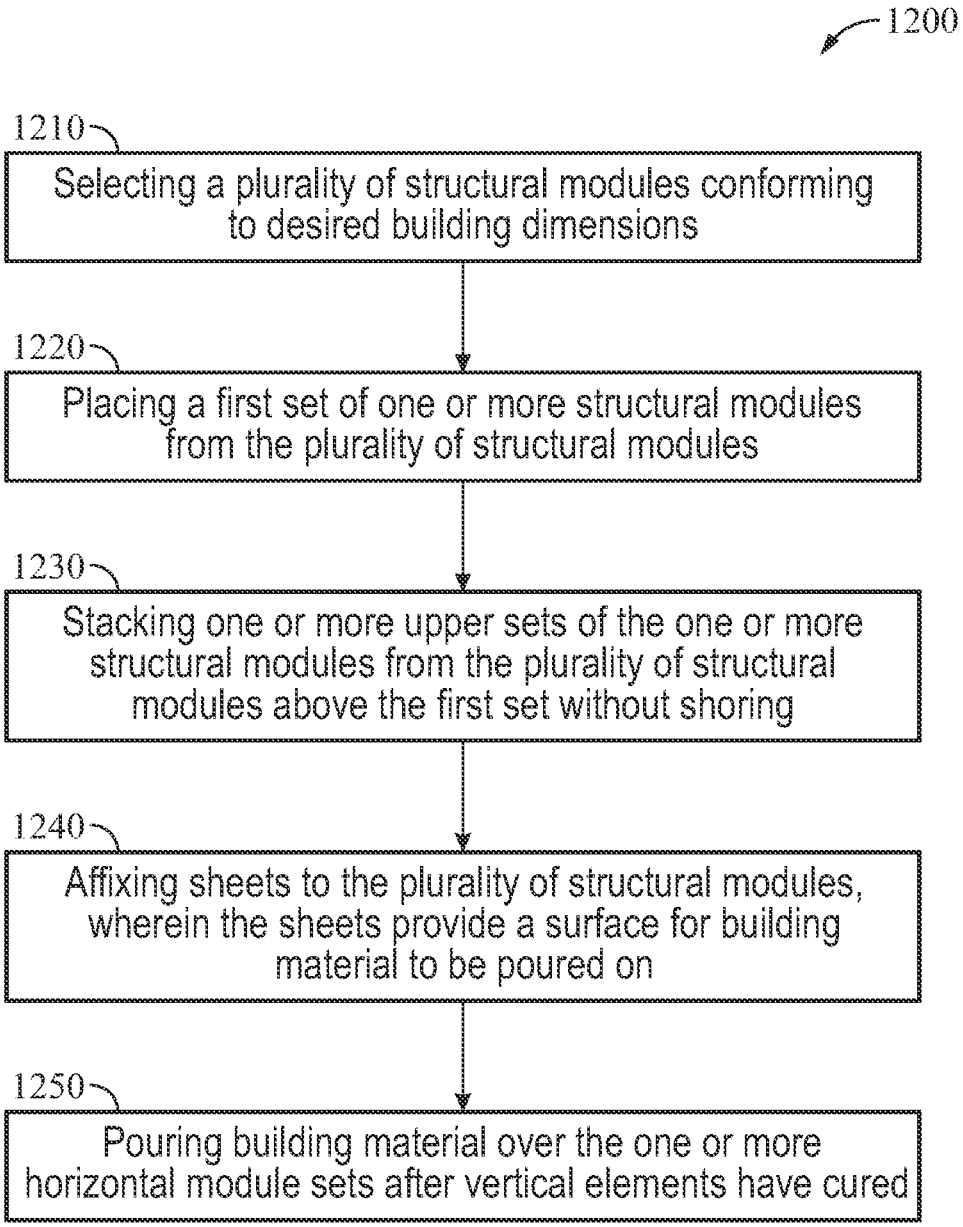
FIG. 12 illustrates a flowchart of a building process, according to some embodiments.

FIG. 12 illustrates building process 1200 with structural module 100, structural modules 200, 300 and/or 900, and/or structural modular systems 400, 500, 600, 700, 800, 1000, and/or 1100. The building process 1200 also operates with structural modules 1300, 1400, 1500, 1500-F, 1500-G, 1500-H, 1500-I, and/or 1600, discussed below. The process starts at step 1210, where a plurality of structural modules are selected that match or conform to the desired building dimensions. Because the structural modules are pre-engineered, the selection of structural modules includes selecting structural modules that will satisfy or exceed building engineering standards and requirements while matching or conforming to the desired building dimensions.

With the selected plurality of structural modules, in the next step 1220, a first set of one or more structural modules from the plurality of structural modules are placed in position for construction according to the desired construction dimensions. For example, the first set of the one or more structural modules could be the one or more structural modules that comprise a particular floor of a building, such as the basement, the first floor, second floor, or any other floor.

Then, in step 1230, one or more upper sets of the one or more structural modules from the plurality of structural modules are stacked above the first set of the one or more structural modules. Next, in step 1240, sheets, such as corrugated sheets, are affixed to the plurality of structural modules. The sheets provide a surface for building material to be poured on. FIGS. 6-A to 8-B and 11 illustrate various first sets with upper sets stacked above the first sets, with and without affixed sheets. Note that, at this point, none of the upper sets are supported by shoring. Instead, the upper module sets are supported by the poured shear walls and/or columns below the upper module sets, or by the shear wall and/or column forms above the poured shear walls and/or columns. In other words, the upper sets are supported by the shear walls and/or columns forms and vertical structural modules of the sets below them, whether other upper sets or the first set. In some embodiments, none of the one or more structural modules are supported by shoring. In some embodiments, none of the plurality of structural modules are supported by shoring.

In step 1250, building material is poured on the sheets 280 after the corresponding vertical elements have cured. Note that, contrary to the 4-Day Cycle and similar methods, the building process 1200 allows for the simultaneous pouring the vertical elements of multiple floors, setting in place horizontal structural modules (such as structural modules 200/300) and can include stacking for the creation of new floors. Note that, at this point, none of the upper sets are supported by shoring. Instead, the upper module sets are supported by the poured and cured shear walls and/or columns below the upper module sets, or by the shear wall and/or column forms above the poured and cured shear walls and/or columns. In other words, the stacking one or more upper sets of one or more structural modules from the plurality of structural modules above the first set allows for the pouring building material over the one or more upper sets after vertical elements have cured.

FIGS. 13-A, 13-B, 13-C, and 13-D illustrate structural module 1300, which incorporates the aspects of the structural modules 200, 300, and/or 350. FIG. 13-A illustrates a perspective view of the structural module 1300 in non-extended form. The structural module 1300 comprises a first beam 1310 of one or more beams; one or more sheets 280 (see FIG. 13-D) supported by a interior perimeter angle 1315, hook bars 1360, and a first set of rebar 1368 (sec FIG. 13-C). In some embodiments, the structural module 1300 further comprises a second beam 1320 of the one or more beams, a first and second enclosing beams 1312, 1313 of the one or more beams; a first and second adjustable beams 1322, 1323 of the one or more beams, and a second set of rebar 1370 (see FIG. 13-C). FIGS. 13-B and 13-C illustrate a perspective view of the structural module 1300 in extended form and show the first and second adjustable beams 1322, 1323, each extended out from inside the first and second enclosing beams 1312, 1313, respectively, and connected to the second beam 1320. When extended, the first and second adjustable beams 1322, 1323 can be secured in position with respect to the first and the second enclosing beams by securing bolt holes 370 with screws or pins and/or by welding. The bolt holes 370 are located at the distal ends of the first and second enclosing beams 1312, 1313 that remains enclosing a portion of the first and second adjustable beams 1322, 1323 when the structural module 1300 is in extended form.

In some embodiments, the first center beam 1330 and a second center beam 1340 are parallel to the first beam 1310. In some embodiments, the first beam 1310, the second beam 1320, the first and second enclosing beams 1312, 1313, and the first and second adjustable beams 1322, 1323 form a rectangular shape. The term "center" in first center beam 1330 and second center beam 1340 is used for simplicity, as these beams may be centered or may be located with respect to the first beam 1310 and/or the second beam 220 without being precisely located in the center between the first beam 1310 and the second beam 1320 when then structural module 1300 is in extended form. In some embodiments, the first center beam 1330 and second center beam 1340 are located somewhere between the first beam 1310 and the second beam 1320. Also note that the first and second enclosing beams 1312, 1313 and the first and second adjustable beams 1322, 1323 are optional, as some embodiments might not include the first and second enclosing beams 1312, 1313 and the first and second adjustable beams 1322, 1323 while still positioning the rest of the one or more beams adequately for construction, with or without the first set of rebar 1368 or the second set of rebar 1370.

During installation, the structural module 1300 may need to be stacked in a manner in which rebar will need to pass through the structural module 1300. First top slots 1318 are located at the top of the first and second enclosing beams 1312, 1313 and the first and second adjustable beams 1322, 1323. First bottom slots (not shown) are located at the bottom of the first and second enclosing beams 1312, 1313 and the first and second adjustable beams 1322, 1323. The first top slots 1318 and the first bottom slots allow rebar from a shear wall to pass through the first and second enclosing beams 1312, 1313 and through the first and second adjustable beams 1322, 1323 during installation. Second top slots 1319 are located at the top of the first beam 1310 and the second beam 1320. Second bottom slots (not shown) are located at the bottom of the first beam 1310 and the second beam 1320. The second top slots 1318 and the second bottom slots allow rebar from columns to pass through the first beam 1310 and the second beam 1320 during installation. The one or more sheets 280 can be provided with similar slots on site for installation. Similarly, the one or more sheets 280 can be cut in pieces and welded on site to fit any structural module.

The interior perimeter angle 1315 is an "L" shaped beam located on the sides of the one or more beams, forming a ledge on which any of the one or more sheets 280 may rest. The interior perimeter angle 1315 may be welded on the construction site. The interior perimeter angle 1315 has a series of openings to not obstruct side openings 1314 when welded to the sides of the one or more beams.

The first beam 1310 has deflection reduction properties. The second beam 1320 has deflection reduction properties and the same orientation as the first beam when the structural module 1300 is placed for construction. The first and second enclosing beams 1312, 1313 are each connected to the first beam 1310. In some embodiments, the structural module 1300 further comprises a first center beam 1330 and a second center beam 1340. In some embodiments, the first beam 1310, the second beam 1320, the first center beam 1330, and the second center beam 1340 have one or more grout openings 120. The structural module 1300 is not supported by shoring when the structural module is placed for construction, for example, when stacked on shear wall formwork and/or column formwork.

FIG. 13-C illustrates a perspective view of the structural module 1300 with the first set of rebar 1368 and the second set of rebar 1370. The first set of rebar 1368 and the second set of rebar 1370 are supported by chairs 1366 on the one or more sheets 280. The sheet 280 is not shown in FIG. 13-C for visual clarity of the shown aspects. The first set of rebar 1368 is parallel to the first beam 1310. The first set of rebar 1368 has an orientation different than the second set of rebar 1370. In FIG. 13-C, the first set of rebar 1368 is shown to have an orientation perpendicular to the orientation of the second set of rebar 1370. A plurality of rebars of the second set of rebar 1370 passes through the first center beam 1330 and the second center beam 1340 through the side openings 1314 of the first center beam 1330 and the second center beam 1340, as further discussed below.

In the configurations illustrated in FIGS. 13-A, 13-B, 13-C, and 13-D, the first and second enclosing beams 1312, 1313 are connected to a first distal end and a second distal end of the first beam 1310. The adjustable beams 1322 are inside the first and second enclosing beams 1312, 1313 in FIG. 13-A and are extended out from the first and second enclosing beams 1312, 1313 in FIGS. 13-B, 13-C, and 13-D. Note that the first and second adjustable beams 1322, 1323 may be extended to different lengths according to any desired building dimensions. Each one of the one or more beams has a series of side openings 1314 on the side facing towards inside the area enclosed by the perimeter of the structural module 1300. In cases of only one beam, the beam 1310 has side openings on only one side or in both sides. In cases when the multiple beams of the one or more beams do not enclose an area, the one or more beams have side openings 1314 on both sides or on the side facing the other beams of the one or more beams. In cases when there is an enclosed area and beams inside the enclosed area, the one or more beams have side openings 1314 on both sides or on the side facing the other beams of the one or more beams. In some embodiments, and exception is made with the first and second adjustable beams 1322, 1323, which have side slots 1316 to accommodate hook portions 1364 of the hook rebars 1360 when the first and second adjustable beams 1322, 1323 are inside the first and second enclosing beams 1312, 1313.

Each hook rebar 1360 has a straight portion 1362. The straight portions 1362 extend out of the side openings 1314. As shown in FIG. 13-A, when the structural module 1300 is in non-extended form, the straight portions 1362 extending out from the side openings 1314 of the second beam 1320 fit through the side openings 1314 of the first center beam 1330 and the second center beam 1340. In FIG. 13-C, the first set of rebar 1368 and the second set of rebar 1370 are shown touching the straight portions 1362 of the hook rebars 1360, including hook rebars placed at the side slots 1316. In operation, and the first set of rebar 1368 and the second set of rebar 1370 are tied or welded to the corresponding straight portions 1362.

FIG. 13-D illustrates a perspective view of the structural module 1300 and a close-up view of part of the structural module 1300 with the one or more sheets 280 resting on the interior perimeter angle 1315 (not shown because it is covered by the one or more sheets 280). In some embodiments, at least one of the one or more sheets 280 is a corrugated sheet. The one or more sheets 280 are secured to the interior perimeter angle 1315 by nelson studs 262, and/or by welding, bolting, and/or pinning. The pouring of building material onto the sheet 280 transforms the sheet 280 to a composite deck that permanently includes the sheet 280 and the corresponding structural module, surrounded by building material, as part of the composite deck. Thus, the pouring of wet building material transforms a structural module 1300 into a composite deck, or a structural deck.

FIG. 13-E illustrates a cross-section view of part of the structural module 1300, with the interior perimeter angle 1315 welded to the second beam 1320, a rebar of the first set of rebar 1368 passing through the second beam 1320, the hook portion 1364 inside the second beam 1320, and the straight portion 1362 extending through the side opening 1314. The sheet 280 rests on the interior perimeter angle 1315 and is secured to the perimeter angle with the nelson studs 262 and/or by welding, bolting, and/or pinning.

It will be apparent to those skilled in the art that the distinctions between beams serves the purpose of illustrating and describing the features and aspects, but that such distinctions do not mean that two or more beams could not be considered just one beam. For example, the first beam 1310 and the first and second enclosing beams 1312, 1313 may be characterized as a first frame 1301, with or without the first center beam 1330 and/or the second center beam 1340. Likewise, the second beam 1320 and the first and the second adjustable beams 1322 may be characterized as a second frame 1302, with or without the second center beam 1340.

In operation, the structural module 1300 is fitted, dimensioned, and shaped to match desired construction dimensions. For example, if the structural module 1300 will be used to create support for a deck or sheets 280, the first frame 1301 and the second frame 1302 are prefabricated, adjusted to the desired construction dimensions by extending the second frame 1302, welded with the interior perimeter angle 1315 as described above, affixed with the one or more sheets 280 on the interior perimeter angle 1315, placed with the first set of rebar 1368 and the second set of rebar 1370 tied or welded to the hook rebars 1360, and the building material (for example, wet concrete) is poured on sheet 280 before or after the structural module 1300 is placed on the desired construction location. Prior to pouring building material, a first sheet of the one or more sheets 280 is affixed on the interior perimeter angle 1315 at the first frame 1301 and a second sheet of the one or more sheets 280 is affixed on the interior perimeter angle 1315 at the second frame 1302. The pouring of building material onto the sheet 280 (not shown in FIG. 13) transforms the sheet 280 to a composite deck that permanently includes the sheet 280 and the corresponding structural module, the first set of rebar 1368 and/or the second set of rebar 1370, surrounded by building material, as part of the composite deck. Thus, the pouring of wet building material transforms a structural module 1300 into a composite deck, or a structural deck, once the building material has cured. In the case of multiple structural modules 1300 placed together laterally or in another orientation at the same level, the interior perimeter angle 1315 will follow the interior perimeter of the multiple structural modules 1300.

Figure 14:
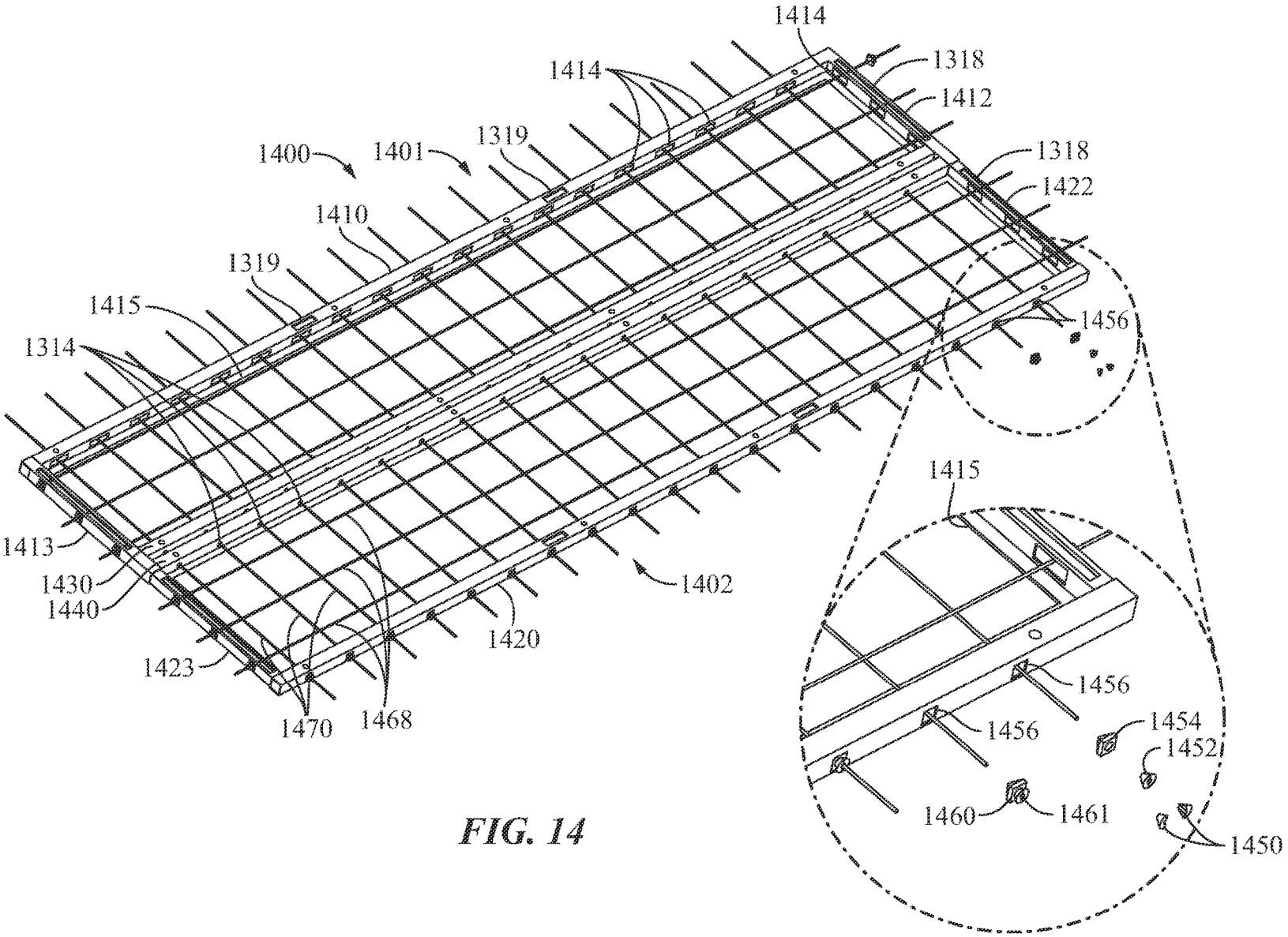
FIG. 14 illustrates a perspective view of a structural module, according to some embodiments.

FIG. 14 illustrates a perspective view of structural module 1400, which incorporates the aspects of the structural modules 200, 300, 350, and/or 1300. The structural module 1400 is shown in extended form. The structural module 1400 comprises a first beam 1410 of one or more beams; one or more sheets 280 (not shown) supported by a perimeter angle 1415, a second beam 1420 of the one or more beams, a first and second enclosing beams 1412, 1413 of the one or more beams, a first and second adjustable beams 1422, 1423, of the one or more beams, a first center beam 1430, a second center beam 1440, a first set of tensioned cables 1468, and a second set of tensioned cables 1470. The perimeter angle 1415 is an "L" shaped beam located on the sides of the one or more beams, forming a ledge on which any of the one or more sheets 280 may rest. The perimeter angle 1415 may be welded on the construction site. The perimeter angle 1415 has a series of openings to not obstruct side openings 1414 when welded to the sides of the one or more beams.

The pouring of building material onto the sheet 280 (not shown in FIG. 14) transforms the sheet 280 to a composite deck that permanently includes the sheet 280 and the corresponding structural module, one or more post-tensioned cables 1468 and/or 1470 surrounded by building material, as part of the composite deck. Thus, the pouring of wet building material transforms a structural module 1400 into a composite deck, or a structural deck, once the building material has cured.

Side openings 1414 are longer and wider than the outside openings 1456. The outside openings 1456 are a series of openings located through the outside perimeter of the structural module 1400. The outside openings 1456 match in size and dimensions with the compression device 1460. The compression device 1460 comprises a pyramid 1454 and a wedge 1452. In some embodiments, the wedge 1452 is comprised by a pair of half wedges 1450. Compression devices 1460 are positioned at the outside openings 1456 and have an aperture 1461 through which cables of the first set of tensioned cables 1468 or the second set of tensioned cables 1470 pass through. After the building material cures, when tensioning the first set of tensioned cables 1468 and/or the second set of tensioned cables 1470, the reactionary compression forces are more evenly distributed by using a pyramid 1454. The side openings 1414 are larger than the outside openings 1456 to clear the reactionary forces caused by the compression devices 1460. The compression devices 1460 fit into the outside openings 1456 and are tack welded at the outside openings 1456 to hold the compression devices 1460 in place, the pyramids 1454 being inside the structural module 1400. Thus, the pyramid 1454 become part of the composite deck once building material is poured and cures. Tack welding the compression devices 1460 in place prevents the building material from leaking out of the side opening 1456 when the building material is wet. In operation, when the post-tension cables are stressed, the applied hydraulic pressure will break the tack welds, freeing the compression devices 1460 from the outside openings 1456 and allow the pyramids 1454 to move withing the outside openings 1456. The pyramid's moving freely is important because the pyramids 1454 apply inward compressive forces into the building material once the building material has cured and the post-tension cables are stressed.

In some embodiments, the first center beam 1430 and a second center beam 1440 are parallel to the first beam 1410. In some embodiments, the first beam 1410, the second beam 1420, the enclosing beams 1412, and the adjustable beams 1422 form a rectangular shape. The term "center" in first center beam 1430 and second center beam 1440 is used for simplicity, as these beams may be centered or may be located with respect to the first beam 1410 and/or the second beam 1420 without being precisely located in the center between the first beam 1410 and the second beam 1420 when then structural module 1400 is in extended form. In some embodiments, the first center beam 1430 and second center beam 1440 are located somewhere between the first beam 1410 and the second beam 1420. Also note that the first and second enclosing beams 1412, 1413 and the first and second adjustable beams 1422, 1423 are optional, as some embodiments might not include the first and second enclosing beams 1412, 1413 and the first and second adjustable beams 1422, 1423 while still positioning the rest of the one or more beams adequately for construction.

It will be apparent to those skilled in the art that the distinctions between beams serves the purpose of illustrating and describing the features and aspects, but that such distinctions do not mean that two or more beams could not be considered just one beam. For example, the first beam 1410 and the first and second enclosing beams 1412, 1413 may be characterized instead as one beam that may be characterized as a first frame 1401, with or without the first center beam 1430. Likewise, the second beam 1420 and the first and second adjustable beams 1422, 1423 may be characterized as a second frame 1402, with or without the second center beam 1440.

In operation, the structural module 1400 is fitted, dimensioned, and shaped to match desired construction dimensions. For example, if the structural module 1400 will be used to create support for a deck or sheets 280, the first frame 1401 and the second frame 1402 are prefabricated, adjusted to the desired construction dimensions by extending the second frame 1402, welded with the interior perimeter angle 1415 as described above, affixed with the one or more sheets 280 on the interior perimeter angle 1415, placed with the first set of post-tensioned cables 1468 and the second set of post-tensioned cables 1470, affixed with the compression device 1460 at the outside openings 1456, and poured with building material (for example, wet concrete) on sheet 280 before or after the structural module 1400 is placed on the desired construction location. Prior to pouring building material, a first sheet of the one or more sheets 280 is affixed on the interior perimeter angle 1415 at the first frame 1401 and a second sheet of the one or more sheets 280 is affixed on the interior perimeter angle 1415 at the second frame 1402. The pouring of building material onto the sheet 280 (not shown in FIG. 13) transforms the sheet 280 to a composite deck that permanently includes the sheet 280 and the corresponding structural module, the first set of post-tensioned cables 1468, the second set of post-tensioned cables 1470, and the compression device 1460 surrounded by building material, as part of the composite deck. Thus, the pouring of wet building material transforms a structural module 1400 into a composite deck, or a structural deck, once the building material has cured. In the case of multiple structural modules 1400 placed together laterally or in another orientation at the same level, the interior perimeter angle 1415 will follow the interior perimeter of the multiple structural modules 1400.

FIGS. 15-A, 15-B, 15-C, and 15-D illustrate structural module 1500, which incorporates the aspects of the structural modules 200, 300, 350, 1300, and/or 1400. FIG. 15-A illustrates a perspective view of the structural module 1500 in non-extended form. The structural module 1500 comprises a first beam 1510 of one or more beams, one or more sheets 280, hook bars 1360, and a first set of rebar 1368. In some embodiments, the structural module 1500 further comprises a second beam 1520 of the one or more beams, a first and second enclosing beams 1512, 1513 of the one or more beams; a first and second adjustable beams 1522, 1523 of the one or more beams, and a second set of rebar 1370. FIGS. 15-B and 15-C illustrate a perspective view of the structural module 1500 in extended form and show the first and second adjustable beams 1522, 1523, each extended out from inside the first and the second enclosing beams 1512, respectively, and connected to the second beam 1520. When extended, the first and second adjustable beams 1522, 1523 can be secured in position with respect to the first and the second enclosing beams by securing bolt holes 370 with screws or pins and/or by welding. The bolt holes 370 are located at the distal ends of the first and second enclosing beams 1512, 1513 that remain enclosing a portion of the first and second adjustable beams 1522, 1523 when the structural module 1500 is in extended form.

In some embodiments, the first center beam 1530 and a second center beam 1540 are parallel to the first beam 1510. In some embodiments, the first beam 1510, the second beam 1520, the enclosing beams 1512, and the adjustable beams 1522 form a rectangular shape. The term "center" in first center beam 1530 and second center beam 1540 is used for simplicity, as these beams may be centered or may be located with respect to the first beam 1510 and/or the second beam 1520 without being precisely located in the center between the first beam 1510 and the second beam 1520 when then structural module 1500 is in extended form. In some embodiments, the first center beam 1530 and second center beam 1540 are located somewhere between the first beam 1510 and the second beam 1520. Also note that the first and second enclosing beams 1512, 1513 and the first and second adjustable beams 1522, 1523 are optional, as some embodiments might not include the first and second enclosing beams 1512, 1513 and the first and second adjustable beams 1522, 1523 while still positioning the rest of the one or more beams adequately for construction, with or without the first set of rebar 1368 or the second set of rebar 1370.

During installation, the structural module 1500 may need to be stacked in a manner in which rebar will need to pass through the structural module 1500. First top slots 1318 are located at the top of the first and second enclosing beams 1512, 1513 and the first and second adjustable beams 1522, 1523. First bottom slots (not shown) are located at the bottom of the first and second enclosing beams 1512, 1513 and the first and second adjustable beams 1522, 1523. The first top slots 1318 and the first bottom slots allow rebar from a shear wall to pass through the first and second enclosing beams 1312, 1313 and through the first and second adjustable beams 1322, 1323 during installation. Second top slots 1319 are located at the top of the first beam 1510 and the second beam 1520. Second bottom slots (not shown) are located at the bottom of the first beam 1510 and the second beam 1520. The second top slots 1318 and the second bottom slots allow rebar from columns to pass through the first beam 1510 and the second beam 1520 during installation. The one or more sheets 280 can be provided with similar slots on site for installation. Similarly, the one or more sheets 280 can be cut in pieces and welded on site to fit the structural module 1500.

The first beam 1510 has deflection reduction properties. The second beam 1520 has deflection reduction properties and the same orientation as the first beam when the structural module 1500 is placed for construction. The first and second enclosing beams 1512, 1513 are each connected to the first beam 1510. In some embodiments, the structural module 1500 further comprises a first center beam 1530 and a second center beam 1540. The structural module 1500 is not supported by shoring when the structural module is placed for construction, for example, when stacked on shear wall formwork and/or column formwork.

The first beam 1510, the second beam 1520, the first center beam 1530, and the second center beam 1540 are "C" shaped, with strips 1518 providing support and with the "C" beam shape bottom 1516 providing support for the one or more sheets 280.

FIG. 15-C illustrates a perspective view of the structural module 1500 with the first set of rebar 1368 and the second set of rebar 1370. The first set of rebar 1368 and the second set of rebar 1370 are supported by chairs 1366 on the one or more sheets 280. The sheet 280 is not shown in FIG. 15-C for visual clarity of the shown aspects. The first set of rebar 1368 has an orientation different than the second set of rebar 1370. In FIG. 15-C, the first set of rebar 1368 is shown to have an orientation perpendicular to the orientation of the second set of rebar 1370. In some embodiments, a plurality of rebars of the second set of rebar 1370 passes through the first center beam 1530 and the second center beam 1540 through the side openings (not shown) of the first center beam 1530 and the second center beam 1540, as further discussed below.

In the configurations illustrated in FIGS. 15-A, 15-B, 15-C, and 15-D, the first and second enclosing beams 1512, 1513 are connected to a first distal end and a second distal end of the first beam 1510. The adjustable beams 1522 are inside the first and second enclosing beams 1512, 1513 in FIG. 15-A and are extended out from the first and second enclosing beams 1512, 1513 in FIGS. 15-B, 15-C, and 15-D. Note that the first and second adjustable beams 1522, 1523 may be extended to different lengths according to any desired building dimensions. Each one of the one or more beams has a series of side apertures 1514 on the side facing towards inside the area enclosed by the perimeter of the structural module 1500. In cases of only one beam, the beam 1510 has side openings on only one side or in both sides. In cases when the multiple beams of the one or more beams do not enclose an area, the one or more beams have side apertures 1514 on both sides or on the side facing the other beams of the one or more beams. In cases when there is an enclosed area and beams inside the enclosed area, the one or more beams have side apertures 1514 on both sides or on the side facing the other beams of the one or more beams. In some embodiments, the second set of rebar 1370 pass through the first center beam 1530 and the second center beam 1540 through a series of circular side openings (not shown). In some embodiments, a first half of the rebars of the first set of rebar 1368 are tied to straight portions 1364 of hook rebars 1360 extending from the first center beam 1530. Likewise, in some embodiments, the first set of rebar 1368 pass through the first center beam 1530 and the second center beam 1540 through a series of circular side openings (not shown). In some embodiments, a second half of the rebars of the first set of rebar 1368 are tied to straight portions 1364 of hook rebars 1360 extending from the second center beam 1540 (not shown).

FIG. 15-D illustrates a perspective view of the structural module 1500 with a close-up view of part of the structural module 1500. FIG. 15-D shows a first sheet of the one or more sheets 280 supported by the first beam 1510, the first and the second enclosing beams 1512, and the first center beam 1530. FIG. 15-D also shows a second sheet of the one or more sheets 280 supported by the second beam 1520, the first and the second adjustable beams 1512, and the second center beam 1540.

FIG. 15-E illustrates a cross-section view of part of the structural module 1500. FIG. 15-E shows the second sheet of the one or more sheets 280 supported by the beam bottom 1516 of the second beam 1520, a rebar of the first set of rebar 1368 passing through the second beam 1520, the hook portion 1364 inside the second beam 1520, and the straight portion 1362 extending through the side aperture 1514. Part of the inside of the first adjustable beam 1522 is shown as part of the background. This side aperture 1514 is dimensioned by the first strip 1518, by a second strip 1518 (not shown in FIG. 15-E), and by the top and bottom of the second beam 1520.

It will be apparent to those skilled in the art that the distinctions between beams serves the purpose of illustrating and describing the features and aspects, but that such distinctions do not mean that two or more beams could not be considered just one beam. For example, the first beam 1510 and the first and second enclosing beams 1512, 1513 may be characterized instead as a first frame 1501, with or without the first center beam 1530 and/or the second center beam 1540. Likewise, the second beam 1520 and the first and the second adjustable beams 1512 may be characterized as a second frame 1502, with or without the second center beam 1540.

In operation, the structural module 1500 is fitted, dimensioned, and shaped to match desired construction dimensions. For example, if the structural module 1500 will be used to create support for a deck or sheets 280, the first frame 1501 and the second frame 1502 are prefabricated, adjusted to the desired construction dimensions by extending the second frame 1502, affixed with the one or more sheets 280 on beam shape bottom 1516, placed with the first set of rebar 1368 and the second set of rebar 1370 tied or welded to the hook rebars 1360 (the first set of rebar 1368 and the second set of rebar 1370 are placed on chairs 1366 to hold the first set of rebar 1368 and the second set of rebar 1370 in position until the building material is poured), and poured with building material (for example, wet concrete) on sheet 280 before or after the structural module 1500 is placed on the desired construction location. Prior to pouring building material, a first sheet of the one or more sheets 280 is affixed beam shape bottom 1516 at the first frame 1501 and a second sheet of the one or more sheets 280 is affixed on the beam shape bottom 1516 at the second frame 1502 by welding, bolting, and/or pinning. The pouring of building material (not shown in FIG. 15) onto the sheet 280 transforms the sheet 280 to a composite deck that permanently includes the sheet 280 and the corresponding structural module, the first set of rebar 1368, the second set of rebar 1370, the chairs 1366, the hook rebars 1360, and the building material as part of the composite deck. Thus, the pouring of wet building material transforms a structural module 1500 into a composite deck, or a structural deck, once the building material has cured.

FIG. 15-F illustrates a perspective view of structural module 1500-F, which is a modification of and incorporates the aspects of the structural module 1500. The structural module 1500-F comprises a first beam 1510-F, a first and second enclosing beams 1512-F, 1513-F, a second beam 1520-F, a first and second adjustable beams 1522-F, 1523-F, a first center beam 1530-F, and/or a second center beam 1540-F, which incorporate the aspects of the first beam 1510, the first and the second enclosing beams 1512, the second beam 1520, the first and second adjustable beams 1522, 1523, the first center beam 1530, and the second center beam 1540, respectively. Each one of the first beam 1510-F, the first and second enclosing beams 1512-F, 1513-F, the second beam 1520-F, the first and second adjustable beams 1522, 1523-F, the first center beam 1530-F, and the second center beam 1540-F has a series of side holes 1517 which allow rebar from other structural modules to pass through the structural module 1500-F. There will be structural modules that have both one or more beams with side holes 1517 and one or more beams without side holes 1517. For example, in a building with rectangular desired building dimensions, the structural modules at the borders of the rectangular shape will have one or more beams without side holes 1517 for such beams defining the outside perimeter of the rectangular desired building dimensions, while the rest of the one or more beams will have side holes 1517. The rebars may be replaced with tensioning cables, using the aspects described above. In the case of multiple structural modules 1500-F placed together laterally or in another orientation at the same level, the first set of rebar 1368 and/or the second set of rebar 1370 may pass through side holes 1517 between structural modules 1500-F. Structural modules 1500-F throughout the perimeter of the desired construction dimensions will not have side holes 1517 on the sides facing the perimeter of the desired construction dimensions.

The pouring of building material onto the sheet 280 transforms the sheet 280 to a composite deck that permanently includes the sheet 280 and the corresponding structural module, surrounded by building material, as part of the composite deck. Thus, the pouring of wet building material transforms a structural module 1500 or 1500-F into a composite deck, or a structural deck once the building material has cured.

It will be apparent to those skilled in the art that the distinctions between beams serves the purpose of illustrating and describing the features and aspects, but that such distinctions do not mean that two or more beams could not be considered just one beam. For example, the first beam 1510-F and the first and second enclosing beams 1512-F, 1513-F may be characterized as a first frame 1501-F, with or without the first center beam 1530-F and/or the second center beam 1540-F. Likewise, the second beam 1520-F and the first and the second adjustable beams 1512-F may be characterized as a second frame 1502-F, with or without the second center beam 1540-F.

In operation, the structural module 1500-F is fitted, dimensioned, and shaped to match desired construction dimensions. For example, if the structural module 1500-F will be used to create support for a deck or sheets 280, the first frame 1501 and the second frame 1502 are prefabricated, adjusted to the desired construction dimensions by extending the second frame 1502, affixed with the one or more sheets 280 on beam shape bottom 1516-F, placed with the first set of rebar 1368 and the second set of rebar 1370 tied or welded to the hook rebars 1360 (the first set of rebar 1368 and the second set of rebar 1370 are placed on chairs 1366 to hold the first set of rebar 1368 and the second set of rebar 1370 in position until the building material is poured), and poured with building material (for example, wet concrete) on sheet 280 before or after the structural module 1500-F is placed on the desired construction location. Prior to pouring building material, a first sheet of the one or more sheets 280 is affixed beam shape bottom 1516-F at the first frame 1501-F and a second sheet of the one or more sheets 280 is affixed on the beam shape bottom 1516-F at the second frame 1502-F by welding, bolting, and/or pinning. The pouring of building material (not shown in FIG. 15) onto the sheet 280 transforms the sheet 280 to a composite deck that permanently includes the sheet 280 and the corresponding structural module, the first set of rebar 1368, the second set of rebar 1370, the chairs 1366, the hook rebars 1360, and the building material as part of the composite deck. Thus, the pouring of wet building material transforms a structural module 1500-F into a composite deck, or a structural deck, once the building material has cured.

FIG. 15-G illustrates a perspective view of structural module 1500-G, which incorporates the characteristics of structural module 1500. The difference between the structural module 1500 and the structural module 1500-G is that the structural module 1500-G has a second beam 1520-G that is curved, instead of having the second beam 1520. Similarly, the second beam 1520-G has inside a curved rebar 1568-G. The curved beam 1520-G makes additional desired building dimensions available to developers, designers, engineers, and architects.

FIG. 15-H illustrates a perspective view of structural module 1500-H, which incorporates the characteristics of the structural module 1400 and 1500. A difference between the structural module 1500-F and the structural modules 1400 and 1500 is that the structural module 1500-H has a second beam 1520-H that is curved, instead of having the second beam 1420 or the second beam 1520. Note that rebar may be added to the structural module 1500-H for additional rigidity to the structure. The curved beam 1520-H makes additional desired building dimensions available to developers, designers, engineers, and architects. Another difference is that the various beams of the structural module 1400 do not have the side apertures 1514 and the strips 1518 found in the various beams of the structural module 1500-H. A similarity between the structural module 1500-H and the structural module 1500 is the use of a first beam 1510-H, first and second enclosing beams 1512-H, 1513-H, a second beam 1520-H, first and second adjustable beams 1522-H, 1523-H, first center beam 1530-H, and the second center beam 1540-H, which incorporate the aspects of the first beam 1510, the first and second enclosing beams 1512, 1513, the second beam 1520, the first and second adjustable beams 1522, 1523, the first center beam 1530, and the second center beam 1540, respectively. A difference between the structural module 1500-H and the structural module 1500 is that the structural module 1500-H, like the structural module 1400, uses post-tensioned cables through outside openings 1456 along the outside perimeter of the structural module 1500-H. FIG. 15-H shows compression devices 1460 occupying the outside openings 1456.

FIG. 15-I illustrates a perspective view of the structural module 1500-I, which incorporates the characteristics of the structural modules 1500-G and 350. The difference between the structural module 1500-G and the structural module 1500-I is that the structural module 1500-I does not have a curved second beam 1520-G. Instead, the structural module 1500-I has second beam 1570-I and an expanding beam 1560-I. The second beam 1570-I and the second expanding beam 1560-I comprise side apertures 1514 with strips 1518.

FIG. 15-I shows a configuration in which a first pin connector 375-1 connects the second beam 1570-I to the first adjustable beam 1522 and a second pin connector 375-2 connects the expanding beam 1560-I to the second adjustable beam 1523. The first and the second pin connectors 375-1, 375-2 allow the second beam 1570-I together with the expanding beam 1560-I to change their angle with respect to the first beam 1510, the first center beam 1530, and/or the second center beam 1540. The combined length of the second beam 1570-I and the expanding beam 1560-I changes to accommodate the changes of the angle between the second beam 1570-I and the first adjustable beam 1522, and between the expanding beam 1560-I and the second adjustable beam 1523. While maintaining particular angles with the first and the second pin connectors 375-2, the first and second adjustable beams 1522, 1523 may be adjusted to change the position of the second beam 1570-I and the expanding beam 1560-I with respect to the first and second enclosing beams 1512, 1513. Thus, the position, the angle, and the combined length of the second beam 1570-I and the expanding beam 1560-I change to fit desired construction dimensions specified by developers, designers, engineers, and architects.

The pouring of building material onto the sheet 280 (not shown in FIGS. 15-C, 15-F, 15-G, 15-H, and 15-I) transforms the sheet 280 to a composite deck that permanently includes the sheet 280 and the corresponding structural module, and/or rebar and/or post-tensioned cables, surrounded by building material, as part of the composite deck. Thus, the pouring of wet building material transforms a structural module 1500, 1500-F, 1500-G, 1500-H, 1500-I into a composite deck, or a structural deck once the building material has cured.

FIG. 16-A illustrates a perspective view of structural module 1600. The structural module 1600 comprises at least one shear wall formwork 1604 incorporating the aspects of the shear wall formwork 400-W, at least one column formwork 1608 incorporating the aspects of the column formwork 400-C, and a first structural module 1500. Note that throughout FIGS. 16-A. 16-B, and 16-C, structural modules 1500 may be substituted with structural modules 200, 300, 350, 1300, 1400, 1500, 1500-F, 1500-G, 1500-H, and/or 1500-I. The shear wall formwork 1604 and the column formwork 1608 are filled with building material and have FIG. 16-B, which illustrates structural system 1600-S, shows the same aspects as FIG. 16-A but with a second structural module 1500 above the structural module 1600. Each shear wall formwork of the at least one shear wall formwork 1604 has a shear wall outside rebar row 1610, a shear wall middle rebar row 1620, and a shear wall inner rebar row 1630. Each column formwork of the at least one column formwork 1608 has a column outside rebar row 1640, a column middle rebar row 1650, and a column inner rebar row 1660.

The pouring of building material onto the sheets 280 (not shown) transforms the structural module 1500 to a composite deck that permanently includes the sheets 280, the first set of rebar 1368 and/or the second set of rebar 1370 and/or the first set of post-tensioned cables 1468 and/or the second set of post-tensioned cables 1470, the chairs 1366, the hook rebars 1360 and the corresponding structural module, surrounded by building material, as part of the composite deck. Thus, the pouring of wet building material transforms a structural module 1500 into a composite deck, or a structural deck.

FIG. 16-C illustrates a perspective view of the structural system 1600-S with a first structural module 1500 on a structural module 1600. FIG. 16-C shows that the shear wall outside rebar rows 1610 and the column outside rebar rows 1640 fall outside of the perimeter of the second structural module 1500. The shear wall middle rebar rows 1620 pass through the first bottom slot (not shown) and the first top slot 1318 of the first or the second enclosing beams 1512 or of the first or the second adjustable beams 1522 of the second structural module 1500. The column middle rebar rows 1650 pass through the second bottom slot (not shown) and the second top slot 1319 of the first beam 1510 or the second beam 1520 of the second structural module 1500. The shear wall inner rebar rows 1630 and the column inner rebar rows 1660 fall inside of the perimeter of the second structural module 1500, except for the rebar at the distal ends of the shear wall inner rebar rows 1630, which fall outside of the perimeter of the second structural module 1500. The rebar of the shear wall inner rebar rows 1630 and the column inner rebar rows 1660 is placed in shear wall pairs of rebar and column pairs of rebar, respectively. After placement of the second structural module 1500, one rebar from each of the shear wall pairs of rebar is bent down, forming a shear wall bent rebar 1670. Likewise, after placement of the second structural module 1500, one rebar from each of the column pairs of rebar is bent down, forming a column bent rebar 1680.

Sheets 280 (not shown) are affixed to the first structural module 1500. Chairs 1366 are placed on or welded to the sheets 280. A first set of rebar 1368 and/or a second set of rebar 1370 are placed on chairs 1366 and tied or welded to hook rebars 1360 on the first structural module 1500. In some embodiments, a first set of post-tensioned cables 1468 and/or a second set of post-tensioned 1470 (not shown) are placed on the sheets 280 of the first structural module 1500. In operation, sheets 280 are affixed to the structural module 1500 prior to the pairs of rebar being bent down.

FIG. 16-D illustrates a perspective view of the structural system 1600-S with the first set of rebar 1368 and the second set of rebar 1370 on the second structural module 1500 (sheets 280 not shown for clarity). When wet building material is poured over the second structural module 1500, the shear wall bent rebar 1670 and the column bent rebar 1680 are also covered by the building material, adding rigidity to the structure when the building material cures. Note that in FIGS. 16-B, 16-C, and 16-D the one or more sheets 280 are not shown to provide visual clarity for the shown aspects. Also note that the structural system 1600-S provides support for a deck on the second structural module 1500 without the need for any shoring.

It is to be understood that the structural frames and structural modules may be oriented in the y-direction or x-direction on each floor of the structure or the structural systems. The structural modules and the structural systems counteract stresses from the building moment about the y-axis, the x-axis, and the z-axis.

In some embodiments, each structural module is configured as a self-supporting structure and provides a form for the building when shipped to the build site.

One skilled in the arts will readily understand that the system may be used for smaller building sites, such as a house to permit the prefabricated and pre-engineered structural modules to be shipped to the build site.

In some embodiments, the structural decks may be applied to any structure or building type. For example, the structural decks may be used between two concrete sheer walls where the decks sit on opposing angles to form the floor, thus eliminating the need to stack the structural decks.

In some embodiments, the structural frames may act as a shoring element in a shoring scaffold system.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

An equivalent substitution of two or more elements can be made for any one of the elements in the claims below or that a single element can be substituted for two or more elements in a claim. Although elements can be described above as acting in certain combinations and even initially claimed as such, it is to be expressly understood that one or more elements from a claimed combination can in some cases be excised from the combination and that the claimed combination can be directed to a subcombination or variation of a subcombination.

It will be appreciated by persons skilled in the art that the present embodiment is not limited to what has been particularly shown and described hereinabove. A variety of modifications and variations are possible in light of the above teachings without departing from the following claims.

What is claimed is:

1. A structural module comprising:

a first beam;

a first center beam;

a first sheet supported by the first beam and the first center beam;

a second beam;

a second center beam;

a second sheet supported by the second beam and the second center beam; and a first set of rebar over the first sheet and the second sheet, wherein the first center beam and the second center beam are between the first beam and the second beam, wherein the structural module is not supported by shoring when the structural module is placed for construction; and wherein the first set of rebar passes through the first center beam and the second center beam.

2. The structural module of claim 1, further comprising:

a second set of rebar over at least one of the first sheet and the second sheet, wherein the second set of rebar has an orientation that is different from the orientation of the first set of rebar.

3. The structural module of claim 1, wherein the second beam is curved.

4. The structural module of claim 1, wherein the first beam is a C-shaped channel beam.

5. The structural module of claim 4, wherein each rebar of first set of rebar is tied to a corresponding hook rebar from a plurality of hook rebars, and wherein each hook portion of each hook rebar is within the first beam.

6. The structural module of claim 5, wherein the first beam comprises a plurality of openings, and wherein each hook rebar from the plurality of hook rebars passes through a corresponding opening of the plurality of openings.

7. The structural module of claim 4, further comprising:

a first set of tensioned cables over one or more sheets, wherein the one or more sheets provide a surface for building material to be poured on.

8. The structural module of claim 7, further comprising:

a second set of tensioned cables over the one or more sheets, wherein the second set of tensioned cables has an orientation that is different from the orientation of the first set of tensioned cables.

* * * * *